US005659329A

United States Patent [19]

Yamanobe et al.

[11] Patent Number: 5,659,329

[45] Date of Patent: Aug. 19, 1997

[54] ELECTRON SOURCE, AND IMAGE-FORMING APPARATUS AND METHOD OF DRIVING THE SAME

[75] Inventors: Masato Yamanobe, Machida; Yoshiyuki Osada; Ichiro Nomura, both of Atsugi; Hidetoshi Suzuki, Fujisawa; Tetsuya Kaneko; Hisaaki Kawade, both of Yokohama; Yasue Sato, Kawasaki; Yuji Kasanuki, Isehara; Eiji Yamaguchi, Zama; Toshihiko Takeda, Atsugi; Shinya Mishina, Nara; Naoto Nakamura, Isehara; Hiroaki Toshima, Tokyo; Aoji Isono; Noritake Suzuki, both of Atsugi; Yasuyuki Todokoro, Yokohama, all of Japan

[73] Assignee: Canon Kabushiki Kaisha, Tokyo, Japan

[21] Appl. No.: 727,233

[22] Filed: Oct. 8, 1996

Related U.S. Application Data

[63] Continuation of Ser. No. 174,447, Dec. 28, 1993, abandoned.

[30] Foreign Application Priority Data

| | | | |
|---|---|---|---|
| Dec. 19, 1992 | [JP] | Japan | 4-361355 |
| Dec. 29, 1992 | [JP] | Japan | 4-359796 |
| Jan. 7, 1993 | [JP] | Japan | 5-001224 |
| Apr. 5, 1993 | [JP] | Japan | 5-077897 |
| Apr. 5, 1993 | [JP] | Japan | 5-078165 |

[51] Int. Cl.[6] ..... G09G 3/22

[52] U.S. Cl. ..... 345/74; 313/309

[58] Field of Search ..... 345/74, 75; 313/306, 313/309, 336, 495; 315/169.1, 169.4, 366

[56] References Cited

U.S. PATENT DOCUMENTS

| | | | |
|---|---|---|---|
| 3,935,500 | 1/1976 | Oess et al. | 313/495 |
| 4,531,122 | 7/1985 | Redfield | 345/74 |
| 4,575,765 | 3/1986 | Hirt | 345/74 |
| 4,954,744 | 9/1990 | Suzuki et al. | 313/336 |
| 5,015,912 | 5/1991 | Spindt et al. | 345/74 |

(List continued on next page.)

FOREIGN PATENT DOCUMENTS

| | | |
|---|---|---|
| 6431332 | 2/1964 | Japan . |
| 45-31615 | 10/1970 | Japan . |
| 1283749 | 11/1989 | Japan . |
| 256822 | 2/1990 | Japan . |
| 320941 | 1/1991 | Japan . |

OTHER PUBLICATIONS

Araki, et al., "Electroforming and Electron Emission of Carbon Thin Films," *Journal of the Vaccum Society of Japan,* 1981, vol. 26. No. 1, pp. 22–29.

Dittmer, G., "Electrical Conduction and Electron Emission of Discontinuous Thin Films," *Thin Solid Films,* 9 (1972) pp. 317–328.

(List continued on next page.)

*Primary Examiner*—Steven Saras

*Attorney, Agent, or Firm*—Fitzpatrick, Cella, Harper & Scinto

[57] ABSTRACT

An electron source emits electrons as a function of input signals. The electron source includes a substrate, a matrix of wires having m row wires and n column wires laid on the substrate with an insulator layer interposed therebetween, and a plurality of surface-conduction electron-emitting devices each having a pair of electrodes and a thin film including an electron emitting region and arranged between the electrodes. The electron-emitting devices are so arranged as to form a matrix with the electrodes connected to the respective row and column wires. The electron source further includes a selector for selecting a row of the plurality of surface-conduction electron-emitting devices, and a modulator for generating modulation signals according to input signals and applying them to the surface-conduction electron-emitting devices selected by the selector.

54 Claims, 44 Drawing Sheets

U.S. PATENT DOCUMENTS

| | | | |
|---|---|---|---|
| 5,066,883 | 11/1991 | Yoshioka et al. | 333/309 |
| 5,160,871 | 11/1992 | Tomii et al. | 315/366 |
| 5,202,674 | 4/1993 | Takemuri et al. | 345/75 |
| 5,262,698 | 11/1993 | Dunham | 315/169.4 |

OTHER PUBLICATIONS

Dyke, et al., *Advances in Electronics and Electron Physics,* vol. VIII, 1956, Academic Press Inc., New York, NY, pp. 90–185.

Elinson, et al., "The Emission of Hot Electrons and the Field Emission of Electrons from Tin Oxide," *Radio Engineering and Electronic Physics,* Jul. 1965, No. 7, pp. 1290–1296.

Hartwell, et al., "Strong Electron Emission From Patterned Tin–Indium Oxide Thin Films," *IEDM Technical Digest,* 1975, pp. 519–521.

Mead, c.A., "Operation of Tunnel–Emission Devices," *Journal of Applied Physics,* Apr. 1961, vol. 32, No. 4, pp. 646–652.

Spindt, et al., "Physical Properties of Thin–film Field Emission Cathodes wit Molybdenum Cones," *Journal of Applied Physics,* Dec. 1976, vol. 47, No. 12, pp. 5248–5263.

STRIPE

MATRIX

A-A' SECTION

FIG.31 (1)
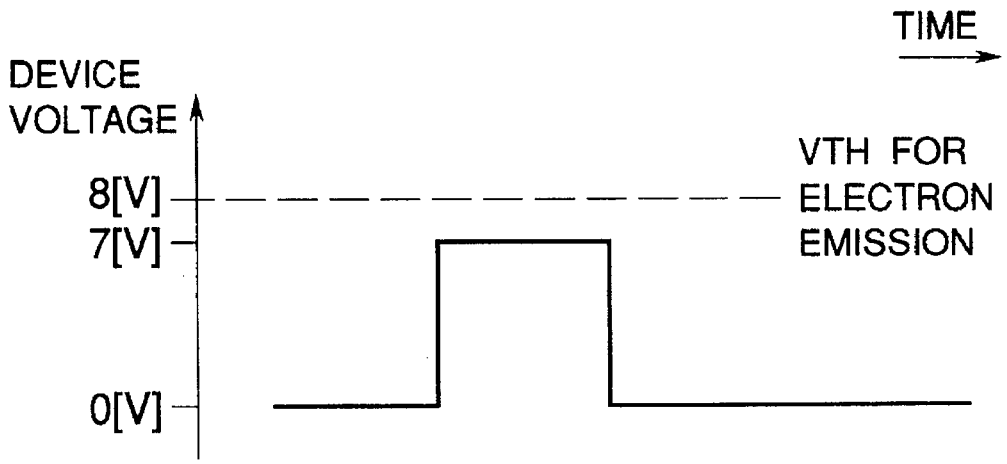
FIG.31 (2)
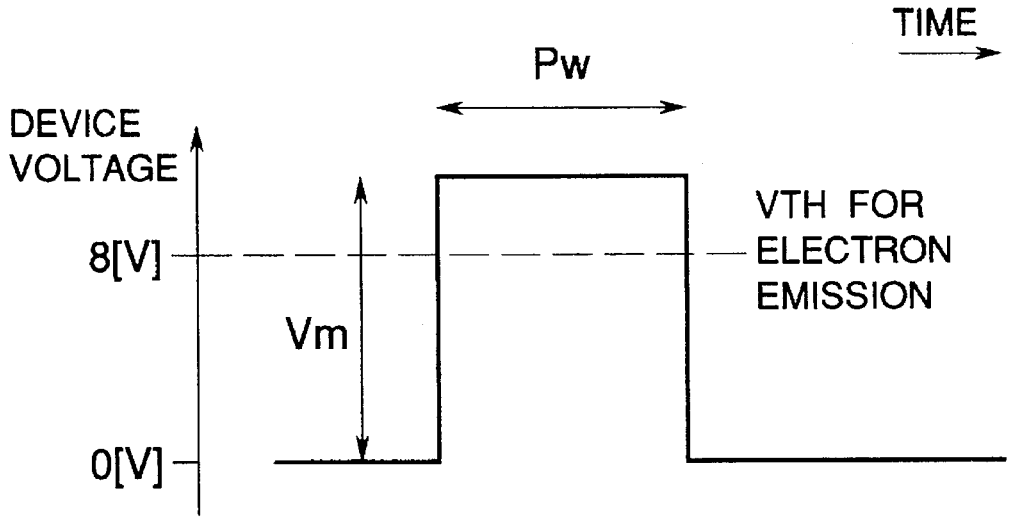

FIG.33 (1)
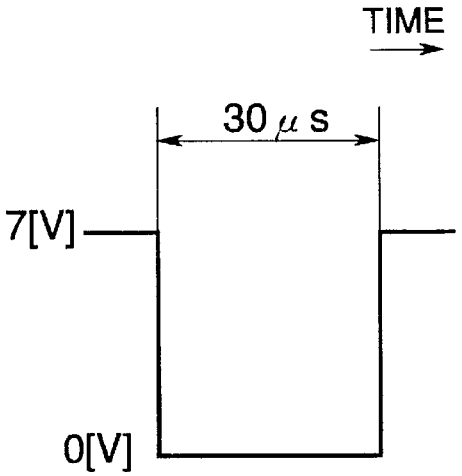
FIG.33 (2)
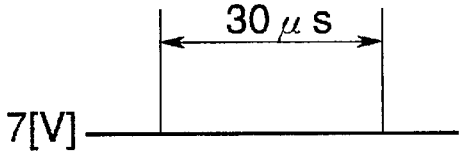
FIG.33 (3)
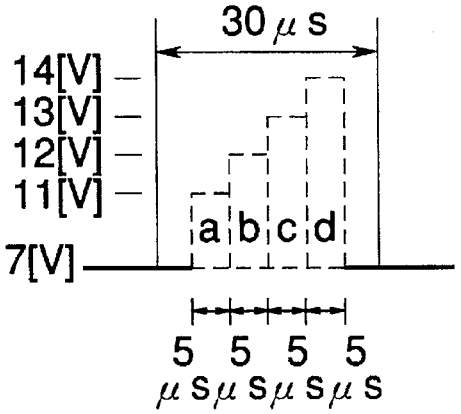
FIG.33 (4)
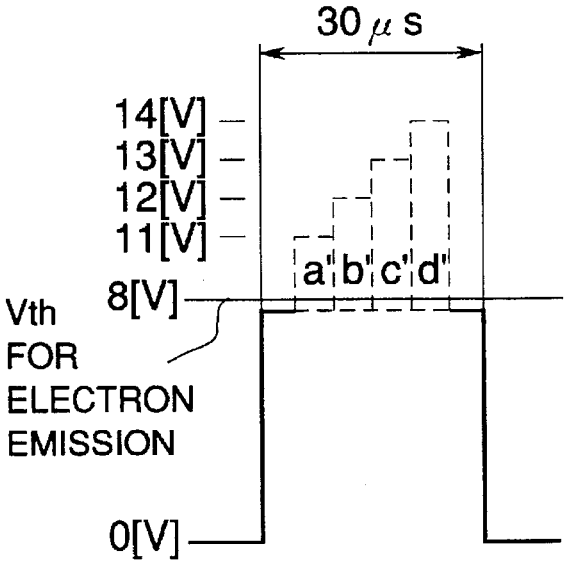
FIG.33 (5)
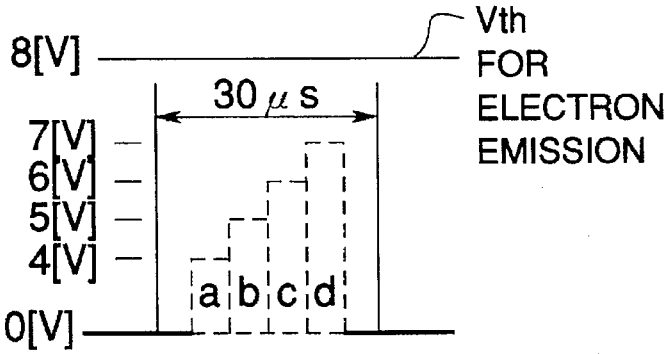

FIG.35 (1)
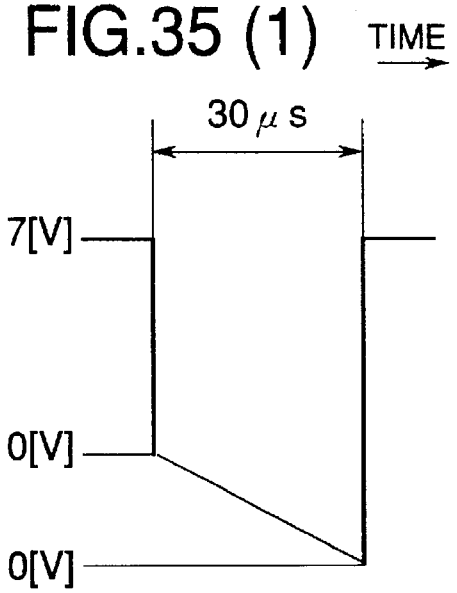
FIG.35 (2)
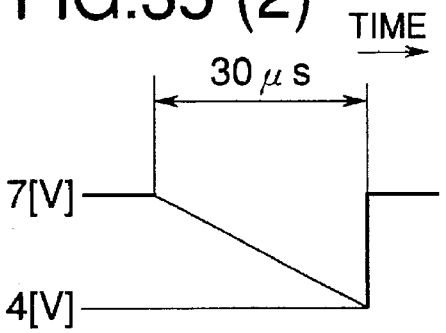
FIG.35 (3)
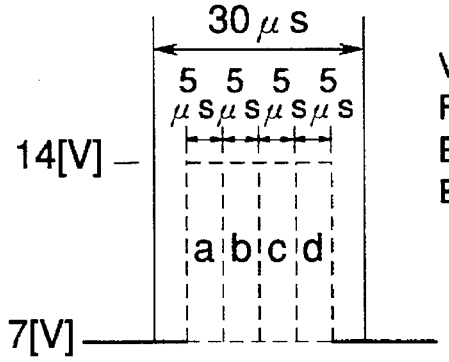
FIG.35 (4)
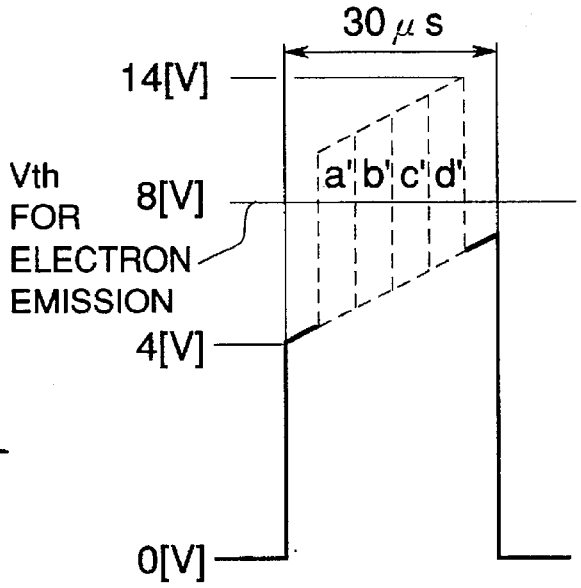
FIG.35 (5)
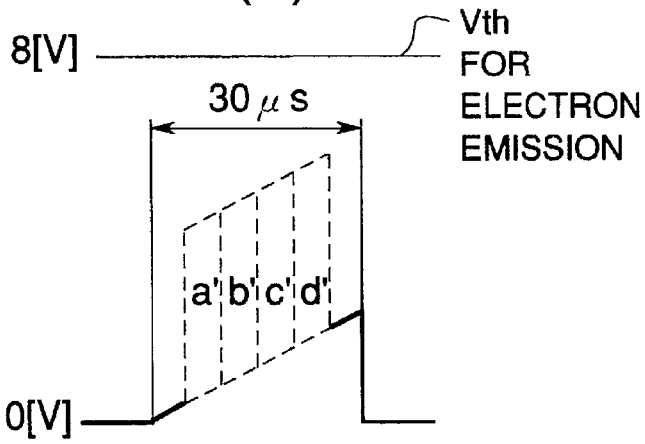

ELECTRON SOURCE, AND IMAGE-FORMING APPARATUS AND METHOD OF DRIVING THE SAME

This application is a continuation of application Ser. No. 08/174,447, filed Dec. 28, 1993, now abandoned.

BACKGROUND OF THE INVENTION

1. Field of the Invention

This invention relates to an electron source and an image-forming apparatus such as a display as an instance of application thereof, and more particularly, it relates to an electron source provided with a plurality of surface-conduction electron-emitting devices, and an image-forming apparatus such as an electronic display and a method of driving the same.

2. Related Background Art

Thermal cathodes and cold cathode electron sources are two known types of electron emitting devices, of which the latter include field-emission type (hereinafter referred to as FE type), metal/insulation layer/metal type (hereinafter referred to as MIM type) and surface-conduction electron emitting devices.

Examples of FE type devices are proposed in W. P. Dyke & W. W. Dolan, "Field emission", Advances in Electron Physics, Vol. 8, p. 89 (1956); and, A. Spindt, "Physical Properties of thin-film field emission cathodes with molybdenum cones" J. Appl. Phys., Vol. 32, p. 646 (1961).

An MIM type device is disclosed in C. A. Mead, "The tunnel-emission amplifier", J. Appl. Phys., Vol. 32, p. 646 (1961).

A surface-conduction type electron-emitting device is proposed in M. I. Elinson, Radio Eng. Electron Phys., p. 10 (1965).

A surface-conduction electron-emitting device utilizes the phenomenon that electrons are emitted out of a small thin film formed on a substrate when an electric current is forced to flow in parallel with the film surface. While Elison proposes the use of an $SnO_2$ thin film for a device of this type, the use of an Au thin film is proposed in G. Dittmer, "Thin Solid Films", 9, 317 (1971) whereas the use of an $In_2O_3/SnO_2$ thin film and that of a carbon thin film are discussed respectively in M. Hartwell and C. G. Fonstad, "IEEE Trans. ED Conf", 519 (1975), and H. Araki et al., "Vacuum", Vol. 26, No. 1, p. 22 (1983).

FIG. 43 of the accompanying drawings schematically illustrates a surface-conduction electron-emitting device proposed by M. Hartwell. In FIG. 43, reference numerals 431 and 432 respectively denote an insulator substrate and an H-shaped metal oxide film for electron-emission formed thereon by sputtering. Reference numeral 433 denotes an electron-emitting region that becomes operational when electrified in a process generally referred to as "forming", which will be described hereinafter. The entire thin film including the electron-emitting region is designated by numeral 434 in FIG. 43. For a device as illustrated in FIG. 43, L1 is between 0.5 and 1 mm and W is equal to 0.1 mm.

An electron-emitting region 433 is produced in a surface-conduction electron-emitting device normally by electrifying a thin film 432 for electron-emission on the device, a process generally referred to as "forming". More specifically, a DC voltage or a slowly rising voltage that rises, for instance, at a rate of 1 V/min. is applied to the opposite ends of the thin film 432 for electron-emission to locally destroy, deform, or structurally modify the thin film 432 for electron-emission to produce fissures in a part of the thin film, which constitute an electrically highly resistive electron-emitting region 433. Once the surface-conduction electron-emitting device is processed for forming, electrons will be emitted from those fissures and their neighboring areas when a voltage is applied to the thin film 434 including the electron-emitting region 433 to cause an electric current to flow through the device.

Known surface-conduction electron-emitting devices are, however, accompanied by problems when they are put to practical use. The applicant of the present patent application who has been engaged in the technological field under consideration has already proposed a number of improvements to the existing technologies in order to solve some of the problems, which will be described in greater detail hereinafter.

Surface-conduction electron-emitting devices are, on the other hand, advantageous in that they can be used in arrays in great numbers over a large area because they are structurally simple and hence can be manufactured at low cost in a simple way. In fact, many studies have been made to exploit this advantage and applications that have been proposed as a result of such studies include charged beam sources and electronic displays.

A large number of surface-conduction electron-emitting devices can be arranged in an array to form a matrix of devices that operates as an electron source, where the devices of each row are wired and regularly arranged to produce columns. (See, for example, Japanese Patent Application Laid-open No. 64-31332 of the applicant of the present patent application.)

As for image-forming apparatuses such as displays, although very flat displays comprising a liquid crystal panel in place of a CRT have gained polularity in recent years, such displays are not without problems. One of such problems is that a light source needs to be additionally incorporated into the display in order to illuminate the liquid crystal panel because liquid crystal does not emit light by itself. An emissive electronic display that is free from this problem can be realized by using a light source formed by arranging a large number of surface-conduction electron-emitting devices in combination with fluorescent bodies that are induced to selectively shed visible light by electrons emitted from the electron source. With such an arrangement, an emissive display apparatus having a large display screen and enhanced display capabilities can be manufactured relatively easily at low cost. (See, for example, U.S. Pat. No. 5,066,883 of the applicant of the present patent application.)

Incidentally, the emissive display apparatus of the above identified category comprising an electron source formed by a large number of surface-conduction electron-emitting devices and fluorescent bodies can be operated by drive signals that are applied to the wires connecting the respective surface-conduction electron-emitting devices arranged in rows (row wires) and to the control electrodes arranged in the space separating the electron source and the fluorescent bodies along a direction perpendicular to the row wires (grids or column electrodes). (See, for example, Japanese Patent Application Laid-open No. 1-283749 of the applicant of the present patent application).

There are, however, a number of difficulties that have to be overcome before such a display apparatus becomes commercially feasible. Some of the difficulties include the problem of accurately aligning individual surface-conduction electron-emitting devices and corresponding individual grids and the problem of securing a uniform distance between each grid and the corresponding surface-conduction electron emitting device, both of which are manufacture-related problems. In an attempt to solve these manufacture-related problems, there has been proposed an improved display apparatus of the category under consideration, in which the grids are formed into a layer and laid on the layer of the surface-conduction electron-emitting devices to produce a multilayer structure. (See, for example, Japanese Patent Application Laid-open No. 3-20941 of the applicant of the present patent Application.)

FIGS. 44 and 45 illustrate a known typical electronic display comprising conventional surface-conduction electron-emitting devices as disclosed Japanese Patent Publication No. 45-31615. Referring to FIGS. 44 and 45, it comprises transversal current type electron-emitting bodies 442 connected in series, strip-shaped transparent electrodes 444 arranged perpendicularly to the electron-emitting bodies 442 to form a lattice therewith and a glass panel 443 provided with a number of small holes 443' and disposed between the electron-emitting bodies and the electrodes in such a manner that the holes are located on the respective crossings of the electron-emitting bodies and the electrodes. Each of the holes 443' contains gas hermetically sealed therein so that the display emit light by gas-electric discharge only at the crossings of those transversal current type electron-emitting bodies 442 that are currently discharging electrons and those transparent electrodes 444 to which an accelerating voltage E2 is currently being applied. While Japanese Patent Publication No. 43-31615 does not describe the transversal current type electron-emitting body in detail, it may safely be presumed that it is a surface-conduction electron-emitting device because the materials (metal thin film, mesa film) and the structural features of the neck 442' described there exactly match their counterparts of a surface-conduction electron-emitting device. For the purpose of the present invention, the term "surface-conduction electron-emitting device" is used in the sense as defined in "The Thin Film Handbook".

Now, some of the problems that have arisen with electronic displays comprising known surface-conduction electron-emitting devices will be discussed below.

Three major problems have been pointed out for a display apparatus disclosed in the above cited Japanese Patent Publication No. 45-31615.

(1) While the display apparatus is designed to operate for electric discharge as electrons emitted from the transversal current type electron-emitting bodies are accelerated and caused to collide with gas molecules, the pixels of the apparatus can glow by electric discharge with different levels of luminance and the luminance of a same pixel can fluctuate when the transversal current type electron-emitting bodies are energized to a same intensity. One of the possible reasons for this may be that the intensity of electric discharge of such an apparatus is heavily dependent on the state of the gas in the apparatus and not satisfactorily controllable, while another may be that the output level of a transversal current type electron-emitting body cannot necessarily be stabilized if the gas pressure is somewhere around 15 mmHg as described in the Examples section of the cited patent document.

Thus, the above described display apparatus is not able to provide any multiple-tone display and therefore can offer only a limited scope of use.

(2) While the display apparatus can change the color for display by using a different type of gas, the use of various gases does not necessarily extend the scope of color display because the wavelength of visible light generated by electric discharge does not cover a wide range. Additionally, the optimum gas pressure used for the emission of light by electric discharge varies as a function of the type of gas involved.

Thus, in order to achieve a color display by using a single panel, different gases must be sealed in the holes with varied gas pressures depending on the locations of the holes, making the manufacture of such an apparatus extremely difficult. If, for example, three laminated panels are used for a display apparatus to avoid this problem, it will become unrealistically heavy and the manufacturing cost will be prohibitive to produce such a heavy apparatus.

(3) Since the display apparatus comprises a large number of components including the substrates of the transversal current type electron-emitting bodies, the strip-shaped transparent electrodes and the holes where gas is hermetically sealed, it is structurally very complicated and hence only a very small error margin is allowed for aligning the components. Additionally, since the threshold voltage used for the emission of light by electric discharge is as high as 35 [V] as described in the cited document, each electric element used in the panel drive circuit is required to show a high withstand voltage.

Thus, manufacturing such a display apparatus is complicated and expensive.

It is mainly due to the above reasons that an electronic display of the above described type has not been able to find any practical applications in the field of television receiving sets and other similar electronic apparatuses.

On the other hand, the image-forming apparatuses proposed by the applicant of the present patent application and comprising an electron source formed by arranging a number of surface-conduction electron-emitting devices and a same number of fluorescent bodies juxtaposed therewith are not without problems.

Firstly, in order to realize such an electron source, it is indispensable to arrange grids along a direction (column-directed wiring) perpendicular to the wires connecting the electron-emitting devices arranged in parallel (row-directed wiring) if the devices are selectively made to emit electrons. In this regard, no simple and easy process has been developed for manufacturing an electron source with which devices are selected for the emission of electrons and the level of electron emission is controllable.

Secondly, in order for the fluorescent bodies of such an image-forming apparatus arranged in juxtaposition with the electron source to emit light at selected locations with a controlled level of luminance, a certain number of grids need indispensably be provided as in the case of the electron source. Again, no simple and easy process has been developed for manufacturing an image-forming apparatus comprising such fluorescent bodies, with which electron-emitting devices can be selected with difficulty to cause them emit light at a controlled level according to incoming signals so that the fluorescent bodies may be made to glow at selected locations with a controlled level of luminance.

SUMMARY OF THE INVENTION

In view of the above identified problems, it is therefore an object of the invention to provide a novel electron source comprising a large number of surface-conduction electron-emitting devices adapted to be selectively energized to emit electrons at varied amounts under the control of input signals. According to the invention, such an electron source can be manufactured at low cost because of its simple configuration and used in combination with a fluorescent material arranged vis-a-vis the electron source to produce a high quality image-forming apparatus capable of displaying images in color and in a multitude of tones. It is another object of the present invention to provide a method of effectively driving such an electron source.

Still another object of the invention is to provide an image-forming apparatus comprising such an electron source and capable of displaying images with good gradation as well as a method of effectively driving the same.

A further object of the invention is to provide an image-forming apparatus comprising such as an electron source and an image display screen provided with pixels that are ingeniously so configured as to be free from crosstalks.

According to an aspect of the invention, the above objects are achieved by providing an electron source adapted to emit electrons as a function of input signals comprising a substrate, a matrix of wires having m row wires and n column wires laid on the substrate with an insulator layer interposed therebetween and a plurality of surface-conduction electron-emitting devices each having a pair of electrodes and a thin film including an electron emitting section and arranged between the electrodes, the electron-emitting devices being so arranged as to form a matrix with the electrodes connected to the respective row and column wires, the electron source further comprising a selector for selecting some of the plurality of surface-conduction electron-emitting devices and applying modulation signals thereto, and a modulator for generating modulation signals according to input signals and applying them to the surface-conduction electron-emitting devices selected by the selector.

According to another aspect of the invention the above objects are achieved by providing an image-forming apparatus adapted to form images as a function of input signals comprising an electron source and an image-forming member, the electron source by turn comprising a substrate, a matrix of wires having m row wires and n column wires laid on the substrate with an insulator layer interposed therebetween and a plurality of surface-conduction electron-emitting devices each having a pair of electrodes and a thin film including an electron-emitting section and arranged between the electrodes, the electron-emitting devices being so arranged as to form a matrix corresponding to that of pixels of the apparatus with the electrodes connected to the respective row and column wires, the image-forming apparatus further including a selector for selecting and some of the plurality of surface-conduction electron-emitting devices and applying modulation signals thereto and modulator for generating modulation signals according to input signals and applying them to the surface-conduction electron-emitting devices selected by the selection means.

BRIEF DESCRIPTION OF THE DRAWINGS

FIGS. 31(1) and 31(2) are graphs showing the relationship between the time and the drive voltage applied to an electron-emitting device of the fourth embodiment.

FIGS. 33(1) through 33(5) are graphs showing the relationship between the time and the drive voltage applied to an electron-emitting device of the fifth embodiment.

FIGS. 35(1) through 35(5) are graphs showing the relationship between the time and the drive voltage applied to an electron-emitting device of the sixth embodiment of FIG. 34.

DETAILED DESCRIPTION OF THE PREFERRED EMBODIMENTS

Now, the present invention will be described in greater detail by way of preferred embodiments of the invention.

Firstly, by referring to Japanese Patent Application Laid-open No. 2-56822, of the applicant of the present patent application, some of the fundametal structural and functional features of an electro-emitting device, particularly of a surface-conduction electron-emitting device, that provides a basic unit of an electron source and an image-forming apparatus according to the invention will be discussed along with a preferred method of manufacturing such a device.

Some of the features of a surface-conduction electron-emitting device to be used for the purpose of the present invention include the following.

1) A thin film to be used for an electron-emitting region of a device is basically constituted of fine particles that are dispersed or obtained by sintering organic meatl before it is electrically treated by a process called "forming".

2) After the "forming" process, both the electron-emitting region and the remaining areas of the thin film including the electron-emitting region are also constituted of fine particles.

There are two alternative profiles that can be taken for a surface-conduction electron-emitting device to be used for the purpose of the invention, a planar profile and a stepwise profile.

Firstly, a plane type surface-conduction electron-emitting device will be described.

Figure 1A:
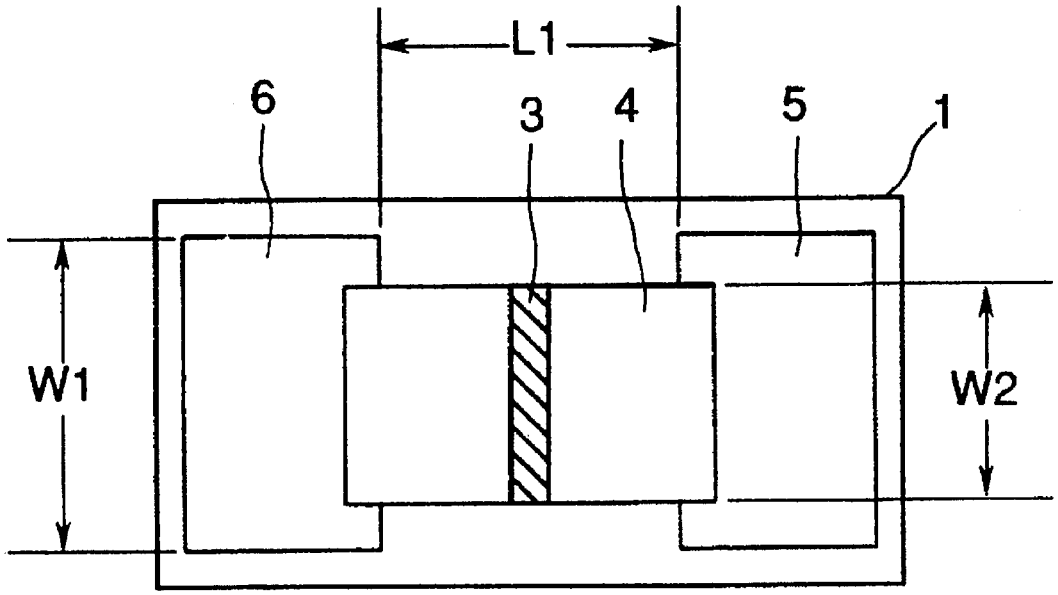
FIGS. 1A and 1B are schematic views illustrating the basic configuration of a plane type surface-conduction electron-emitting device that can be used for the purpose of the present invention.
Figure 1B:
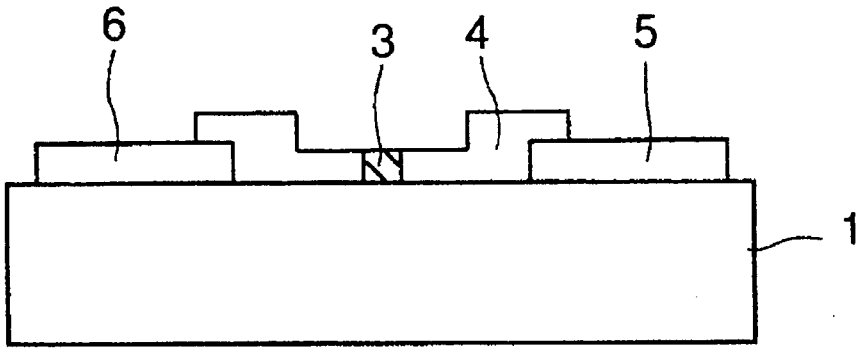

FIGS. 1A and 1B are schematic plan view and a sectional view of a plane type surface-conduction electron-emitting device.

As shown in FIGS. 1A and 1B, the device comprises a substrate 1, a pair of electrodes 5 and 6 (referred to as device electrodes hereinafter) and a thin film 4 including an electron-emitting region 3.

The substrate 1 is preferably a substrate such as a glass substrate made of quartz glass, glass containing Na and other impurities to a reduced level or soda lime glass, a multilayer glass substrate prepared by forming a $SiO_2$ layer on a piece of soda lime glass by sputtering or a ceramic substrate made of a ceramic material such as alumina.

While the oppositely arranged device electrodes 5 and 6 may be made of any conductor material, preferred candidate materials include metals such as Ni, Cr, Au, Mo, W, Pt, Ti, Al, Cu and Pd, their alloys, printable conductor materials made of a metal or a metal oxide selected from Pd, Ag, $RuO_2$, Pd-Ag and glass, transparent conductor materials such as $In_2O_3$—$SnO_2$ and semiconductor materials such as polysilicon.

The distance L1 separating the electrodes is between hundreds angstroms and hundreds micrometers and determined as a function of various technical aspects of photolithography to be used for manufacturing the device, including the performance of the aligner and the etching method involved, and the voltage to be applied to the electrodes and the electric field strength designed for electron emission. Preferably it is between several micrometers and tens of several micrometers.

The lengths W1 of the electrode 6 and the thickness of the device electrodes 5 and 6 may be determined on the basis of requirements involved in designing the device such as the resistances of the electrodes, the connections of the row and column wires, or X- and Y-wires as they are referred to hereinafter, and the arrangement of the plurality of electron-emitting devices, although the length of the electrode 6 is normally between several micrometers and several hundred micrometers and the thickness of the device electrodes 5 and 6 is typically between several hundred angstroms and several micrometers.

The thin film 4 of the device that includes an electron-emitting region is partly laid on the device electrodes 5 and 6 as seen in FIG. 1B. Another possible alternative arrangement of the components of the device will be such that the area 2 of the thin film 4 for preparing an electron-emitting region is firstly laid on the substrate 1 and then the device electrodes 5 and 6 are oppositely arranged on the thin film. Still alternatively, it may be so arranged that all the areas of the thin film found between the oppositely arranged device electrodes 5 and 6 operate as an electron-emitting region.

The thickness of the thin film 4 including the electron-emitting region is preferably between several angstroms and several thousand angstroms and most preferably between 10 and 500 angstroms. It is determined as a function of the step coverage of the thin film 4 to the device electrodes 5 and 6, the resistance between the electron-emitting region 3 and the device electrodes 5 and 6, the mean size of the conductor particles of the electron-emitting region 3, the parameters for the forming operation that will be described later and other factors. The thin film 4 normally shows a resistance per unit surface area between $10^{-3}$ and $10^{-7}$ $\Omega/cm^2$.

The thin film 4 including the electron-emitting section is made of fine particles of a material selected from metals such as Pd, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LAB_6$, $CeB_6$, $YB_4$ and $GdB_4$, carbides such TiC, ZrC, HfC, TaC, SiC and WC, nitrides such as TiN, ZrN and HfN, semiconductors such as Si and Ge and carbon as well as other metals and metal compounds such as AgPd, NiCr, Pb and Sn.

The term "a fine particle film" as used herein refers to a thin film constituted of a large number of fine particles that may be loosely dispersed, tightly arranged or mutually and randomly overlapping (to form an island structure under certain conditions).

The electron-emitting region 3 is constituted of a large number of fine conductor particles with a mean particle size of preferably between several angstroms and several hundreds of angstroms and most preferably between 10 and 500 angstroms, and the thickness of the thin film 4 including the electron-emitting region is determined depending on a number of factors including the method selected for manufacturing the device and the parameters for the forming operation that will be described later. The material of the electron-emitting region 3 may be selected from all or part of the materials that can be used to prepared the thin film 4 including the electron-emitting region.

Figure 2A:
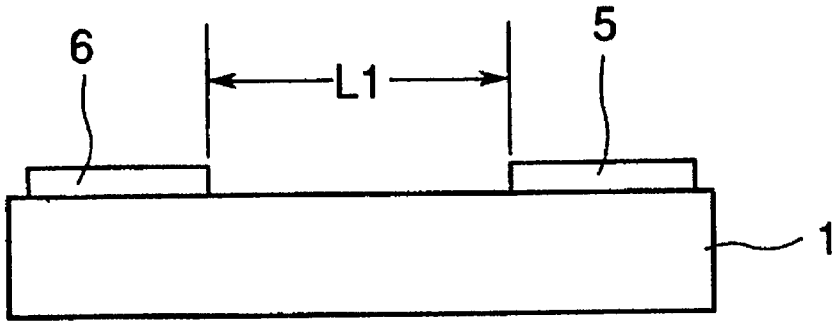
FIGS. 2A through 2C are schematic views illustrating different steps of manufacturing a surface-conduction electron-emitting device to be used for the purpose of the invention.
Figure 2B:
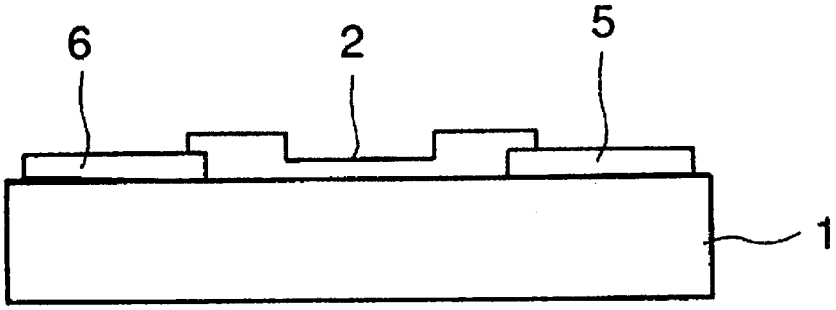
Figure 2C:
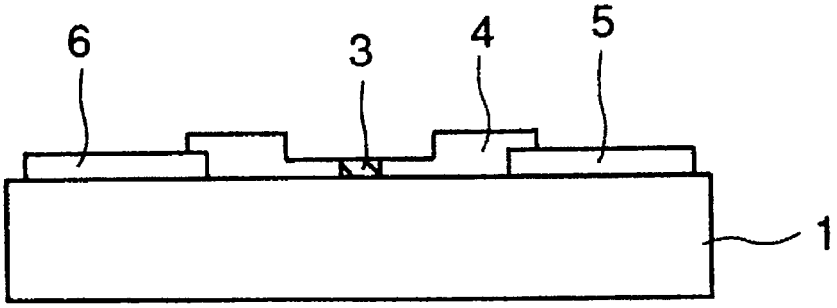

While a number of different methods may be used for manufacturing an electron-emitting device comprising an electron-emitting region 3, FIGS. 2A through 2C illustrate different steps of a specific method. In FIGS. 2A through 2C, reference numeral 2 denotes a thin film to be used for an electron-emitting region and may typically be a fine particle film.

Now, the method will be described below.

1) After a substrate 1 is thoroughly washed with detergent, pure water and organic solvent, a selected electrode material is deposited thereon at oppositely arranged locations by means of vacuum deposition, sputtering or some other appropriate technique and then processed by photolithography to produce a pair of device electrodes 5 and 6 (FIG. 2A).

2) An organic metal solution is applied to the surface of the substrate 1 as well as the device electrodes 5 and 6 on the substrate and let to dry to produce an organic metal thin film. The organic metal solution is a solution of an organic compound of a metal selected from Pd, Ru, Ag, Au, Ti, In, Cu, Cr, Fe, Zn, Sn, Ta, W and Pb as listed earlier. Thereafter, the formed organic metal thin film is heated for sintering and then subjected to a patterning operation, using a lift-off or etching technique, to produce a thin film 2 for preparing an electron-emitting region (FIG. 2B). While the organic metal thin film is prepared by applying an organic metal solution onto the substrate in the above description, such as film may also be formed by using a different technique such as vacuum deposition, sputtering, chemical vacuum deposition, distributed application, dipping or spinner.

3) Subsequently, the device electrodes 5 and 6 are subjected to a so-called forming operation, where a pulsed or rapidly increasing voltage is applied to them by a power source (not shown) to locally modify the structure of the thin film in an area that becomes an electron-emitting region 3 (FIG. 2C). More specifically, the thin film 2 is locally destroyed, deformed or structurally modified as it is electrified to become an electron-emitting section 3. As described above, the inventors of the present invention has proved through observation that the electron-emitting region 3 is constituted of fine conductor particles.

Figure 4:
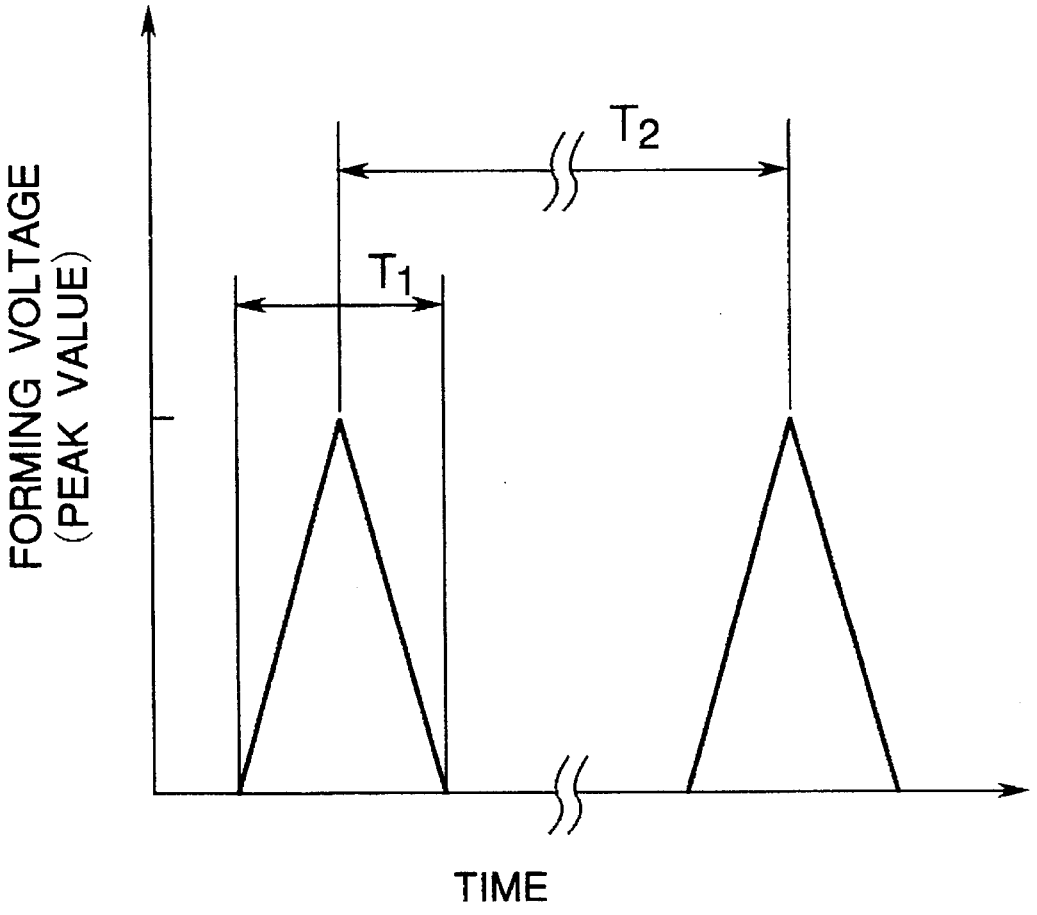
FIG. 4 is a graph showing a voltage waveform to be used for forming a surface-conduction electron-emitting device to be used for the purpose of the invention.

FIG. 4 shows a graph illustrating the voltage waveform to be used for a forming operation.

In FIG. 4, T1 and T2 respectively indicate the pulse width and the pulse interval of triangular pulsed voltage waves, T1 being between 1 microsecond and 10 milliseconds, T2 being between 10 microseconds and 100 milliseconds, the level of the peaks of the waves (peak voltage for forming) being, e.g. and between 4 V and 10 V. The forming operation is conducted for a time period between tens of seconds to several minutes in a vacuum atmosphere.

While a varying voltage in the form of triangular pulses is applied to the electrodes of an electron-emitting device in order to produce an electron-emitting region, it may not necessarily take a triangular form and rectangular waves or waves in some other form may alternatively be used. Likewise, other appropriate values may be selected for the pulse width, the pulse interval and the peak level to optimize the performance of the electron-emitting region to be produced depending on the intended resistance of the electron-emitting device.

If the thin film for preparing the electron-emitting region of an electron-emitting device according to the invention is formed by dispersing fine conductor particles, the above described forming process may be partly modified.

Now, some of the functional features of a electron-emitting device according to the invention and prepared in the above described manner will be described by referring to FIGS. 3 and 5.

Figure 3:
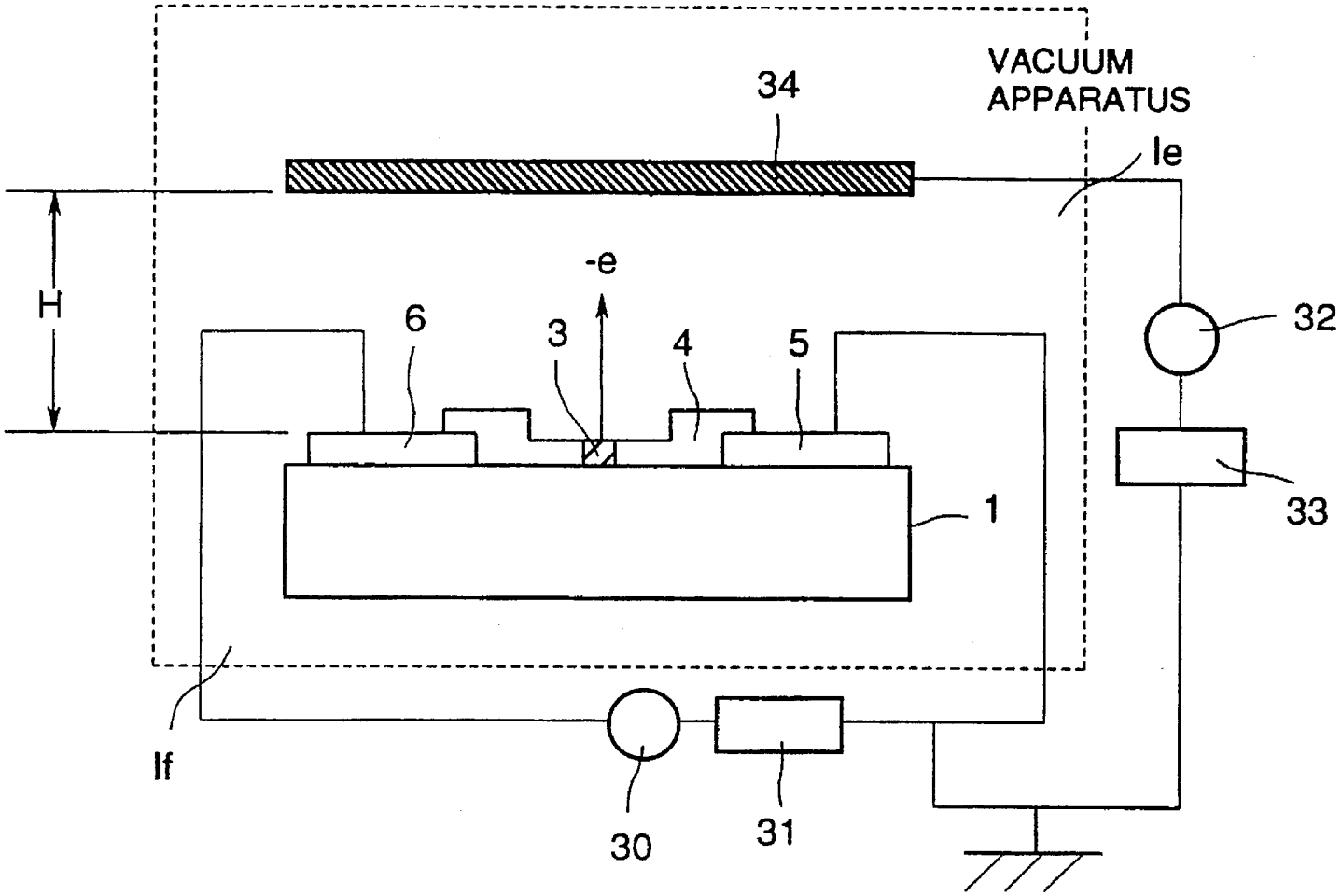
FIG. 3 is a block diagram of a measuring system for determining the performance of a surface-conduction electron-emitting device to be used for the purpose of the invention.

FIG. 3 is a schematic block diagram of a measuring system for determining the performance of an electron-emitting device having a configuration as illustrated in FIGS. 1A and 1B.

In FIG. 3, an electron-emitting device comprising a substrate 1, a pair of device electrodes 5 and 6, a thin film 4 including an electron-emitting region 3 is placed in position in a measuring system comprising on its part a power source 31 for applying voltage Vf to the device (referred to as device voltage Vf hereinafter), an ammeter 30 for measuring the electric current running through the thin film 4 including the electron-emitting region and between the device electrodes 5 and 6, an anode 34 for capturing the emission current emitted from the electron-emitting region 3 of the device, a high voltage source 33 for applying a voltage to the anode 34 and another ammeter 32 for measuring the emission current Ie emitted from the electron-emitting region 3.

When measuring the current If running through the device (referred to as device current hereinafter) and the emission current Ie, the device electrodes 5 and 6 are connected to the power source 31 and the ammeter 30, and the anode 34 connected to the power source 33 and the ammeter 32 is placed above the device. The electron-emitting device and the anode 34 are put into a vacuum chamber, which is provided with an exhaust pump, a vacuum gauge and other pieces of equipment necessary to operate a vacuum chamber so that the measuring operation can be conducted under a desired vacuum condition. Incidentally, the exhaust pump comprises an ordinary high vacuum system constituted of a turbo pump and a rotary pump and an ultra high vacuum system constituted of an ion pump. The entire vacuum chamber and the substrate of the electron-emitting device can be heated to approximately 200° C. by a heater (not shown). A voltage between 1 KV and 10 KV is applied to the anode, which is spaced apart from the electron-emitting device by distance H between 2 mm and 8 mm.

As a result of intensive studies carried out on electron-emitting devices for the purpose of the present invention, the inventors of the present invention discovered critical functional features that paved the way to the present invention.

Figure 5:
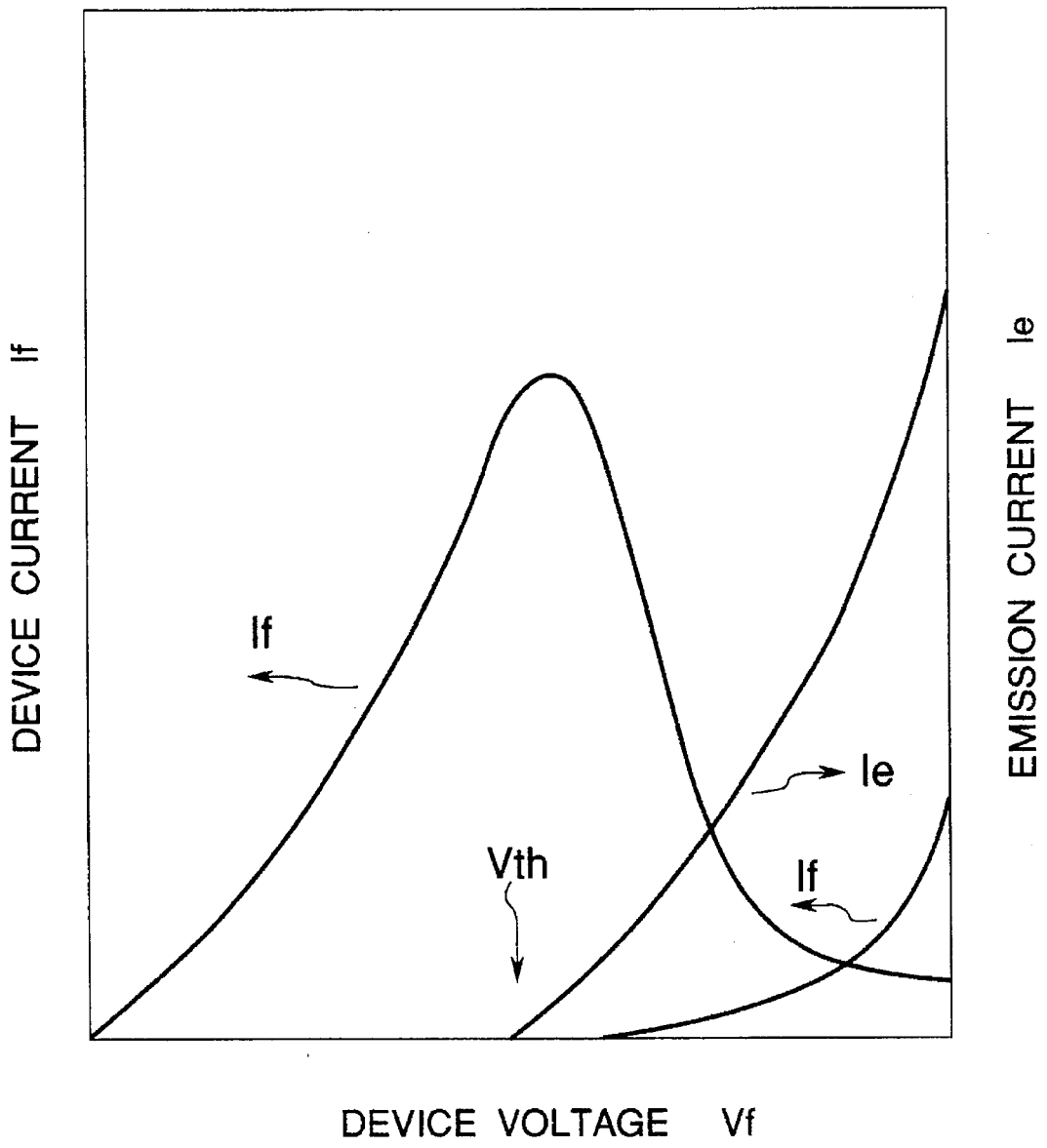
FIG. 5 is a graph showing the relationship between the voltage applied to a surface-conduction electron-emitting device to be used for the purpose of the invention and the current that flows therethrough as well as the relationship between the voltage and the emission current of the device.

FIG. 5 shows a graph schematically illustrating the relationship between the device voltage Vf, i.e. a drive voltage applied to the device electrodes, and the emission current Ie and the device current If typically observed by the measuring system of FIG. 3. Note that different units are arbitrarily selected for Ie and If in FIG. 5 in view of the fact that Ie has a magnitude smaller by far than that of If. As seen in FIG. 5, an electron-emitting device according to the invention has three remarkable features in terms of emission current Ie, which will be described below.

Firstly, an electron-emitting device according to the invention shows a sudden and sharp increase in the emission current Ie when the voltage applied thereto exceeds a certain level (which is referred to as a threshold voltage hereinafter and indicated by Vth in FIG. 5), whereas the emission current Ie is practically unobservable when the applied voltage is found that the threshold value Vth. Differently stated, an electron-emitting device according to the invention is a non-linear device having a clear threshold voltage Vth to the emission current Ie.

Secondly, since the emission current Ie is highly dependent on the device voltage Vf, the former can be effectively controlled by way of the latter.

Thirdly, the emitted electric charge captured by the anode 34 is a function of the duration of time of applying the device voltage Vf. In other words, the amount of electric charge captured by the anode 34 can be effectively controlled by way of the time during which the device voltage Vf is applied.

Because of the above remarkable features, an electron-emitting device according to the invention may find a variety of applications.

On the other hand, the device current If either rises monotonically relative to the device voltage Vf (as shown by a solid line in FIG. 5, a characteristic referred to as MI, i.e. monotonic increase, characteristic hereinafter) or varies to show a form specific to a voltage-controlled-negative-resistance (as shown by a broken line in FIG. 5, a characteristic referred to as VCNR characteristic hereinafter). The inventors of the present discovered that the either of the above features of the device current If appears depending on how the electron emitting device is actually manufactured.

More specifically, the device current If of an electron-emitting device can take on a VCNR characteristic when the device is subjected to a forming operation in an ordinary vacuum system, although it can greatly vary depending on the vacuum degree and electric conditions of the measuring system during and after the forming operation, including the rate at which the voltage applied to the device is raised to obtain a particular current-voltage relationship for the device and the time during which the device is left in the vacuum chamber before the device is tested for its performance. Note that the emission current Ie always shows an MI characteristic.

In view of the above described discoveries, the inventors of the present invention carried out an experiment where an electron-emitting device whose device current If had been showing a VCNR characteristic in an ordinary vacuum system was baked in an ultra high vacuum system at high temperature (e.g., 100° C. for 15 hours) and found that after the baking operation both the device current If and the emission current Ie showed an MI feature if subjected to device voltage Vf.

It should be noted that, while a monotonically increasing device current If is observed on a device as disclosed in Japanese Patent Application Laid-open No. 1-279542 of the applicant of the present patent application when the device is subjected to a voltage rising at a relatively high rate after it is processed by a forming operation in an ordinary vacuum system, it is different from the emission current Ie and the device current If of an electron-emitting device according to the invention that monotonically increases with the device voltage after it is processed in an ultra high vacuum system and therefore they may safely be assumed to be totally different from each other.

Thus, the above described monotonically increasing relationship between the current voltage Vf and the device current If and between the current voltage Vf and the emission current Ie of an electron-emitting device according to the invention may provide a wide areas of application for the device in future.

Now, a surface-conduction electron-emitting device having an alternative profile, or a step type electron-emitting device, will be described.

Figure 6:
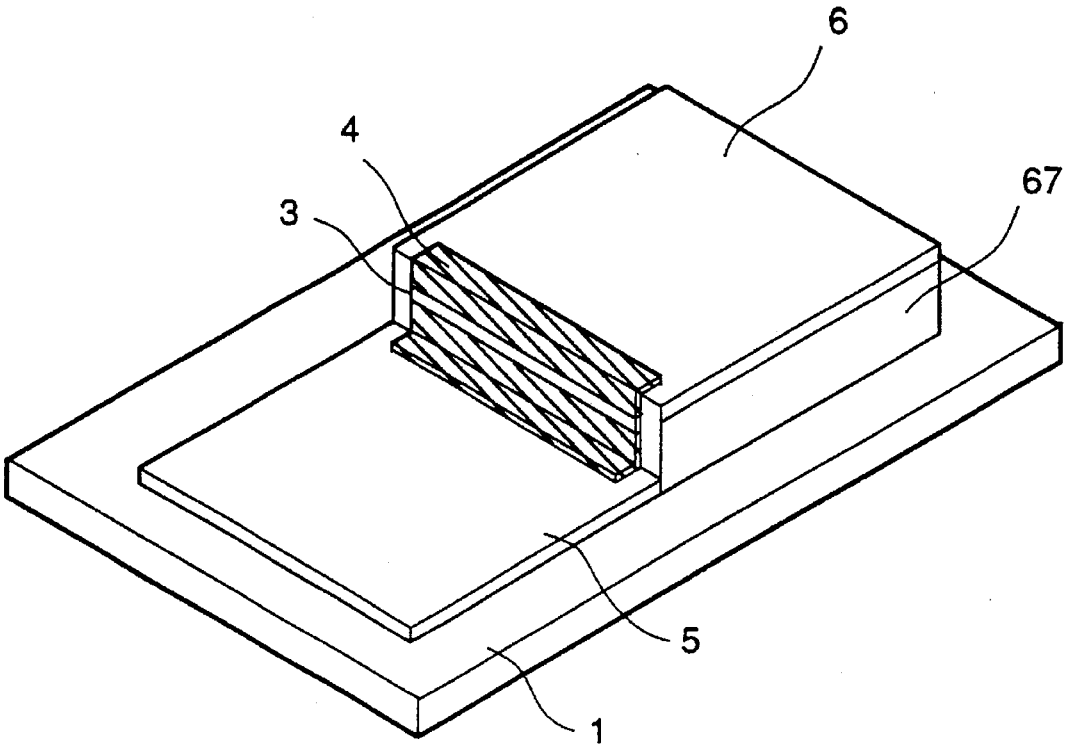
FIG. 6 is a schematic perspective view of a step type surface-conduction electron-emitting device that can be used for the purpose of the invention.

FIG. 6 is a schematic perspective view of a step type surface-conduction electron-emitting device according to the invention.

As seen in FIG. 6, the device comprises a substrate 1, a pair of device electrodes 5 and 6, a thin film 4 including an electron-emitting region 3 and a step-forming section 67. Since the substrate 1, the device electrodes 5 and 6 and the thin film 4 including the electron-emitting region 3 are prepared from the materials same as those of their counterparts of a plane type electron-emitting device as described above, only the step-forming section 67 and the thin film 4 including the electron-emitting region 3 that characterize this device will be described in detail here.

The step-forming section 67 is made of an insulator material such as $SiO_2$ and formed there by vacuum deposition, printing, sputtering or some other appropriate technique to a thickness between several hundred angstroms and several tens of micrometers, which is substantially equal to the distance L1 separating the electrodes of a plane type electron-emitting device described earlier, although it is determined as a function of the technique selected for forming the step-forming section, the voltage to be applied to the electrodes of the device and the electric field strength available for electron emission and preferably found between several thousand angstroms and several micrometers.

As the thin film 4 including the electron-emitting region is formed after the device electrodes 5 and 6 and the step-forming section 67, it may preferably be laid on the device electrodes 5 and 6 and so shaped as to form suitable electrical connection with the device electrodes 5 and 6. The thickness of the thin film 4 including the electron-emitting region is a function of the method of preparing it and, in many cases, varies on the step-forming section and on the device electrodes 5 and 6. Normally, the thin film 4 is made less thick on the step-forming section than on the electrodes.

The electron-emitting region 3 may be formed in any appropriate area of the thin film 4 other than the one in FIG. 6.

While a surface-conduction electron-emitting device according to the invention is described above in terms of its basic configuration and manufacturing method, such a device may be prepared with any other configuration and manufacturing method without departing from the scope of the invention so long as it is provided with the above defined three features and appropriately used for an electron source or an image-forming apparatus.

Now, an electron source and an image-forming apparatus according to the invention utilizing such an electron-emitting device will be described.

As described earlier, a surface-conduction electron-emitting device according to the invention is provided with three remarkable features. Firstly, it shows a sudden and sharp increase in the emission current Ie when the voltage applied thereto exceeds a certain level (which is referred to as a threshold voltage hereinafter and indicated by Vth in FIG. 5), whereas the emission current Ie is practically unobservable when the applied voltage is found lower than the threshold value Vth. Differently stated, an electron-emitting device according to the invention is a non-linear device having a clear threshold voltage Vth to the emission current Ie.

Secondly, since the emission current Ie is dependent on the device voltage Vf, the former can be effectively controlled by way of the latter.

Thirdly, the emitted electric charge captured by the anode 34 is a function of the duration of time of applying the device voltage Vf. In other words, the amount of electric charge captured by the anode 34 can be effectively controlled by way of the time during which the device voltage Vf is applied.

Consequently, electrons emitted from the surface-conduction electron-emitting device are controlled by the peak level and the width of the pulse of the pulse-shaped voltage applied to the oppositely arranged device electrodes under the threshold voltage, whereas practically no electrons are emitted beyond the threshold voltage. Thus, an apparatus comprising a large number of such surface-conduction electron-emitting devices can be controlled by controlling the pulse-shaped device voltage (pulse width, wave height, etc.) applied to each of the electron-emitting devices according to input signals.

It should be noted that, while a number of different surface-conduction electron-emitting devices having the above identified three fundamental features may be conceivable, the most preferable ones are those whose device curent If and emission current Ie monotonically increase with reference to the device voltage Vf applied to the pair of device electrodes (showing the MI characteristic).

An electron source comprising substrate and a number of surface-conduction electron-emitting devices of the above described type typically operates in a manner as described below by referring to FIG. 7.

Figure 7:
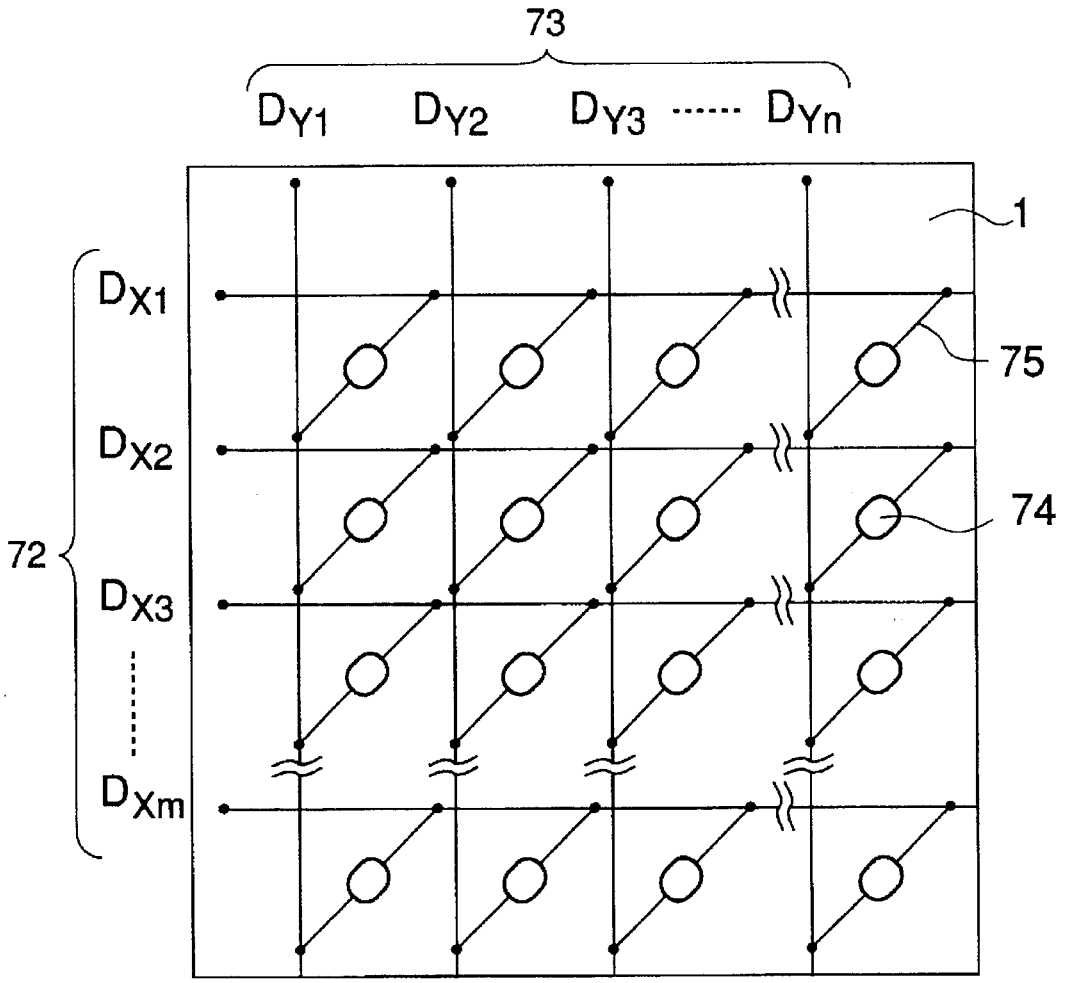
FIG. 7 is a schematic plan view of an electron source according to the invention.

In FIG. 7, 1 denotes a substrate and 73 and 74 respectively denote X- and Y-wires while 74 and 75 respectively designate a surface-conduction electron-emitting device and a connection. The surface-conduction electron-emitting device 74 may have a plannar or stepwise profile.

The substrate 1 is a substrate such as a glass substrate as described earlier and its dimensions are determined as a function of its configuration, the number of devices arranged on the substrate 1 and, if it constitutes a part of a vacuum container for the electron source, the vacuum conditions of the container as well as other factors.

There are a total of m X-wires 72 designated respectively as DX1, DX2, . . . , DXm, which are typically made of a conductive metal and formed on the substrate 1 by vacuum deposition, printing or sputtering to show a desired pattern, although the material, the thickness and the width of the wires need to be so determined that a substantially as equal voltage as possible may be applied to all of the surface-conduction electron-emitting devices.

On the other hand, there are a total of n Y-wires 73 designated respectively as DY1, DY2, . . . , DYn, which are also typically made of a conductive metal and formed on the substrate 1 by vacuum deposition, printing or sputtering to show a desired pattern as in the case of X-wires 72, the material, the thickness and the width of the wires being so determined that as substantially equal a voltage as possible may be applied to all of the surface-conduction electron-emitting devices.

The m X-wires 72 are electrically insulated from the n Y-wires 73 by means of an insulator layer (not shown) laid therebetween, the X- and Y-wires forming a matrix. Both m and n are integers.

The insulator layer (not shown) is typically made of $SiO_2$ and formed on the X-wires 72 carrying substrate 1 by vacuum deposition, printing or sputtering to show a desired contour, although the thickness, the material and the technique to be used for forming it need to be so selected that it may withstand the largest potential difference at the crossings of the X- and Y-wires. It may be so arranged that an insulator layer is found only on and near the crossings of the X- and Y-wires. With such an arrangement, a connection 75 and an X- or Y-wire may be electrically connected without using a contact hole. Each of the X- and Y-wires is led out to an external terminal.

While n Y-wires 73 are laid on m X-wires 72 with an insulator layer interposed therebetween in the above description, m X-wires 72 may be conversely laid on n Y-wires 73 with an insulator layer inserted therebetween. The insulator layer may be used to form all or part of the step-forming sections of the step type surface-conduction electron-emitting devices constituting the electron source if such electron-emitting devices are used.

The oppositely arranged device electrodes of the surface-conduction electron-emitting devices 74 are electrically connected to the respective X-wires 72 (DX1, DX2, . . . , DXm) and Y-wires 73 (DY1, DY2, . . . , DYn) by way of respective connections 75 that are also made of a conductor metal and formed by vacuum deposition, printing or sputtering.

Either a same conductor material or totally or partly different conductor materials may be used for the m X-wires 72, n Y-wires 73, connections 73 and oppositely arranged device electrodes. Such materials may be appropriately selected from metals such as Ni, Cr, Au, Mo, W, Pt, Ti, Al, Cu and Pd, alloys of these metals, printing conductor materials constituted of a metal or a metal oxide such as Pd, Au, $RuO_2$, Pd-Ag and glass and semiconductor materials such as polysilicon.

As will be described in detail hereinafter, scan signal application means (not shown) is connected to the X-wires 72 for applying scan signals to the X-wires 72 in order to scan the rows of the surface-conduction electron-emitting device 74 according to input signals. On the other hand, modulation signal generation means (not shown) is connected to the Y-wires 73 for applying modulation signals to the Y-wires 73 in order to modulate the columns of the surface conduction electron-emitting device 74 according to input signals. A drive voltage is applied to each of the surface-conduction electron-emitting devices as the difference of the voltage of the scan signal and that of the modulation signal applied to the device.

Now, an image-forming apparatus comprising an electron source having a configuration as described above will be described by referring to FIGS. 8 and 9A and 9B, of which FIG. 8 schematically illustrates the configuration of the image-forming apparatus and FIGS. 9A and 9B illustrate two types of fluorescent films that may be used for the apparatus.

Figure 8:
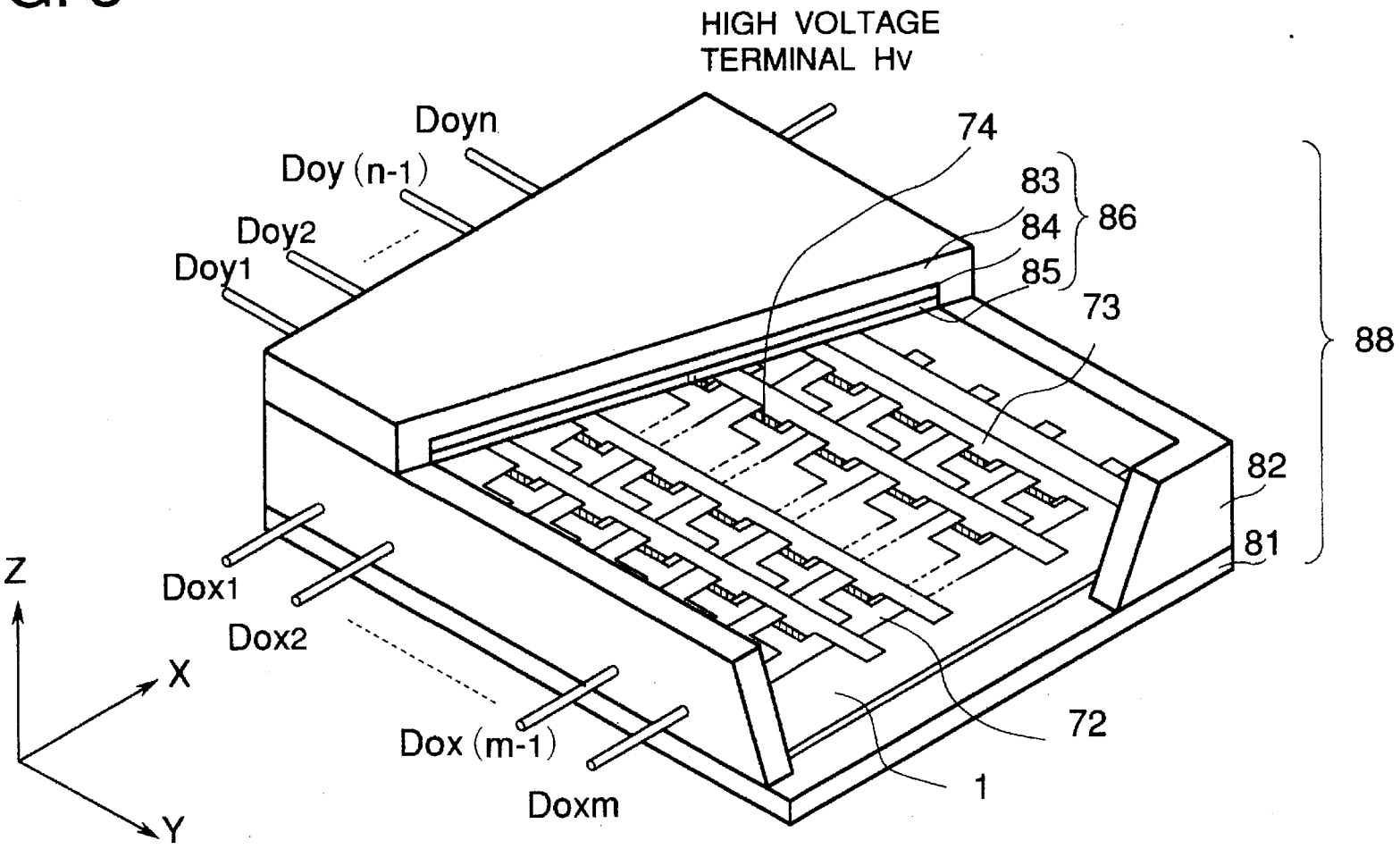
FIG. 8 is a schematic perspective view of an image-forming apparatus according to the invention.

In FIG. 8, the apparatus comprises among others an electron source substrate 1, on which a number of electron-emitting devices are arranged, a rear plate 81 for securely holding the electron source substrate 1, a face plate 86 prepared by arranging a fluorescent film 84 and a metal back 85 on the inner surface of a glass substrate 83 and a support frame 82, casing 88 of the apparatus being formed by applying frit glass to the contact areas of the rear plate 81, the support frame 82 and the face plate 86 and burning them in ambient air or in a nitrogen atmosphere at 400° to 500° C. for more than ten minutes to tightly bond them together. Note that reference numeral 74 in FIG. 8 denotes an electron-emitting region of the device of FIGS. 1A and 1B and reference numerals 72 and 73 respectively designate X- and Y-wires connected to the pair of device electrodes of related surface-conduction electron-emitting devices. The wires connected to the device electrodes of a device may also be referred to as the device electrodes of that device hereinafter, if they are made of a material the same as that of the proper electrodes.

While the casing structure 88 is constituted of the face plate 86, the support frame 82 and the rear plate 81 in the above description, the rear plate 81 may be omitted from it if the substrate 1 has a sufficient strength because the rear plate 81 is simply a reinforcement for the substrate 1. If such is the case, the support frame 82 will be directly bonded to the substrate 1 so that the casing 88 will be constituted of the face plate 86, support frame 82 and the substrate 1.

Figure 9A:
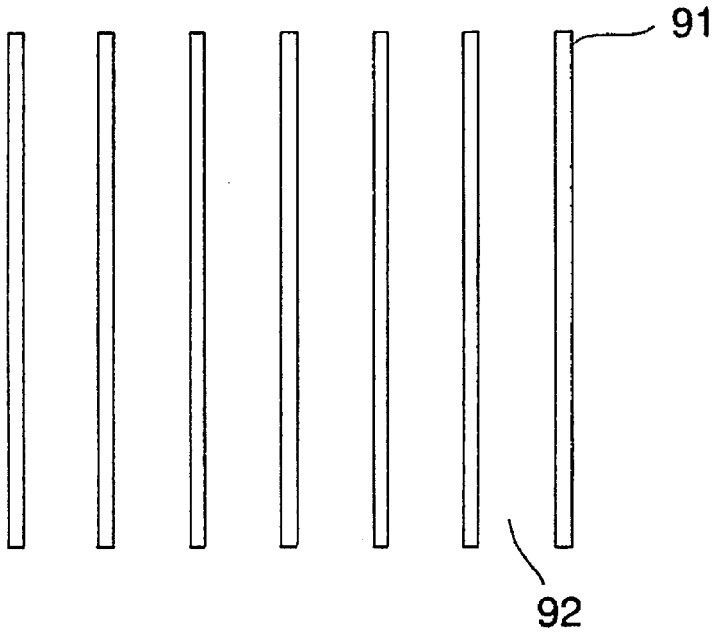
FIGS. 9A and 9B are schematic views illustrating two types of fluorescent films that can be used for the purpose of the invention.
Figure 9B:
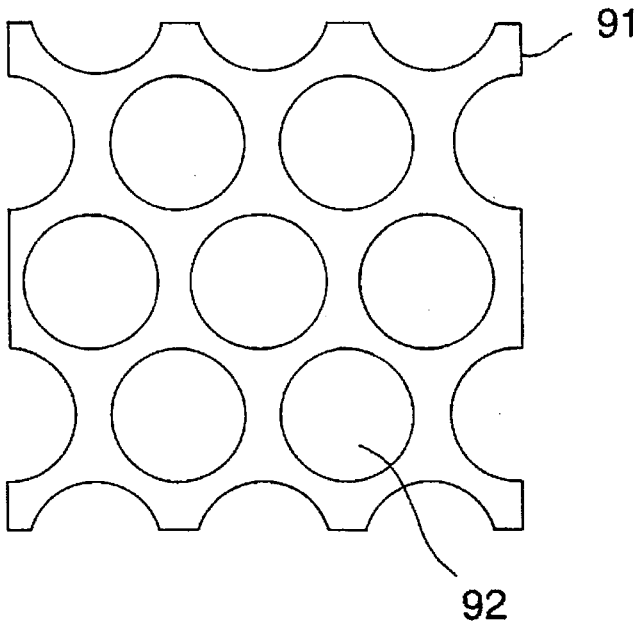

FIGS. 9A and 9B show two types of fluorescent films that can be used for an image-forming apparatus according to the invention. The fluorescent film 84 of FIG. 8 is constituted only of a number of fluorescent materials if the apparatus is designed as a monochrome display, whereas it is constituted of fluorescent materials 92 and a black conductor member 91 which is made of a black conductor material and may be called a black strip or black matrix depending on the shape and arrangement of the fluorescent materials.

Such a black strip or black matrix is arranged in order to make the space for preventing color mixing of the fluorescent materials 92 for three primary colors and suppress any reduction in the contrast of the image on the face plate of the apparatus that can arise when external light is reflected by the surface of the face plate.

While graphite is typically used for the black strip, any other materials may suitably be used so long as they are electrically conductive and show low transmissivity and reflectivity to light.

The fluorescent material 83 are formed on the glass substrate 83 by printing or precipitation regardless if the apparatus is a monochrome or color display. A metal back 85 is normally arranged on the inner surface of the fluorescent film 84 because it reflects light directed to the inner surfaces of the fluorescent materials, operates as an electrode for applying a voltage to electron beams to accelerate their speed and protects the fluorescent materials from being damaged by negative ions that are generated inside the casing to Collide with the fluorescent materials. After the fluorescent film is prepared and its inner surface is smoothed (in a process normally called "filming"), the metal back is formed thereon by depositing aluminum by means of vacuum deposition.

A transparent electrode (not shown) may be formed on the outer surface of the fluorescent film 84 in order to raise the conductivity of the fluorescent film 84.

Note that care should be taken to exactly align the fluorescent materials of each primary color and the respective corresponding electron-emitting devices before the components of the casing 88 are tightly bonded together.

The casing 88 is evacuated by using an exhaust pipe (not shown) to produce a degree of vacuum of $10^{-6}$ Torr inside before it is hermetically sealed. At the same time, a voltage is applied to the oppositely arranged device electrodes of the electron-emitting devices by way of the external terminals Dox1 through Doxm and Doy1 through Doyn of the apparatus to carry out a forming operation and produce an electron-emitting region in each of the devices, while the inside of the casing is held to a degree of vacuum approximately $10^{-6}$ Torr by means of an ordinary vacuum system comprising a rotary pump or a turbo pump. However, in order for the surface-conduction electron-emitting devices to show an MI characteristic for the device current If and the emission current Ie for the purpose of the invention, an additional process of baking them in an ultra high vacuum system comprising an ion pump at 80° C. to 150° C. for three to fifteen hours needs preferably to be carried out after the forming operation.

A getter operation may be carried out on the casing 88 in order to ensure a high degree of vacuum for it after it is sealed. In this operation, a getter arranged at a given position (not shown) in the casing 88 is heated by resistance or high frequency heating to form a film by vapor deposition before the casing is hermetically sealed. The getter is normally made of a material containing Ba as a principal ingredient and the inside of the casing is held to a degree of vacuum between $1\times10^{-5}$ and $1\times10^{-7}$ Torr because of the adsorption effect of the vapor deposited film.

With an image-forming apparatus having a configuration as described above, images are displayed on the screen by applying a voltage to the electron-emitting devices via the external terminals Dox1 through Doxm and Doy1 through Doyn to cause them to emit electrons, applying a high voltage greater than several kilovolts to the metal back 85 or the transparent electrode (not shown) via a high voltage terminal Hv to accelerate the electrons in order to make them collide with the fluorescent film 84, which is consequently energized to emit light to produce images on the screen.

While some of the structural and functional features of an image-forming apparatus according to the invention are described above, the materials and the configurations of the components of the apparatus are not limited to those described and other materials and configurations may alternatively be used whenever appropriate.

Now, some recommended drive methods for driving an electron source or an image-forming apparatus according to the invention will be described.

According to a first drive method, said scan signal application means for applying scan signals is so designed as to apply a voltage V1[V] to wires selected from the m X-wires and another voltage V2[V] to the remaining X-wires so that the surface-conduction electron-emitting devices connected to the wires to which the voltage V1[V] is applied are selectively scanned. (V1[V] is not equal to V2[V].) On the other hand, said modulation signal generation means generates a pulse-shaped voltage having a given length for the n Y-wires and changes its peak level (referred to as Vm[V]) for each and every one of the n Y-wires according to the input signal for that Y-wire, which may be, for instance, a signal representing the brightness level of an incoming image signal, in order to modulate the brightness of the displayed image.

More specifically, the absolute value of the drive voltage Vm–V1[V] applied to the selected N electron-emitting devices that are currently being scanned is modulated on the basis of the relationship between the Vf and Ie of the electron-emitting devices so that each and every electron beam may be emitted from any of the devices with a required intensity depending on the corresponding input signal, e.g., the brightness level of the corresponding incoming video signal.

Meanwhile, the absolute value of the drive voltage Vm–V2[V] applied to the remaining electron-emitting devices that are currently not being scanned is so controlled as to never exceed a threshold voltage Vth predetermined for the electron-emitting devices. Thus, only the electron beams from the electron-emitting devices being scanned and hence having respective required intensities are output for a given period of time, whereas the remaining electron-emitting devices do not output any electron beams during that period.

According to a second drive method, said scan signal application means for applying scan signals is so designed as to apply a voltage V3[V] to wires selected from the m X-wires and another voltage V4[V] to the remaining X-wires so that the surface-conduction electron-emitting devices connected to the wires to which the voltage V3[V] is applied are selectively scanned. (V3[V] is not equal to V4[V].)

On the other hand, said modulation signal generation means generates a pulse-shaped voltage having a given peak level (referred to as Vp[V]) for the n Y-wires and changes the width of each pulse (referred to as Ps[S]) for each and every one of the n Y-wires as a function of the input signal for that Y-wire, which may be, for instance, a signal representing the brightness level of an incoming video signal, in order to modulate the brightness of the displayed image.

More specifically, the absolute value of the drive voltage Vp–V3[V] applied to the selected N electron-emitting devices that are currently being scanned exceeds the absolute value of the predetermined threshold voltage Vth so that each and every electron may be emitted from any of the devices with a required electric charge depending on the corresponding input signal, e.g, the brightness level of the corresponding incoming image signal, by modulating the pulse width Pw[S] of each pulse individually.

Meanwhile, the absolute value of the drive voltage Vm–V2[V] applied to the remaining electron-emitting devices that are currently not being scanned is so controlled as to never exceed a threshold voltage Vth predetermined for the electron-emitting devices. Thus, only the electrons emitted from the electron-emitting devices being scanned and hence having respective required electric charges are output, whereas the remaining electron-emitting devices do not output any electron beams.

According to a third drive method, said scan signal application means for applying scan signals is so designed as to apply a voltage V5[V] to wires selected from the M X-wires and another voltage V6[V] to the remaining X-wires so that the surface-conduction electron-emitting devices connected to the wires to which the voltage V5[V] is applied are selectively scanned. (The difference between V5[V] and V6[V] needs to meet a certain condition.)

On the other hand, said modulation signal generation means generates a pulse-shaped voltage for the N Y-wires and changes the timing of applying the pulse-shaped voltage or its peak level or both for each and every one of the N Y-wires as a function of the input signal to modulate the degree of brightness in the image being displayed. (Here, the timing of applying the pulse-shaped voltage means the pulse width or the phase of the pulse relative to the corresponding scan signal or both.)

More specifically, the drive voltage applied to the selected N electron-emitting devices that are currently being scanned is a voltage pulse whose pulse width and peak value are modulated and it is so controlled that the electric charge of each electron emitted during the scanning period of each and every one of the electron-emitting devices has a quantity that matches the corresponding input signal, e.g., the brightness level the corresponding incoming video signal.

Meanwhile, the drive voltage to the remaining electron-emitting devices that are currently not being scanned is so controlled as to never exceed a threshold voltage Vth predetermined for the electron-emitting devices. Thus, only the electron beams from the electron-emitting devices being scanned and hence having respective required intensities are output for the duration of the time scanning operation, whereas the remaining electron-emitting devices do not output any electron beams during that period.

Incidentally, when an electron source or an image-forming apparatus according to the invention comprises surface-conduction electron-emitting devices that are provided with the above described fundamental feature that both the device current If and the emission current Ie of the device are substantially linearly proportional to the voltage applied thereto, no electron beams would be emitted from those devices that are not currently being scanned. Contrary to this, however, when the emission current Ie of such surface-conduction electron-emitting devices is monotonically increasing to the voltage applied thereto but their device current If has a VCNR characteristic, electron beams may possibly be emitted from those electron-emitting devices that are not currently being scanned. This may be because, while the drive voltage Vm[V]–V2[V] is applied to the electron-emitting devices that are not currently being scanned, these device change their state so that somehow the drive voltage exceeds the threshold voltage level Vth.

In the following, a divided drive method for driving an electron source or an image-forming apparatus according to the invention will be described.

Figure 10:
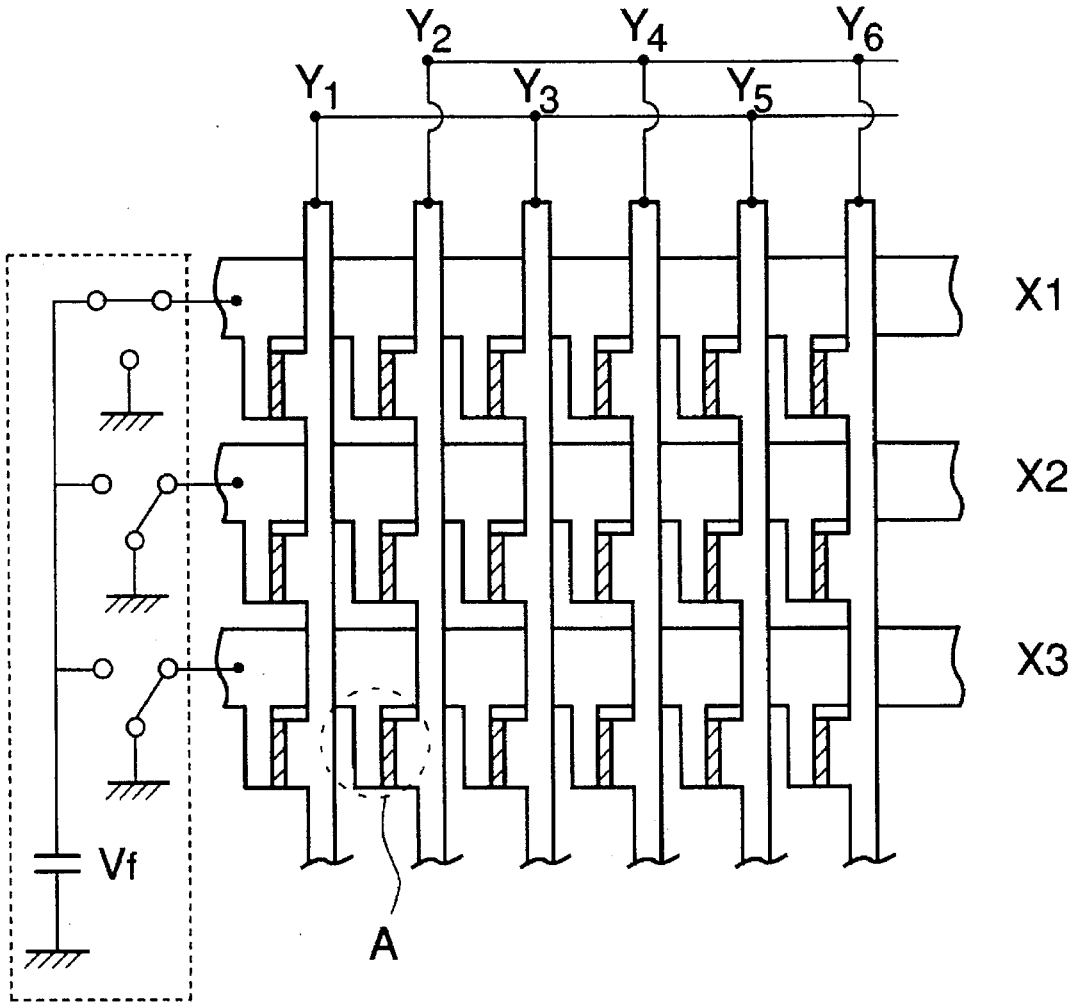
FIG. 10 is a schematic circuit diagram illustrating the method of driving fluorescent materials for the purpose of the invention.

Referring to FIG. 10, it shows an apparatus comprising electron-emitting device rows (X1, X2, . . . ) each having a plurality of electron-emitting devices A and modulation electrode columns (Y1, Y2, . . . ) arranged to form an X-Y matrix. Voltage Vf is applied to one of the electron-emitting device rows (X1, X2, . . . ) with a level sufficiently high for causing the devices of the row to emit electrons while a voltage is applied to one of the modulation electrode columns (Y1, Y2, . . . ) with a level that varies as a function of the input information signal to define an electron beam emission pattern for that electron-emitting device row as a function of the information signal. Then, this operation is repeated on a one-by-one basis for all the electron-emitting device rows to define an electron beam emission pattern for a frame and the operation of defining an electron beam emission pattern for a frame is repeated for a multitude of frames. Then, an image is formed for a frame by irradiating the image-forming member of the apparatus with beams in accordance with the defined electron beam emission pattern and this image forming operation is repeated for a multitude of frames.

It should be noted for the above drive method that, when a voltage is applied to one of the modulation electrode columns (Y1, Y2, . . . ) with a level that varies as a function of the input information pattern, a cutoff voltage is applied to a modulation electrode (which may be, for instance, assumed to be Y2 here) to which an ON-state voltage is applied and its neighboring modulation electrodes (Y1, Y2) regardless of what information signal is given. Consequently, the modulation electrodes Y1 and Y3 are held to a constant voltage level.

With such an arrangement, by applying a cutoff voltage, electron beams that are emitted and collide with the image-forming member are not adversely affected by the voltage applied to the neighboring modulation electrode columns. Additionally, any crosstalks among electron beams are effectively suppressed.

In a preferred mode of carrying out the above described drive method, an information signal is fed to every n-th modulation electrode columns so that the signal input operation is carried out n+1 times while a cutoff signal is fed to the remaining modulation electrodes that are not given any information signal.

Referring to FIG. 10, an input signal is fed to all the even number modulation electrode columns for the first time and then to all the odd number modulation electrode columns for the second time, whereas a cutoff signal is fed to all the odd number modulation electrode columns firstly and then to all the even number modulation electrode columns for the second time. Thus, voltage Vf that is required for electron emission is applied to electron-emitting device row X1, while an information signal given to the modulation electrode columns (Y1, Y2, Y3, . . . ) is firstly 1) fed to modulation electrode columns. Y1, Y3, Y5, . . . while a cutoff signal is fed to modulation electrode columns Y2, Y4, Y6, . . . and then secondly 2) fed to modulation electrode columns Y2, Y4, Y6, . . . while a cutoff signal is fed to modulation electrode columns Y1, Y3, Y5, . . . to define an electron beam emission pattern for row X1 according to the information signal. Then, this operation is repeated for all the electron-emitting device rows on a one-by-one basis to define an electron beam emission pattern for a frame. The operation of defining an electron beam emission pattern for a frame is repeated for a multitude of frames. Thereafter, an image is formed for a frame by irradiating the image-forming member of the apparatus with beams in accordance with the defined electron beam emission pattern and this image forming operation is repeated for a multitude of frames.

In order to effectively irradiate the image-forming member of the apparatus with electron beams emitted from the electron source according to a defined electron emission pattern, an appropriate voltage must be applied to the image-forming member as a function of the level of the ON-state voltage and that of the cutoff voltage as well as the type of the electron-emitting devices involved.

While an information signal (modulation signal) to be used for the purpose of the invention contains an ON-state signal which is a voltage signal for allowing irradiation of the image-forming member with electron beams beyond a given rate and a cutoff signal for blocking irradiation of the image-forming member with electron beams, it may additionally contain a voltage signal for varying the rate of electron beam irradiation of the image-forming member if images are to be formed with a multitude of tones. The ON-state signal and the cutoff signal are defined as a function of the type of the electron-emitting devices involved and the level of the voltage applied to the image-forming member.

An electron source or an image-forming apparatus according to the invention and operated by the above drive method may comprise an image-forming member prepared by arranging red (R), green (G) and blue (B) fluorescent bodies.

The divisor to be used for the drive method may be an appropriately selected integer other than two which is used for the arrangement of FIG. 10.

While a cutoff signal is fed to the modulation electrodes adjacent to those where an input signal is fed in the above description, it should be noted that due to simultaneous driving of plural devices, the time allotted to each device is increased to ensure a sufficient emission of electrons if a cutoff signal is not used. In case of not feeding a cut off signal, the $X_1$, $X_2$, . . . side can be divided for simultaneous driving, in place of the $Y_1$, $Y_2$, . . . side.

Now, preferred embodiments of an electron source and a image-forming apparatus of the present invention will be described.

Figure 11:
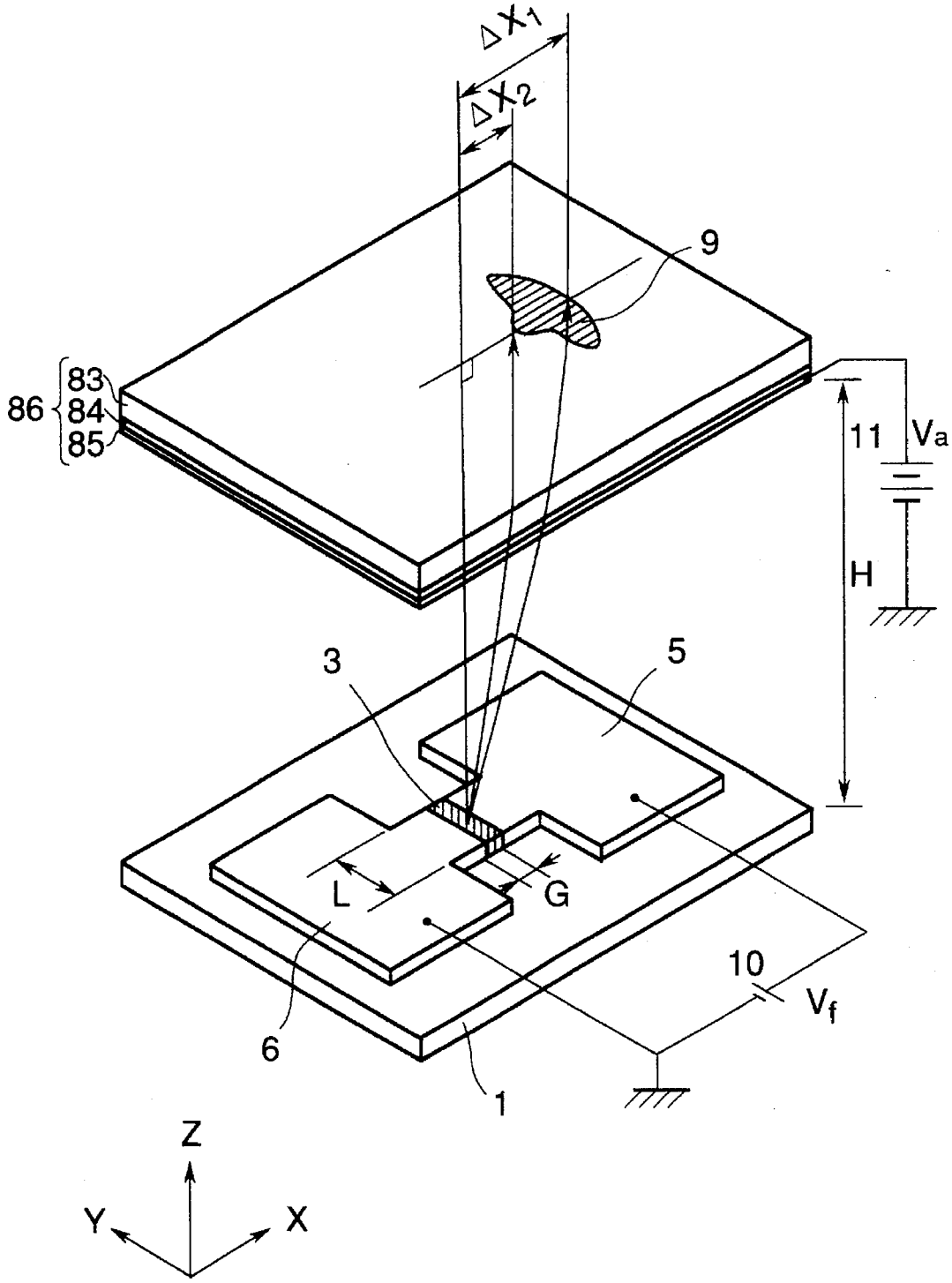
FIG. 11 is an exploded and enlarged perspective view of an electron-emitting device and a face plate of an image-forming apparatus according to the invention.

FIG. 11 is an exploded and enlarged perspective view of a combination of an electron-emitting device and a face plate of an image-forming apparatus that comprises a plurality of surface-conduction electron-emitting devices as illustrated in FIG. 8, said view showing several tracks of electron beams emitted from the electron-emitting device.

In FIG. 11, there is shown an surface-conduction electron-emitting device comprising a substrate 1, high and low potential device electrodes 5 and 6 arranged on the substrate 1 with a narrow gap 1, which is filled with a thin film to form an electron-emitting region 3. There is also shown a face plate 86 arranged vis-a-vis the substrate 1 of the electron-emitting device.

Said face plate 86 comprises a glass plate 83, a metal back 85 and an image-forming member 84 (or a fluorescent material) and arranged above the substrate 1 with a distance H separating them from each other.

When voltage Vf is applied to the device electrodes 5 and 6 by means of a device drive power source 10, electrons are emitted from the electron-emitting region 3 in the form of a beam and accelerated by acceleration voltage Va applied to the fluorescent material 84 via the metal back 7 by an electrode acceleration power source 11 until they collide with the fluorescent material 84 to cause the latter to luminesce and form a luminous spot 9 on the face plate 86.

Figure 12:
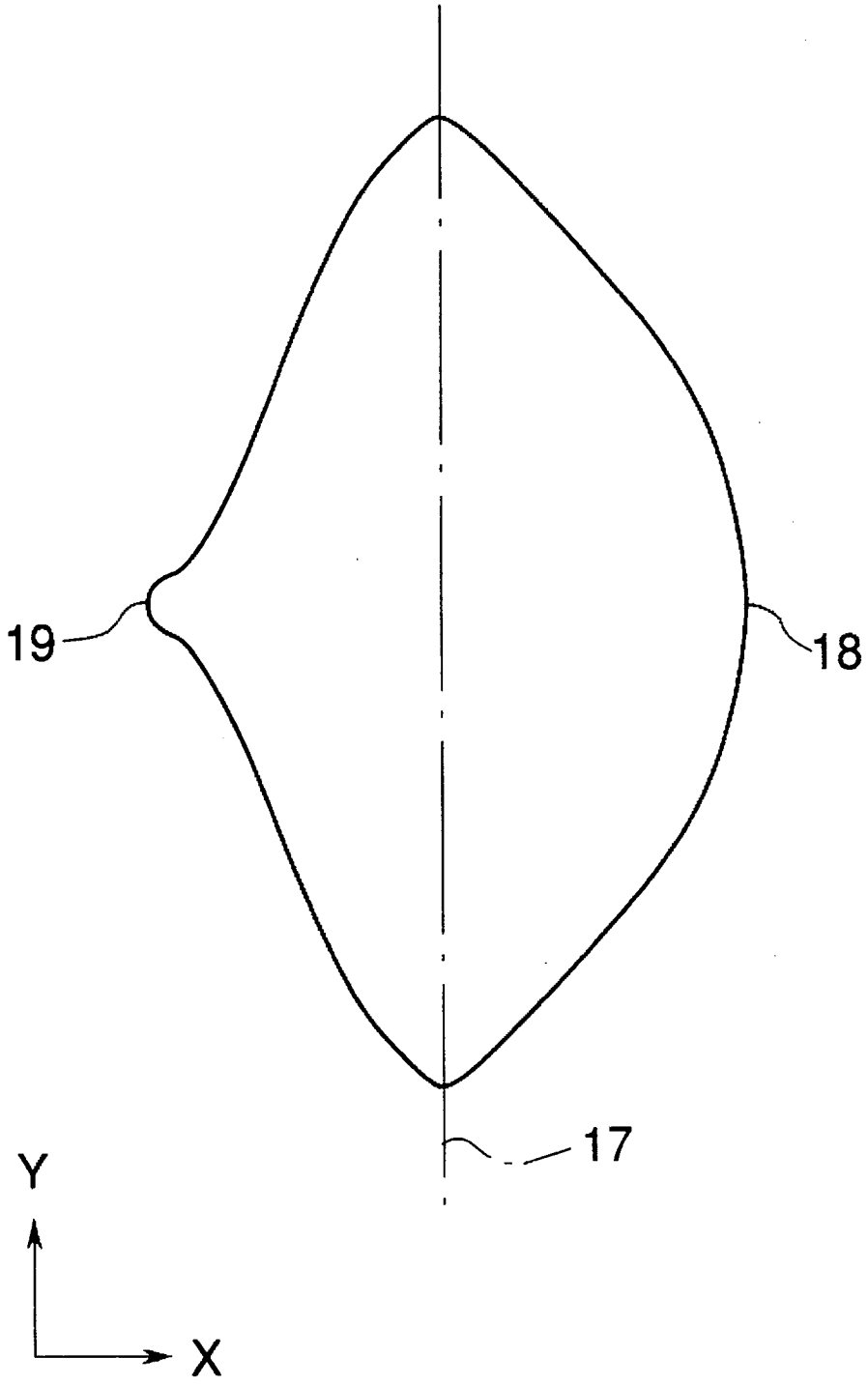
FIG. 12 is a schematic view of a luminous spot that can be observed in a surface-conduction electron-emitting device to be used for the purpose of the invention.

FIG. 12 is a schematic enlarged illustration of a luminous spot 9 observed by the inventors of the present invention in an apparatus shown in FIG. 11.

It was found that, as seen in FIG. 12, a luminous spot of a fluorescent material is expanded to a certain extent both in the direction of voltage application of the device electrodes (X-direction) and in a direction perpendicular to it (Y-direction).

While the reason why an electron beam is expanded to a certain extent before it collides with the image-forming member is not particularly clear, the inventors of the present invention believe on the basis of a number of experiments that it is possibly because electrons are scattered to a certain extent at the time when they are emitted from the electron-emitting region 3.

The inventors of the present invention also believe that, of the electrons emitted in different directions, those that are directed to the high potential device electrode (in positive X-direction) get to the tip 18 of the luminous spot and those that are directed to the low potential device electrode (in negative X-direction) arrive at the tail 19 of the luminous spot to produce a certain width along X-direction. Since that the luminance of the luminous spot is low at the tail, it may be safely assumed that the electrons emitted toward the low potential device electrode are very small in number.

It was also found by a number of experiments conducted by the inventors of the present invention that the luminous spot 9 is normally slightly deflected from the vertical axis of the electron-emitting region 3 into positive X-direction or toward the high potential device electrode 5.

Figure 13:
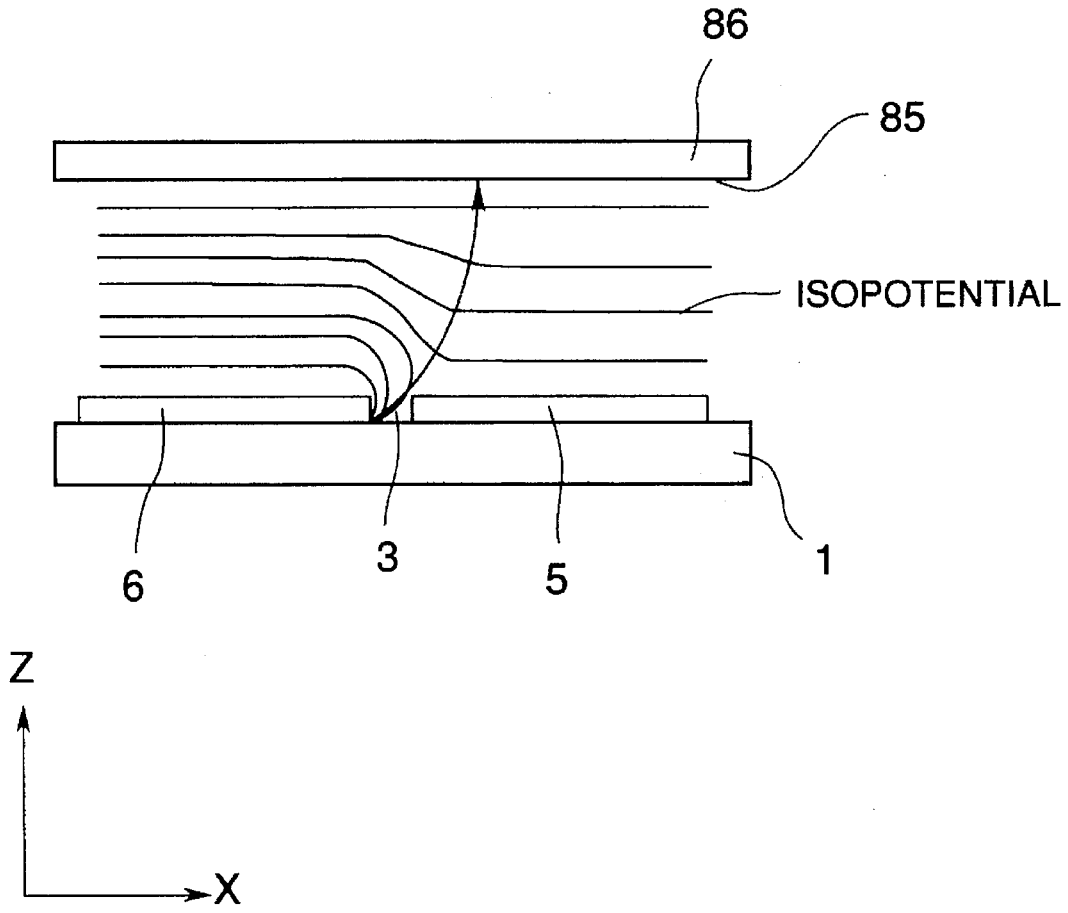
FIG. 13 is a schematic view of equipotential lines for illustrating a possible path of an electron beam in an image-forming apparatus according to the invention and comprising surface-conduction electron-emitting devices.

The inventors of the present invention believes this may be explained by that, as shown in FIG. 13 illustrating the potential distribution within a space above the surface-conduction electron-emitting device, the equipotential lines are not parallel with the surface of the image-forming member 85 near the electron-emitting region 3 and therefore electrons emitted from the region 3 and accelerated by the accelerating voltage Va fly away not only in Z-direction in FIG. 13 but also toward the high potential device electrode.

Differently stated, the electrons emitted from an electron-emitting region 3 are inevitably deflected to a certain extent by the voltage Vf applied thereto for acceleration immediately after the emission.

After looking into the size of the luminous spot 9 and the electrons deflected from the vertical axis of the electron-emitting region 3 into X-direction and other phenomena, the inventors of the present invention came to believe that the deviation of the front end of the luminous spot from the axis of the electron-emitting region (ΔX1 in FIG. 11) and that of the tail of the luminous spot from the axis of the electron-emitting region (ΔX2 in FIG. 11) can be expressed in terms of Va, Vf and H.

When a target to which voltage Va(V) is applied is located above an electron source (in Z-direction) and separated by distance H and the space between the target and the electron source is filled with an evenly distributed electric field, the displacement in X-direction of an electron emitted from the electron source with an initial X-direction velocity of V (eV) and an initial Z-direction velocity of 0 is expressed by equation (1) below which is derived from the equation of motion.

$$\Delta X = 2H\sqrt{\frac{V}{Va}} \tag{1}$$

Referring to FIG. 13, since it was discovered in a series of experiments conducted by the inventors of the present invention that, while the electric field is swerved near the electron-emitting region by the voltage applied to the device electrodes and therefore electrons are accelerated also in X-direction, the voltage applied to the image-forming member is sufficiently greater than the voltage normally applied to the electron-emitting device and consequently electrons are accelerated in X-direction only near the electron-emitting region and thereafter move in that direction at a substantially constant speed. Thus, the deviation in X-direction of the electron can be obtained by replacing V in equation (1) with a formula for expressing the X-direction velocity of an electron after it has been accelerated near the electron-emitting region.

If the X-direction velocity component of an electron is C (eV) after it has been accelerated in X-direction near the electron-emitting region 3, C is a parameter that is to be modified by voltage Vf applied to the device. Thus, if C is expressed as a function of Vf, or C(Vf) (unit being eV) and the latter is used for equation (1), equation (2) below can be obtained for displacement ΔX0.

$$\Delta X0 = 2H\sqrt{(C(Vf)/Va)} \tag{2}$$

Equation (2) above expresses the displacement of an electron that is emitted from the electron-emitting region with an initial X-direction velocity of 0 and given an X-direction velocity of C (eV) near the electron-emitting region under the influence of voltage Vf applied to the device electrodes.

In reality, the initial velocity of the electron has various directional components including the X-direction component. If the initial velocity has a quantity of v0 (eV), from equation (1) the largest and smallest displacements of an electron beam in X-direction will be expressed by equations (3) and (4) below respectively.

$$\Delta X1 = 2H\sqrt{((C+v0)/Va)} \tag{3}$$

$$\Delta X2 = 2H\sqrt{((C-v0)/Va)} \tag{4}$$

Since v0 can also be assumed to be a parameter whose value changes depending on voltage Vf applied to the electron-emitting region and both C and v0 are functions of Vf, the following equations containing constants K2 and K3 can be obtained.

$$\sqrt{((C+v0)(Vf))} = K2\sqrt{Vf}$$

and $$\sqrt{((C-v0)(Vf))} = K3\sqrt{Vf}$$

By modifying equations (3) and (4) and using the above formulas, equations (5) and (6) below can be produced.

$$\Delta X1 = K2 \times 2H\sqrt{(Vf/Va)} \tag{5}$$

$$\Delta X2 = K3 \times 2H\sqrt{(Vf/Va)} \tag{6}$$

where H, Vf and Va are measurable quantities and so are ΔX1 and ΔX2.

As a result of a number of experiments where the quantities of ΔX1 and ΔX2 are observed, varying the values of H, Vf and Va, the inventors of the present invention obtained the following values for K2 and K3.

$$K2 = 1.25 \pm 0.05 \text{ and}$$

$$K3 = 0.35 \pm 0.05$$

The above values hold particularly true when accelerating electric field strength (Va/H) is not lower than 1 kV/mm.

From the above empirical achievements, the quantity (S1) of the voltage applied (in X-direction) to an electron in the electron beam spot on the image-forming member is expressed by a simple formula as shown below.

$$S1 = \Delta X1 - \Delta X2.$$

If K1=K2–K3, then equation (7) below is obtained from equations (5) and (6) above.

$$S1=K1\times 2H\sqrt{(Vf/Va)} \quad (7)$$

where $0.8 \leqq K1 \leqq 1.0$.

As for the size of the electron beam spot in a direction perpendicular to the direction of the voltage applied to the electron-emitting region (Y-direction), while electrons are emitted with an initial velocity of v0 also in that direction, they would not be practically not accelerated in the direction at all. Thus, the displacement of the electron beam will be expressed by $$\Delta Y=2H\sqrt{(v0/Va)} \quad (8)$$

for both positive and negative Y-directions.

From equations (3) and (4), $$\sqrt{((\Delta X1^2-\Delta X2^2)/2)}=2H\sqrt{(v0/Va)} \quad (9)$$

and, from equations (5) and (6), $$\sqrt{((\Delta X1^2-\Delta X2^2)/2)}=2H\sqrt{(Vf/Va)}\times\sqrt{((K2^2-K3^2)/2)} \quad (10).$$

Using equations (9) and (10), then $$2H\sqrt{(v0/Va)}=2H\sqrt{(Vf/Va)}\times\sqrt{((K2^2-K3^2)/2)} \quad (11).$$

Thus, if $\sqrt{((K2^2-K3^2)}=K4$ is assumed for the left side of equation (11), then the size of the electron beam spot on the image-forming member is expressed by equation (12) below for Y-direction, using L for the length of the electron-emitting region in that direction.

$$\begin{aligned} S2 &= L+2\Delta Y \\ &= L+2K4\times 2H\sqrt{(Vf/Va)} \end{aligned} \quad (12)$$

Since H, Vf, Va and L are measurable, the value of coefficient K4 can be determined by observing S2. Considering that K2=1.25±0.05 and K3=0.35+0.05 and the definition of K4, a conclusion of $0.80 \leqq K4 \leqq 0.90$ is finally drawn.

This conclusion was backed by the results obtained in a series of experiments for determining the size of an electron beam spot in Y-direction.

On the basis of the above equations, the inventors of the present invention went on the study of the behavior of electron beams emitted from a number of electron-emitting regions on the image-forming member.

In a system illustrated in FIG. 11, emitted electrons get to the image-forming member to form an asymmetrical pattern there under the influence of a swerved electric field in the vicinity of the device electrodes (FIG. 13) and the edges of the electrodes as typically shown in FIG. 12.

This phenomenon of a deformed electron beam spot and an asymmetrical pattern can give rise to a problem of degraded image resolution to such an extent that can render characters, if displayed, practically illegible and severely blur any moving images.

The contour of an electron beam spot illustrated in FIG. 12 is asymmetrical relative to X-axis and the amount with which its tip or tail is displaced from the axis perpendicular to the electron-emitting region can be obtained by using equations (5) and (6) respectively. The inventors of the present invention discovered that a highly symmetrical luminous spot can be achieved when a plurality of electron-emitting regions provided between a higher potential electrode and a lower potential electrode, which surrounds the higher potential electrode and may be divided into a plurality of lower potential electrode pieces, are arranged with a distance D defined by equation (13) below for separating adjacent sections along the direction of voltage application and made to hit a same spot on the image-forming member.

$$K2\times 2H\sqrt{(Vf/Va)} \geqq D/2 \geqq K3\times 2H29\ (Vf/Va) \quad (13)$$

where K2 and K3 are constant and K2=1.25±0.05 and K3=0.35±0.05.

As for a direction perpendicular to the direction of voltage application (Y-direction), electron-emitting regions may well be arranged with pitch P as defined by inequality (14) below if the electron beam spot formed by electrons emitted from those electron-emitting regions is required to show a high degree of continuity and if each of the electron-emitting regions has a length of L.

$$P<L+2K4\times 2H\sqrt{(Vf/Va)} \quad (14)$$

where K4=0.80.

If, to the contrary, the electron beam spot formed by electrons emitted from electron-emitting regions having a length of L is required to show discontinuity, they may well be arranged in Y-direction at pitch P that satisfies formula (15) below.

$$P \geqq L+2K5\times 2H\sqrt{(Vf/Va)} \quad (15)$$

where K5=0.90.

The concept of the present invention can be used for not only image-forming apparatuses but also for light sources that can replace the light emitting diodes of a conventional optical printer comprising a photosensing drum and light emitting diodes. Note that, if such is the case, not only linear electron beams but also two-dimensionally expanded flux of electron beams may be realized by selectively utilizing the m row wires and n column wires of an electron source having a configuration as described earlier.

Now, some preferably embodiments of such apparatus will be described below.

Embodiment 1

This embodiment is an electron source of an image-forming apparatus, which is realized by forming a number of plane type surface-conduction electron-emitting devices on respective insulator interlayers laid on substrates and using a same material or a material containing a same element for all the device electrodes, the X-wires, the Y-wires and the connections connecting the device electrodes and the wires of the apparatus.

Figure 14:
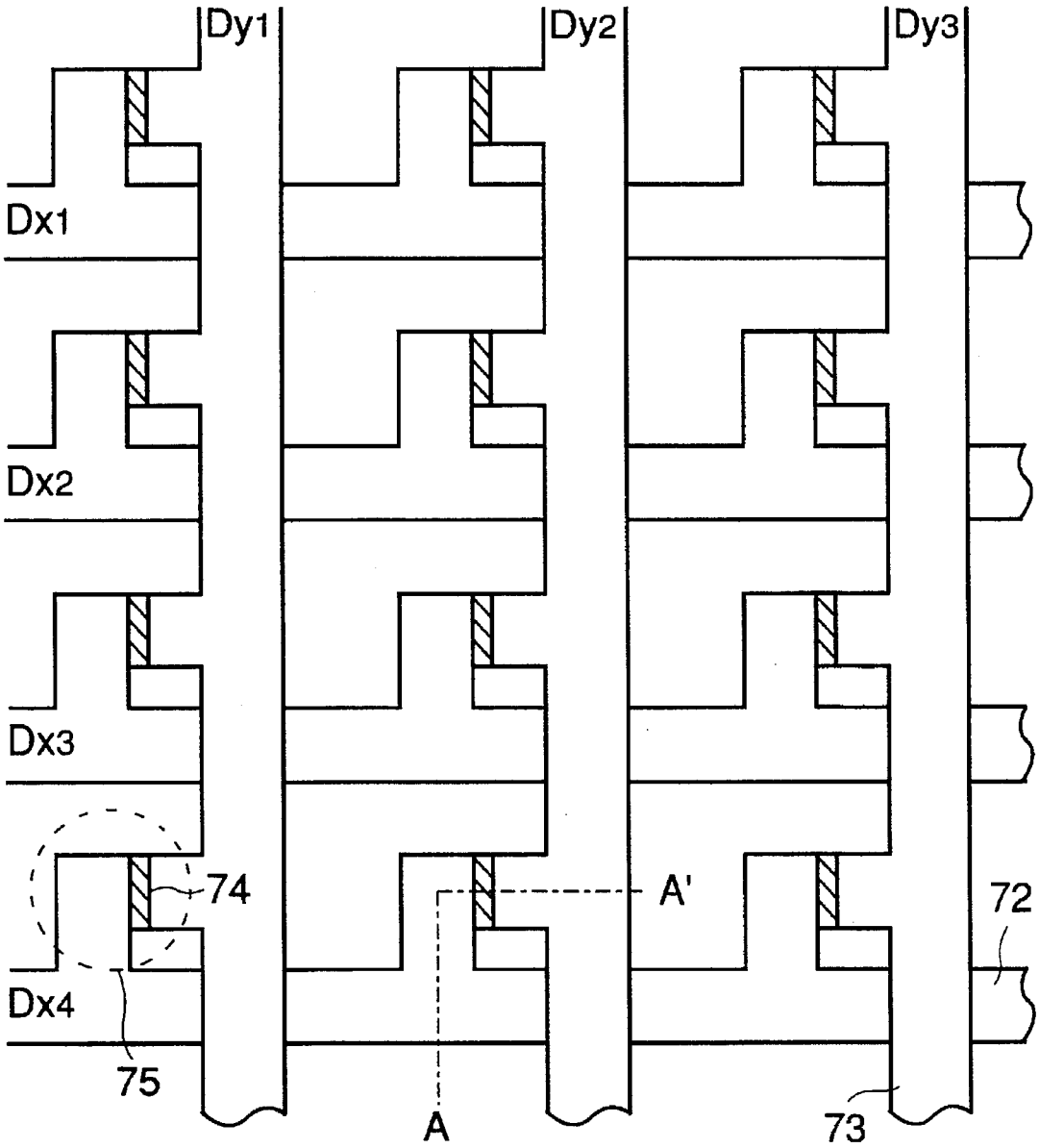
FIG. 14 is a schematic plan view of a first embodiment of an electron source of the invention.
Figure 15:
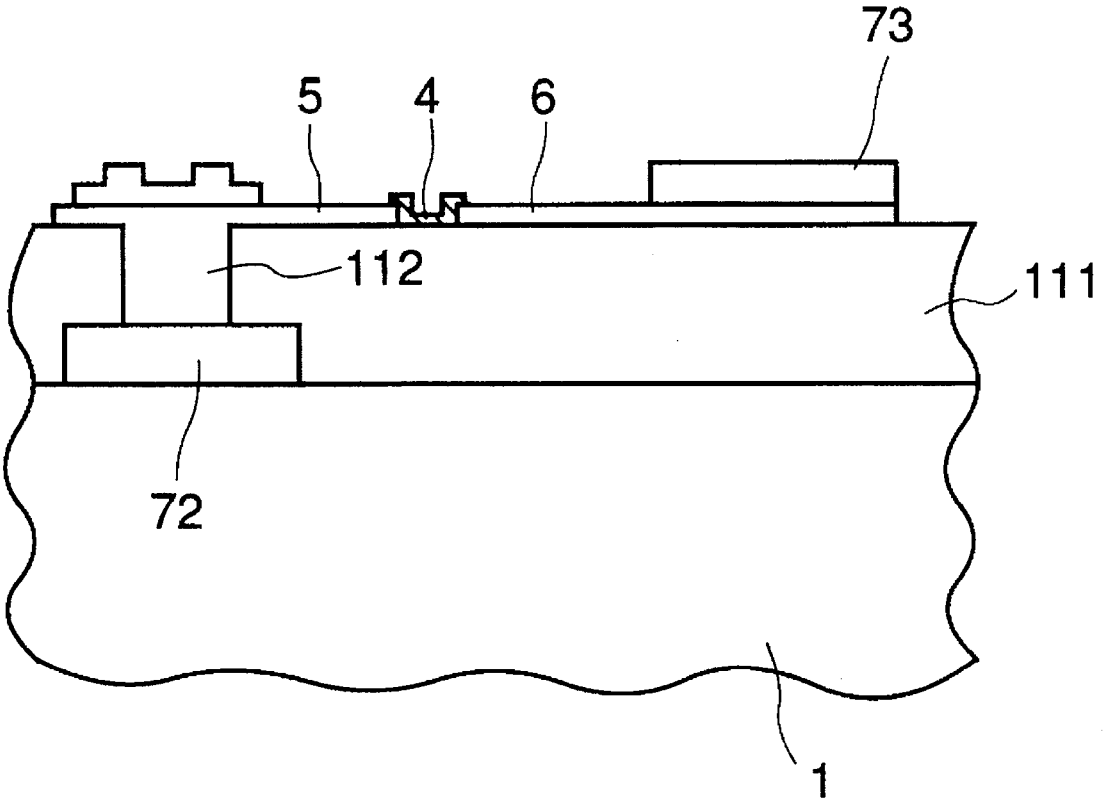
FIG. 15 is a schematic sectional view of the first embodiment of FIG. 14.

FIG. 14 shows a plan view of part of the embodiment of electron source. FIG. 15 illustrates a cross sectional view taken along line A—A' in FIG. 14. FIGS. 16A through 17H illustrate different steps of operation of manufacturing such an electron source. Note that same reference symbols are commonly used to respectively designate same components in FIGS. 14 through 17H.

More specifically, 1 denotes a substrate and 72 denotes an X-wire corresponding to DXm in FIG. 7 (also referred to as underwire) whereas 73 denotes a Y-wire that corresponds to DYn in FIG. 7. 4 Reference numeral denotes a thin film including an electron-emitting section and 5 and 6 denote respective device electrodes whereas 111 and 112 respectively denote an insulator interlayer and a contact hole to be used for electrically connecting the device electrode 5 and the underwire 72.

This embodiment is prepared through the steps as illustrated in FIGS. 16A through 17H and described below only for an electron-emitting device and related parts.

Step a

Figure 16A:
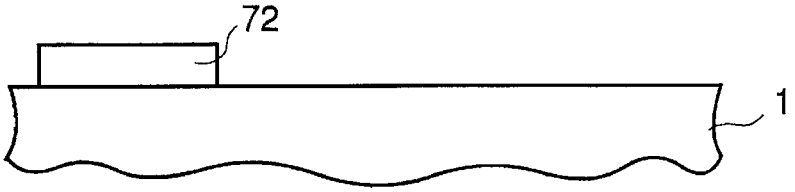
FIGS. 16A through 16D are schematic sectional views of the first embodiment, showing it in different manufacturing steps.

A silicon oxide film is formed on a cleansed soda lime glass plate to a thickness of 0.5 μm by sputtering to produce a substrate 1, on which a 50 Å thick Cr layer and a 6,000 Å thick Au layer are sequentially formed by vacuum deposition. Thereafter, photoresist (AZ 1370 available from HECHST) is applied thereto by a spinner and baked. Then, the photoresist layer is exposed to light with a photomask arranged thereon and photochemically developed to produce a resist pattern for an underwire 72. Subsequently, the Au and Cr deposited layers is wet-etched, using the resist pattern as a mask to produce an underwire 72 (FIG. 16A).

Step b

Figure 16B:
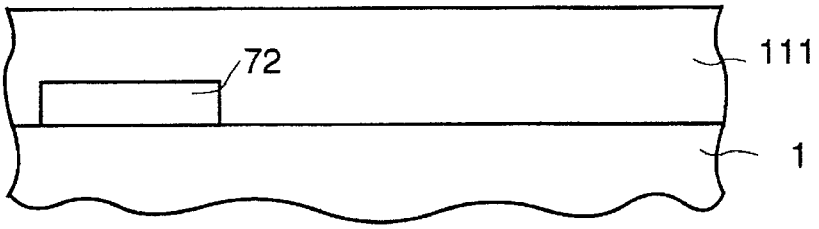

An insulator interlayer 111 of silicon oxide is formed to a thickness of 0.1 μm by RF sputtering (FIG. 16B).

Step c

Figure 16C:
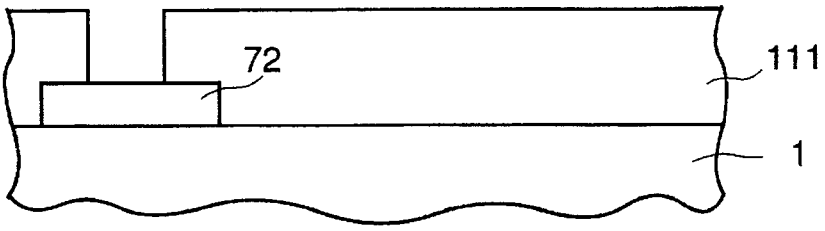

A photoresist pattern 112 is formed on the silicon oxide film produced in step b and this insulator interlayer 111 is etched, using the photoresist pattern as a mask, to produce a contact hole 112 (FIG. 16C).

RIE (Reactive Ion Etching) and $CF_4$ and $H_2$ gases are used for the etching operation in this step.

Step d

Figure 16D:
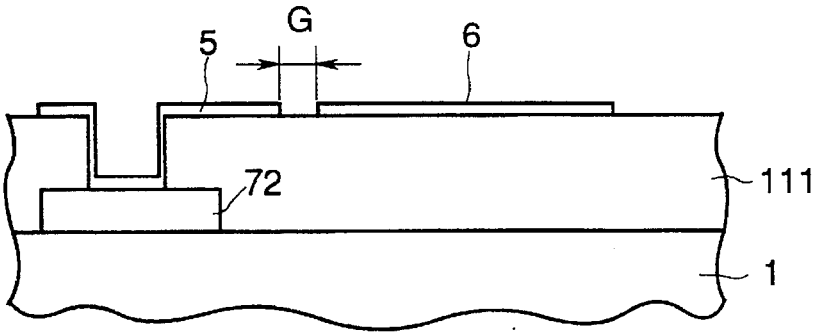

Subsequently, another photoresist pattern is prepared (photoresist RD-2000N-41: available from Hitachi Chemical Co., Ltd.) for device electrodes 5 and 6 and an inter-electrode gap G and then a 50 Å thich Ti film and a 1,000 Å thick Ni film are sequentially formed by vacuum deposition. The photoresist pattern is dissolved in an organic solvent and the Ni and Ti deposit films are lift-off to produce device electrodes 5 and 6, which have a width W1 fo 300 μm and separated from each other by a distance G of 3 μm (FIG. 16D).

Step e

Figure 17E:
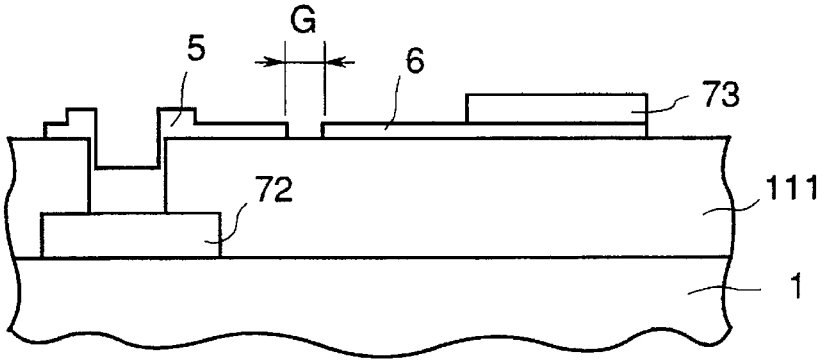
FIGS. 17E through 17H are schematic sectional views of the first embodiment, showing it in different manufacturing steps following those of FIGS. 16A to 16D.

Still another photoresist pattern is formed for an overwire 73 on the device electrodes 5 and 6 and then a 50 Å thick Ti film and a 500 Å thick Au film are sequentially formed by vacuum deposition. Unnecessary portions of these films are removed by lift-off to produce an overwire 73 having a desired pattern (FIG. 17E).

Step f

Figure 17F:
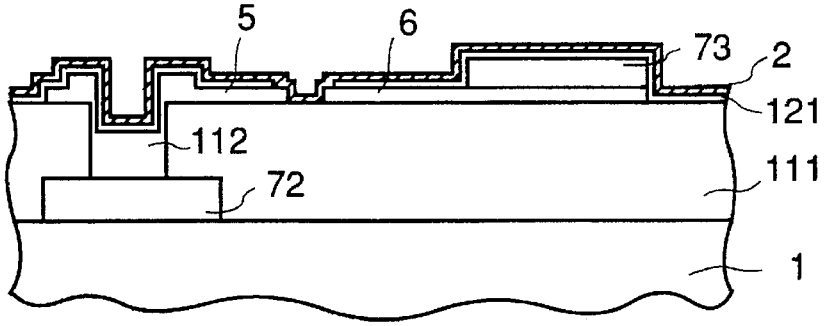
Figure 18:
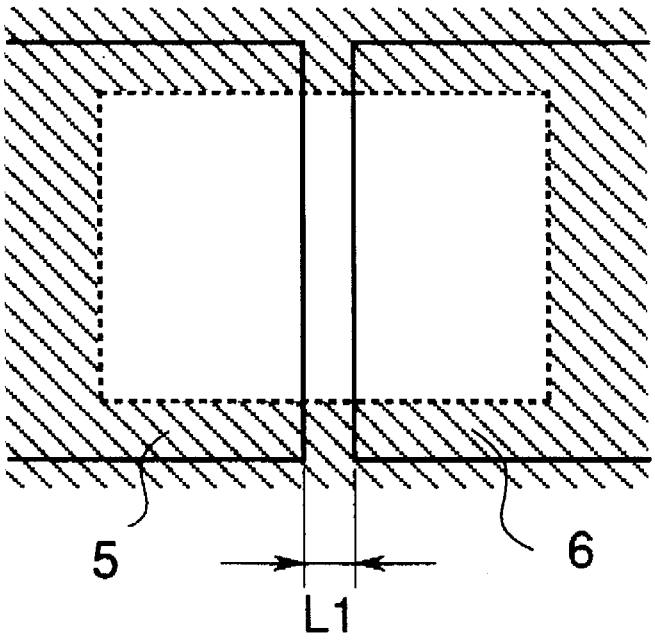
FIG. 18 is a schematic plan view of a mask that can be used for the first embodiment.

FIG. 18 shows a plan view of part of a mask to be used in this step for forming a thin film 2, from which an electron-emitting section is made for an electron-emitting device. The mask has an opening for an inter-electrode gap and its neighboring areas. Using this mask, a 1,000 Å thick Cr film 121 is formed by vapor deposition and subjected to a patterning operation. Then, organic Pd (ccp 4230 available from Okuno Pharmaceutical Co., Ltd.) is applied thereon by means of a spinner and heated at 300° C. for 10 minutes for baking. (FIG. 17F).

The formed thin fine particle film 2 which is made of fine particles of Pd as a main element and used for producing an electron-emitting section has a thickness of 100 Å and a sheet resistance of $5\times10^4$ Ω/cm$^2$. The term "a fine particle film" as used herein refers to a thin film constituted of a large number of fine particles that may be loosely dispersed, tightly arranged or mutually and randomly overlapping (to form an island structure under certain conditions).

Step g

Figure 17G:
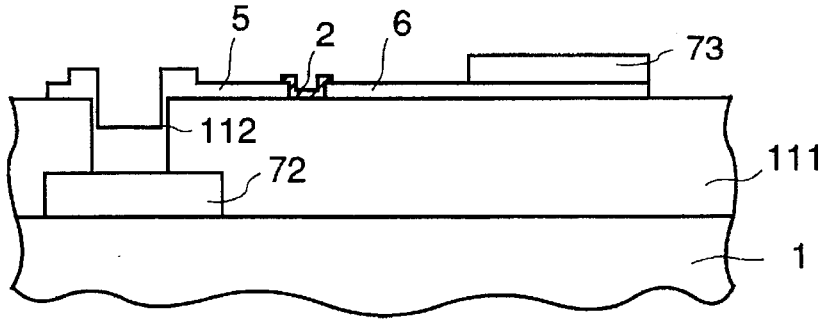

The Cr film 121 and the baked thin film 2 for an electron-emitting section are etched, using an acid etchant, to produce a desired pattern (FIG. 17G).

Step h

Figure 17H:
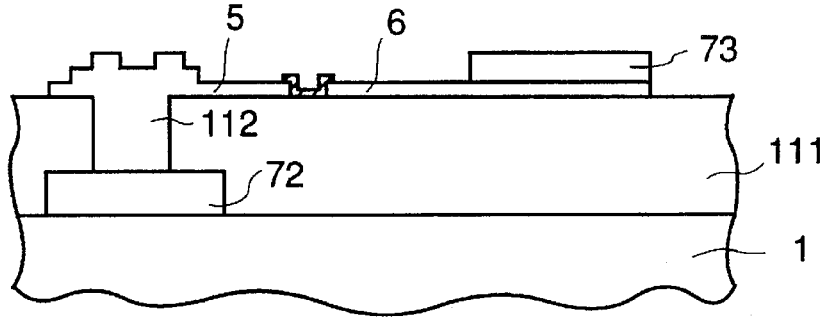

A pattern is formed so that resist may be applied to all the surface areas except the contact hole 112 and, using this as a mask, a 50 Å thick Ti film and a 500 Å thick Au film are sequentially formed by vacuum deposition. Unnecessary portions of these films are removed by lift-off and used to fill the contact hole 112 (FIG. 17H).

Thus, an underwire 72, an insulator interlayer 111, an overwire 73, a pair of device electrodes 5 and 6 and a thin film 2 for an electron-emitting section are formed on an insulator substrate 1.

Now, a display apparatus incorporating such an electron source will be described below by referring to FIGS. 8, 9A and 9B.

Firstly, the substrate 1 carrying thereon a large number of plane type surface-conduction electron-emitting devices is rigidly fitted onto a rear plate 81. Then, a face plate 86 (comprising a glass substrate 83 and a fluorescent film 84 and a metal back 85 arranged on the inner surface of the glass substrate 83) is arranged 5 mm above the substrate 1 by way of a support frame 82 and frit glass is applied to the contact areas of the face place 82, the support frame and the rear plate 81 and burnt in ambient air atmosphere at 410° C. for ten minutes to tightly bond them together (FIG. 8).

The rear plate 81 is securely fitted to the substrate 1 also by means of frit glass. Note that reference numeral 74 in FIG. 8 denotes an electron-emitting region of the device of FIG. 1 and reference numerals 72 and 73 respectively designate X- and Y-wires connected to the pair of device electrodes of related surface-conduction type electron-emitting devices.

The fluorescent film 84 is constituted only by fluorescent bodies if it is used for a monochrome display, whereas it comprises in this embodiment a number of stripe-shaped fluorescent bodies separated by black stripes of a popularly used black material containing graphite as a principal ingredient. The fluorescent stripes are formed on the glass substrate 83 by applying a fluorescent material in the form of slurry.

An ordinary metal back 85 is arranged on the inner surface of the fluorescent film 84. It is prepared by smoothing the inner surface of the fluorescent film 84 (in an operation normally called "filming") and forming an Al film thereon by vacuum deposition.

While a transparent electrode (not shown) may be formed on the outer surface of the fluorescent film 84 in order to raise the conductivity of the fluorescent film 84, such a layer is not formed in this embodiment because the metal back 85 has a sufficiently high conductivity.

Care should be taken to accurately align each set of color fluorescent bodies and an electron-emitting device, as a color display is involved, before the above listed components of the display apparatus are bonded together.

The glass container prepared in a manner as described above and comprising a glass substrate 83 and other components is then evacuated by way of an exhaust pipe (not shown) and a vacuum pump to achieve a sufficient degree of vacuum in the container and then a voltage is applied to the device electrodes of the electron-emitting devices 74 by way of external terminals Dox1 through Doxm and Doy1 through Doyn to carry out a forming operation in order to produce an electron-emitting region out of the thin film for an electron-emitting region of each electron-emitting device. FIG. 4 shows the waveform of a pulse voltage to be used for a forming operation.

In FIG. 4, T1 and T2 respectively indicate the pulse width and the distance separating adjacent pulses of a pulse voltage, which are respectively 1 millisecond and 10 milliseconds for this embodiment, while the peak level (peak voltage in the forming operation) of the voltage is 10 V. The forming operation is conducted in a vacuum atmosphere of approximately $1\times10^{-6}$ Torr for 60 seconds.

The electron-emitting region prepared in a manner as described above contains fine particles made of palladium as a main element and having a mean particle size of 30 Å that are dispersed throughout that section.

Then, the exhaust pipe is heated by a gas burner until it is molten to hermetically seal the evacuated casing with a degree of vacuum of approximately $10^{-6}$.

Finally, a getter operation is carried out by high frequency heating in order to maintain that degree of vacuum within the casing after it is sealed.

An image-forming apparatus according to the invention and having a configuration as described above is operated by using signal generating means (not shown) and applying scan signals and modulation signals to the electron-emitting devices by way of the external terminals Dx1 through Dxm and Dy1 through Dyn to cause the electron-emitting devices to emit electrons. Meanwhile, 5 kV is applied to the metal back 85 by way of high voltage terminal Hv to accelerate electron beams and cause them to collide with the fluorescent film 84, which by turn is energized to emit light to display intended images.

In order to accurately understand the performance of a plane type surface-conduction electron-emitting device according to the invention, an experiment was carried out, in which a sample of plane type surface-conduction electron-emitting device was prepared for comparison according to the same process as the electron-emitting device used in the above and tested for its properties by using a measuring apparatus provided with a normal vacuum system as shown in FIG. 3. Values the same as those of a device according to the invention were selected respectively for L1, W1, W2 and other variables shown in FIG. 1. For the test of the sample, the distance between the anode electrode and the electron-emitting device was 4 mm and the anode voltage was 1 kV, while the inside of the vacuum chamber of the gauging system was maintained to a degree of vacuum of $1\times10^{-6}$ Torr. The device voltage applied to the device was raised uniformly at a rate of approximately 1 V/sec to increase monotonically both device current If and electron emission current Ie.

The device current If and the emission current Ie were measured while applying the device voltage to the device electrodes 5 and 6 of the sample for comparison to prove a current-voltage relationship illustrated in FIG. 5. (See FIG. 19). To the contrary, in a test using an electron-emitting device according to the invention, the emission current Ie showed a rapid increase when the device voltage exceeded 8 V and reached to 1.2 μA when the device voltage was 14 V, at which the device current If was 2.2 mA so that an electron emission efficiency $\eta$ (=Ie/If×100(%)) of 0.05% was obtained. Since a device changes its characteristics depending on the environmental factors including measuring and vacuum conditions, care was taken to carry out the experiment under same and constant conditions.

Embodiment 2

This embodiment is an electron source of an image-forming apparatus, which is realized by forming a number of step type surface-conduction electron-emitting devices on respective substrates and using a same material or a material containing a same element for all the device electrodes, the X-wires, the Y-wires and the connections connecting the device electrodes and the wires of the apparatus. This apparatus is characterized in that each electron-emitting device has an insulator interlayer which is laid between its X-wires and Y-wires and constitutes a raised section of the device.

Figure 20:
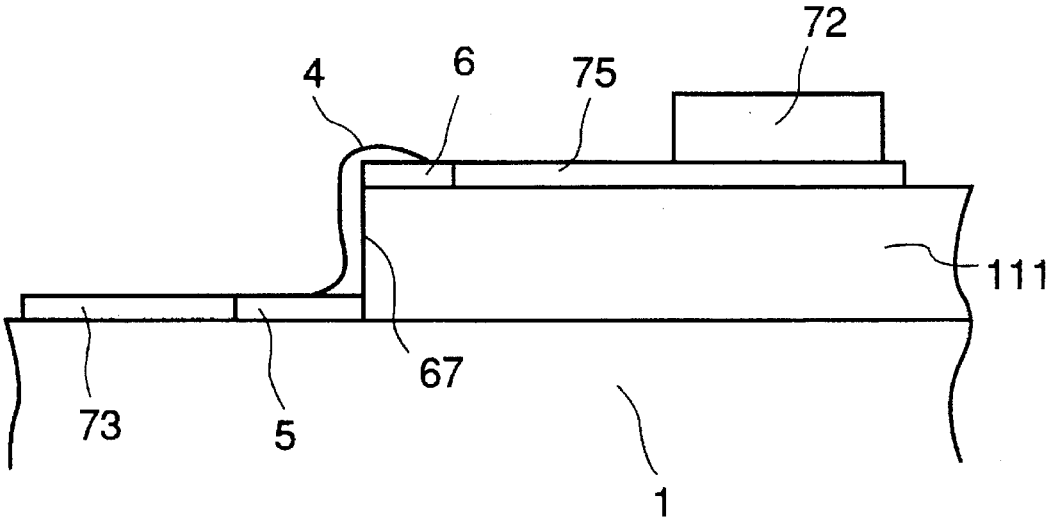
FIG. 20 is a schematic sectional view of a second embodiment of an electron source of the invention.

Since each electron-emitting device and related parts of the electron source have a plan view same as that of FIG. 14, it will not be described here any further. FIG. 20 shows a cross sectional view taken along line A—A' in FIG. 14. In FIG. 20, there are shown a substrate 1, an X-wire 72 (also referred to as overwire) that corresponds to Dxm in FIG. 7, a Y-wire 73 (also referred to as underwire) that corresponds to Dym in FIG. 7, a thin film 4 including an electron-emitting section, a pair of device electrodes 5 and 6 and an interlayer 111.

This embodiment is prepared by following the steps described below and illustrated in FIGS. 21A through 21F.

Step a

Figure 21A:
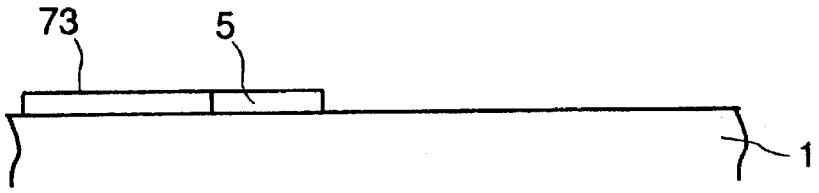
FIGS. 21A through 21F are schematic sectional views of the second embodiment of FIG. 14, showing it in different manufacturing steps.

A 5,000 Å thick Pd layer is formed on a cleansed soda lime glass substrate and then photoresist (AZ 1370 available from HECHST) is applied thereto by a spinner and baked. Then, the photoresist layer is exposed to light with a photomask arranged thereon and photochemically developed to produce a resist pattern for a Y-wire 73. Subsequently, the Pd film was etched to produce a Y-wire 73 and a device electrode 5 simultaneously (FIG. 21A).

Step b

Figure 21B:
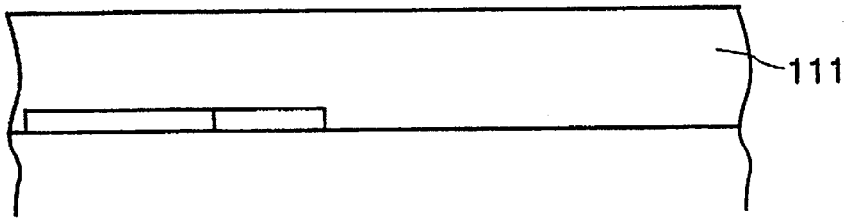

An insulator interlayer 111 of silicon oxide is formed to a thickness of 0.1 μm by RF sputtering. Said interlayer is laid between an X-wire 72 and a Y-wire and serves as a raised section of the surface-conduction type standing electron-emitting device (FIG. 21B).

Step c

Figure 21C:
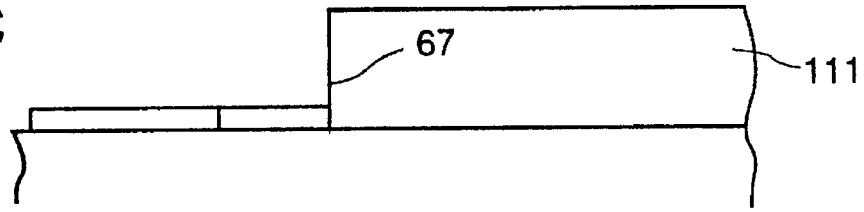

A photoresist pattern 112 is formed on the silicon oxide film produced in step b for a step section 67 having a desired profile and an insulator interlayer 111 and then the insulator interlayer 111 is etched, using the photoresist pattern as a mask, to produce a raised section 67 with a desired profile and have the insulator interlayer 111 conform to the designed shape (FIG. 21C).

RIE (Reactive Ion Etching) and $CF_4$ and $H_2$ gases are used for the etching operation in this step.

Step d

Figure 21D:
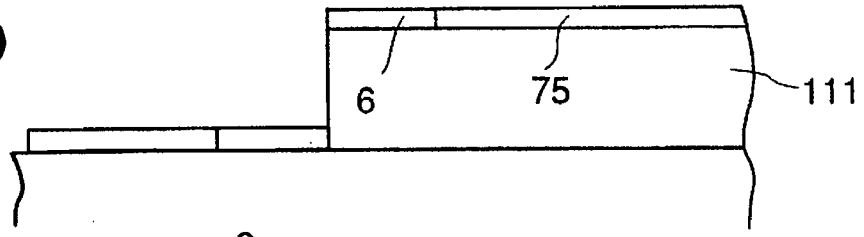

Subsequently, another photoresist pattern is prepared (photoresist RD-2000N-41: available from Hitachi Chemical Co., Ltd.) for device electrodes 5 and 6 and a wire 75*e* and then a 1,000 Å thick Pd is formed by vacuum deposition. The photoresist pattern is dissolved in an organic solvent and the Pd deposit film is lifted-off to produce oppositely arranged device electrodes 5 and 6, which are separated by a distance equal to the thickness of the raised section 67 or 1.5 μm. The device electrode shows a width W1 of 500 μm. (FIG. 21D).

Step e

Using a mask having an opening for the device electrodes 5 and 6 and their neighboring areas as in the case of Embodiment 1 above, a 1,000 Å thick Cr film 121 is formed by vapor deposition and subsequently subjected to a patterning operation. Then, organic Pd (ccp 4230 available from Okuno Pharmaceutical Co., Ltd.) is applied thereon by means of a spinner and heated at 300° C. for 10 minutes for baking.

Figure 21E:
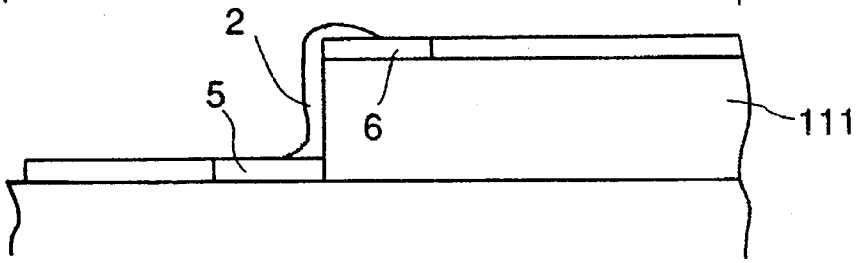

The formed thin fine particle film 2 which is made of fine particles of Pd as a main element and used for producing an electron-emitting section has a thickness of 100 Å and a sheet resistance of $5\times10^4$ Ω/cm$^2$. Then, the Cr film 121 and the baked thin film 2 for an electron-emitting section are etched, using an acid etchant, to produce a desired pattern (FIG. 21E).

Step f

Figure 21F:
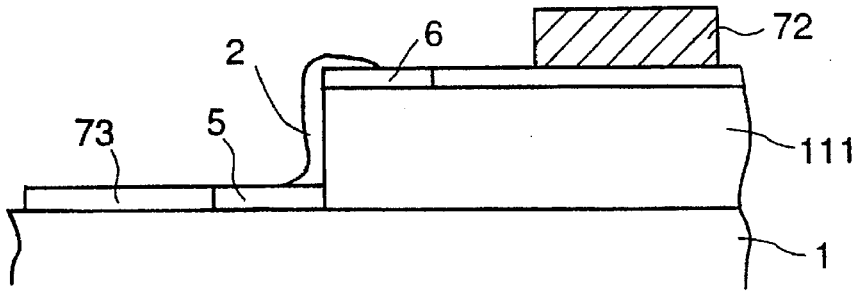

An Ag-Pd conductor body is formed on the device electrode 6 to a thickness of approximately 10 μm to form an X-wire 72 having a desired contour (FIG. 21F).

Thus, an X-wire 72, an insulator interlayer 111, a Y-wire 73, a pair of device electrodes 5 and 6 and a thin film 2 for an electron-emitting section are formed on an insulator substrate 1.

Then, a display apparatus incorporating such an electron source is formed in a manner similar to that of Embodiment 1.

In order to accurately understand the performance of a step type surface-conduction electron-emitting device according to the invention, an experiment was carried out, in which a sample of plane type surface-conduction electron-emitting device was prepared for comparison according to the same process as the electron-emitting device used in the above and tested for its properties by using a gauging apparatus provided with a normal vacuum system shown in FIG. 3 as in the case of Embodiment 1. Values same as those of a device according to the invention were selected for the sample.

Figure 19:
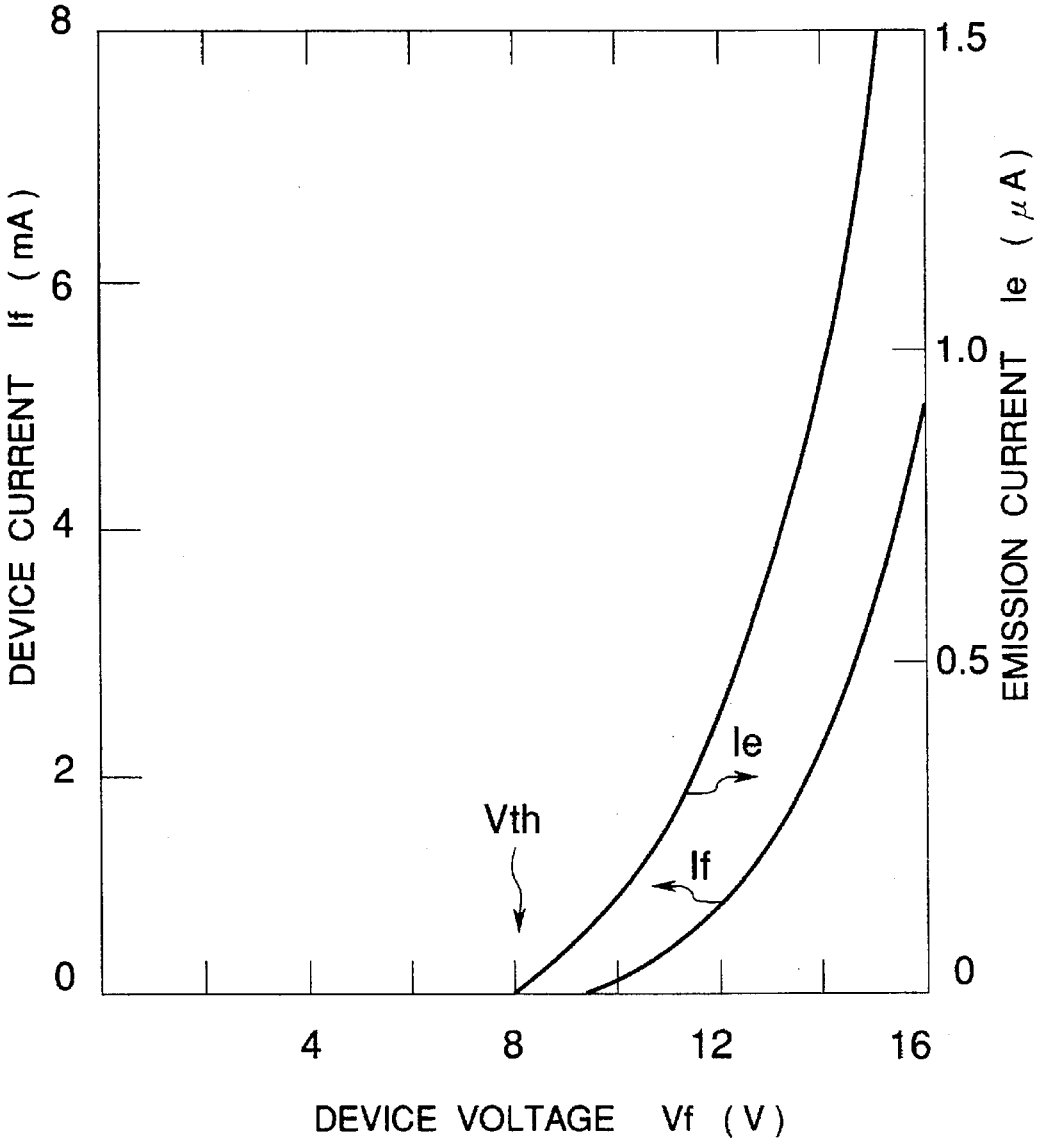
FIG. 19 is a graph similar to FIG. 5 but showing the voltage-current relationships for a specimen prepared for the purpose of comparison.

The device current If and the emission current Ie were measured while applying the device voltage to the device electrodes 5 and 6 of the sample to obtain a current-voltage relationship illustrated in FIG. 5 (See FIG. 19).

In a test using an electron-emitting device according to the invention, the emission current Ie showed a rapid increase when the device voltage exceeded 7.5 V and reached to 1.2 μA when the device voltage was 14 V, at which the device current If was 2.2 mA so that an electron emission efficiency η (=Ie/If(%)) of 0.048% was obtained.

An image-forming apparatus according to the invention and having a configuration as described above is operated by using signal generating means (not shown) and applying scan signals and modulation signals to the electron-emitting devices by way of the external termianls Dx1 through Dxm and Dy1 through Dyn to cause the electron-emitting devices to emit electrons. Meanwhile, 5 kV is applied to the metal back 85 by way of high voltage terminal Hv to accelerate electron beams and cause them to collide with the fluorescent film 84, which by turn is energized to emit light to display intended images.

Embodiment 3

This embodiment is an electron source of an image-forming apparatus, which is realized by forming a number of plane type surface-conduction electron-emitting devices on respective substrates and insulator interlayers between respective X-wires and Y-wires, said insulator interlayers being found only on and near the crossings of the X- and Y-wires, connections for the X- and Y-wires and the corresponding device electrodes being electrically linked without using contact holes and arranged directly on the respective substrates.

Figure 22:
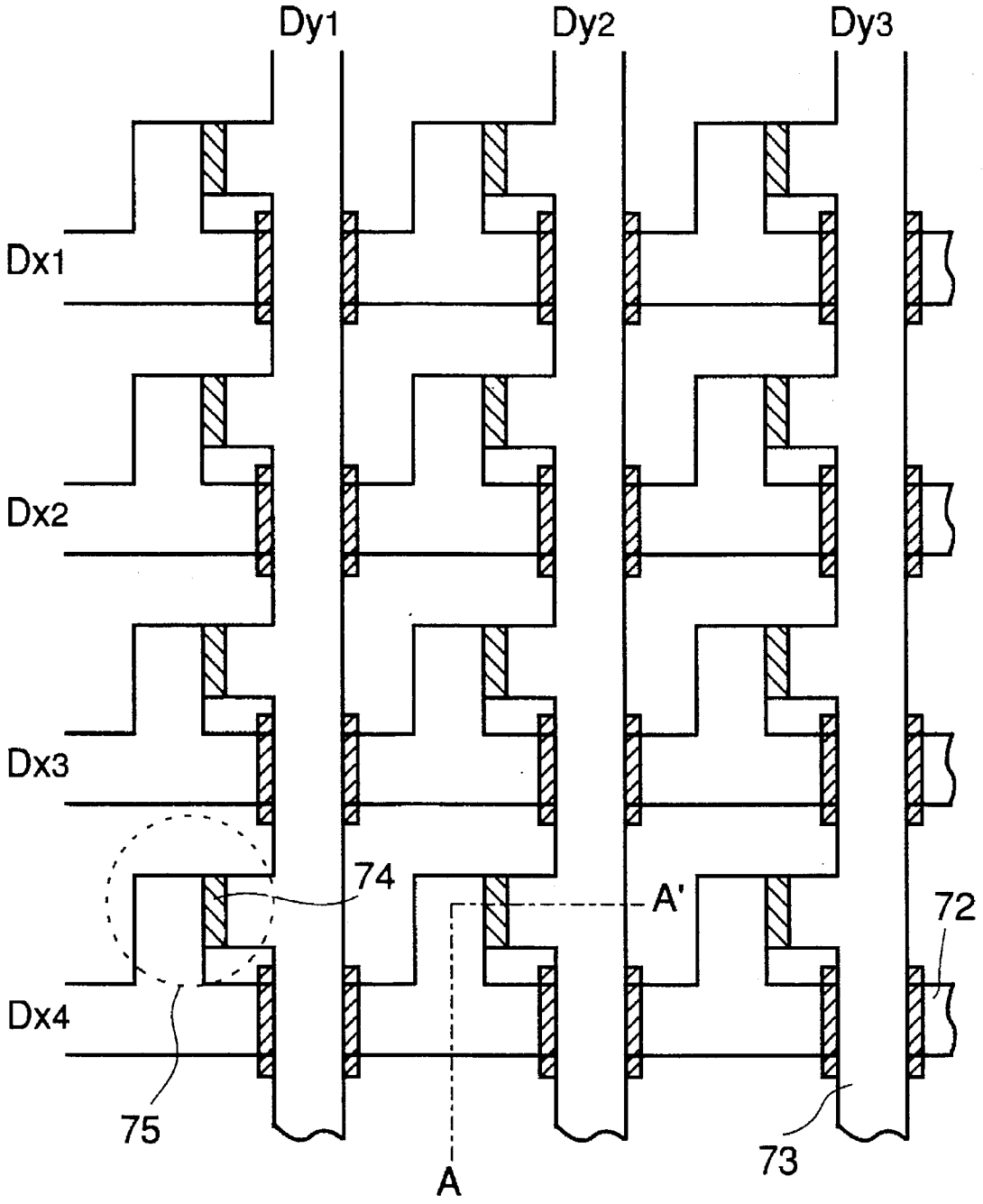
FIG. 22 is a schematic plan view of a third embodiment of an electron source of the invention.
Figure 23:
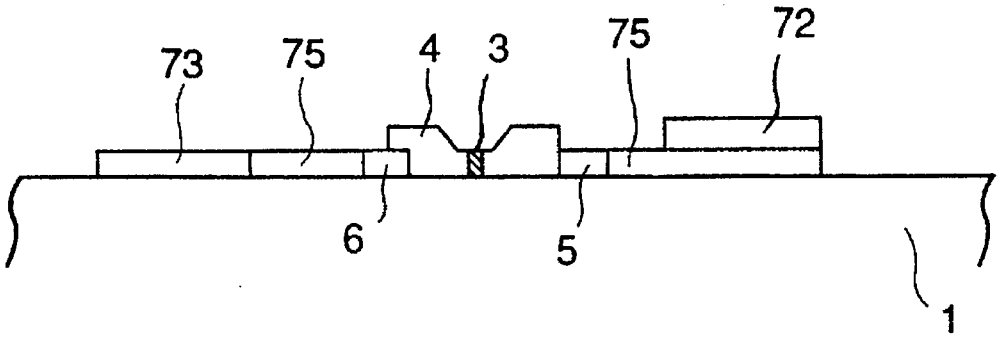
FIG. 23 is a schematic sectional view of the third embodiment of FIG. 22.

FIG. 22 shows a plan view of part of the embodiment of electron source. FIG. 23 illustrates a cross sectional view taken along line A—A' in FIG. 22. Note that same reference symbols are commonly used to respectively designate same components in FIGS. 22 and 23. In FIGS. 22 and 23, there are shown a substrate 1, an X-wire 72 (also referred to as overwire) that corresponds to Dmx in FIG. 7, a Y-wire 73 (also referred to as underwire) that corresponds to Dmy in FIG. 7, a thin film 4 including an electron-emitting region, a connection 76 and a pair of device electrodes 5 and 6.

This embodiment is prepared by following the steps described below and illustrated in FIGS. 24A through 24E.

Step a

Figure 24A:
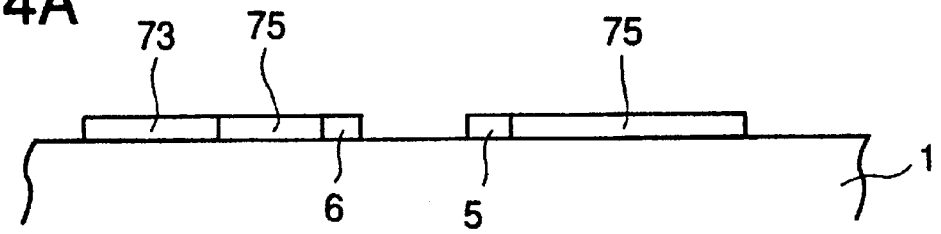
FIGS. 24A through 24E are schematic sectional views of the third embodiment, showing it in different manufacturing steps.

A silicon oxide film is formed on a cleansed soda lime glass plate to a thickness of 0.5 μm by sputtering to produce a substrate 1, on which a 50 Å thick Cr layer and a 6,000 Å thick Au layer are sequentially formed by vacuum deposition. Thereafter, photoresist (AZ 1370 available from HECHST) is applied thereto by a spinner and baked. Then, the photoresist layer is exposed to light with a photomask arranged thereon and photochemically developed to produce a resist pattern for device electrodes 5 and 6, a connection 75 and a Y-wire 73. Subsequently, the Au and Cr deposit layer is wet-etched, using the resist pattern as a mask to produce device electrodes 5 and 6 (electrode width: 300 μm, interelectrode distance: 2 μm), a connection 75 and a Y-wire 73 simultaneously (FIG. 24A).

Step b

Figure 24B:
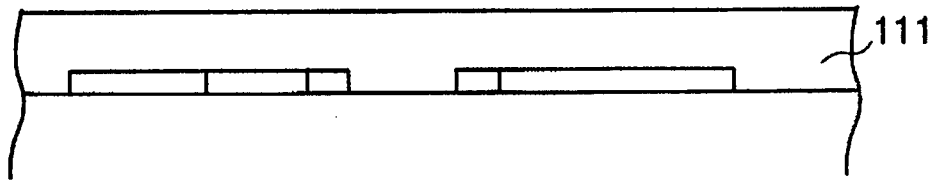

An insulator interlayer 111 of silicon oxide to be arranged only on and near the crossing of a Y-wire 73 and an X-wire 72 is formed to a thickness of 0.1 μm by RF sputtering (FIG. 24B).

Step c

Figure 24C:
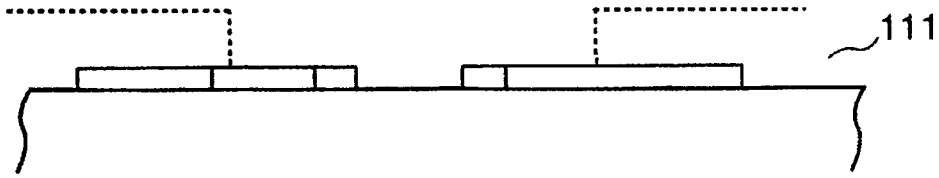

A photoresist pattern 112 for an insulator interlayer 111 to be arranged on and near the crossing of a Y-wire 73 and an X-wire 72 is formed on the silicon oxide film produced in Step b and the insulator interlayer 111 is etched, using the photoresist pattern as a mask, to produce an insulator interlayer 111 having a desired form (FIG. 24C).

RIE (Reactive Ion Etching) and $CF_4$ and $H_2$ gases are used for the etching operation in this step.

Step d

Figure 24D:
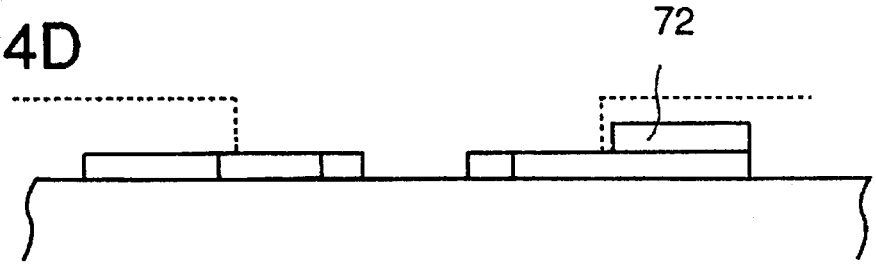

Subsequently, another photoresist pattern is prepared (photoresist RD-2000N-41: available from Hitachi Chemical Co., Ltd.) for an X-wire 72 and then Au was deposited thereon by vacuum deposition to a thickness of 5,000 Å. Thereafter, the photoresist pattern is dissolved in an organic solvent and the Au deposit film is lifted-off to produce an X-wire 72 (FIG. 24D).

Step e

Using a mask having an opening for the device electrodes 5 and 6 and their neighboring areas as in the case of Embodiment 1 above, a 1,000 Å thick Cr film 121 is formed by vapor deposition and subsequently subjected to a patterning operation. Then, organic Pd (ccp 4230 available from Okuno Pharmaceutical Co., Ltd.) is applied thereon by means of a spinner and heated at 300° C. for 10 minutes for backing.

The formed thin fine particle film 2 which is made of fine particles of Pd as a main element and used for producing an electron-emitting region has a thickness of 75 Å and a sheet resistance of $1\times10^5$ Ω/cm$^2$.

Figure 24E:
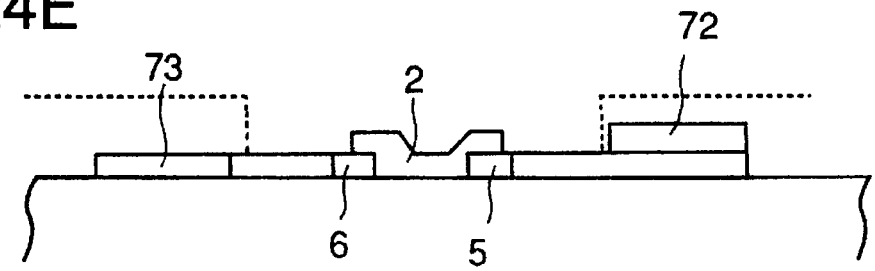

Then, the Cr film 121 and the baked thin film 2 for an electron-emitting region are etched, using an acid etchant, to produce a desired pattern (FIG. 24E).

Thus, an underwire 72, an insulator interlayer 111, an overwire 72, a pair of device electrodes 5 and 6 and a thin film 2 for an electron-emitting region are formed on an insulator substrate 1.

Then, a display apparatus incorporating such an electron source is formed in a manner similar to that of Embodiment 1.

In order to accurately understand the performance of a plane type surface-conduction electron-emitting device according to the invention, an experiment was carried out, in which a sample of plane type surface-conduction electron-emitting device was prepared for comparison according to the same process as the electron-emitting device used in the above and tested for its properties by using a gauging apparatus provided with a normal vacuum system shown in FIG. 3 as in the case of Embodiment 1. Values the same as those of a device according to the invention were selected for the sample.

The device current If and the emission current Ie were measured while applying the device voltage to the device electrodes 5 and 6 of the sample to obtain a current-voltage relationship illustrated in FIG. 5.

In a test using an electron-emitting device according to the invention, the emission current Ie showed a rapid increase when the device voltage exceeded 7.0 V and reached to 1.0 μA when the device voltage was 14 V, at which the device current If was 2.1 mA so that an electron emission efficiency η (=Ie/If(%)) of 0.05% was obtained.

An image-forming apparatus according to the invention and having a configuration as described above is operated by using signal generating means (not shown) and applying scan signals and modulation signals to the electron-emitting devices by way of the external terminals Dx1 through Dxm and Dy1 through Dyn to cause the electron-emitting devices to emit electrons. Meanwhile, a high voltage greater than several kV is applied to the metal back 85 by way of high voltage terminal Hv to accelerate electron beams and cause them to collide with the fluorescent film 84, which by turn is energized to emit light to display intended images.

Embodiment 4

This embodiment is an image-forming system comprising a pair of image-forming apparatuses according to the invention as two units, for which electron sources are prepared by partly modifying the method of preparing an electron source of Embodiment 1 and to which the first and second drive methods are respectively applied.

Otherwise, each unit of this embodiment has a configuration same as that of Embodiment 1 and hence can be manufactured in a way same as that of Embodiment 1. The forming operation and the operation of bonding together the face plate, the support frame and the rear plate to produce a casing for each unit are also same as their counterparts of Embodiment 1. It should be noted here, however, a pair of identical apparatuses are prepared at the same time for this embodiment.

The casing of one of the prepared apparatuses is evacuated by means of an ordinary vacuum system to a degree of vacuum of approximately $10^{-6}$ Torr and then the exhaust pipe of the casing is heated and molten by a gas burner (not shown) to hermetically seal the casing. This apparatus is referred to herein as display panel A.

On the other hand, the other apparatus is held by a pair of plate-shaped heat sources at the face and rear plates respectively and the entire apparatus was heated and baked at approximately 120° C. for an hour. Then, the apparatus was evacuated by means of a super high vacuum system for ten hours while it is heated continuously. Subsequently, the exhaust pipe of the casing is heated and molten by a gas burner (not shown) to hermetically seal the casing. This apparatus is referred to herein as display panel B.

Finally, both the display panels A and B are subjected to a getter process using a resistance heating technique in order to maintain an intended degree of vacuum after they are sealed.

Now, a drive circuit for driving the panels A and B for display operation respectively by using the first and second drive methods will be illustrated and described below.

Figure 25:
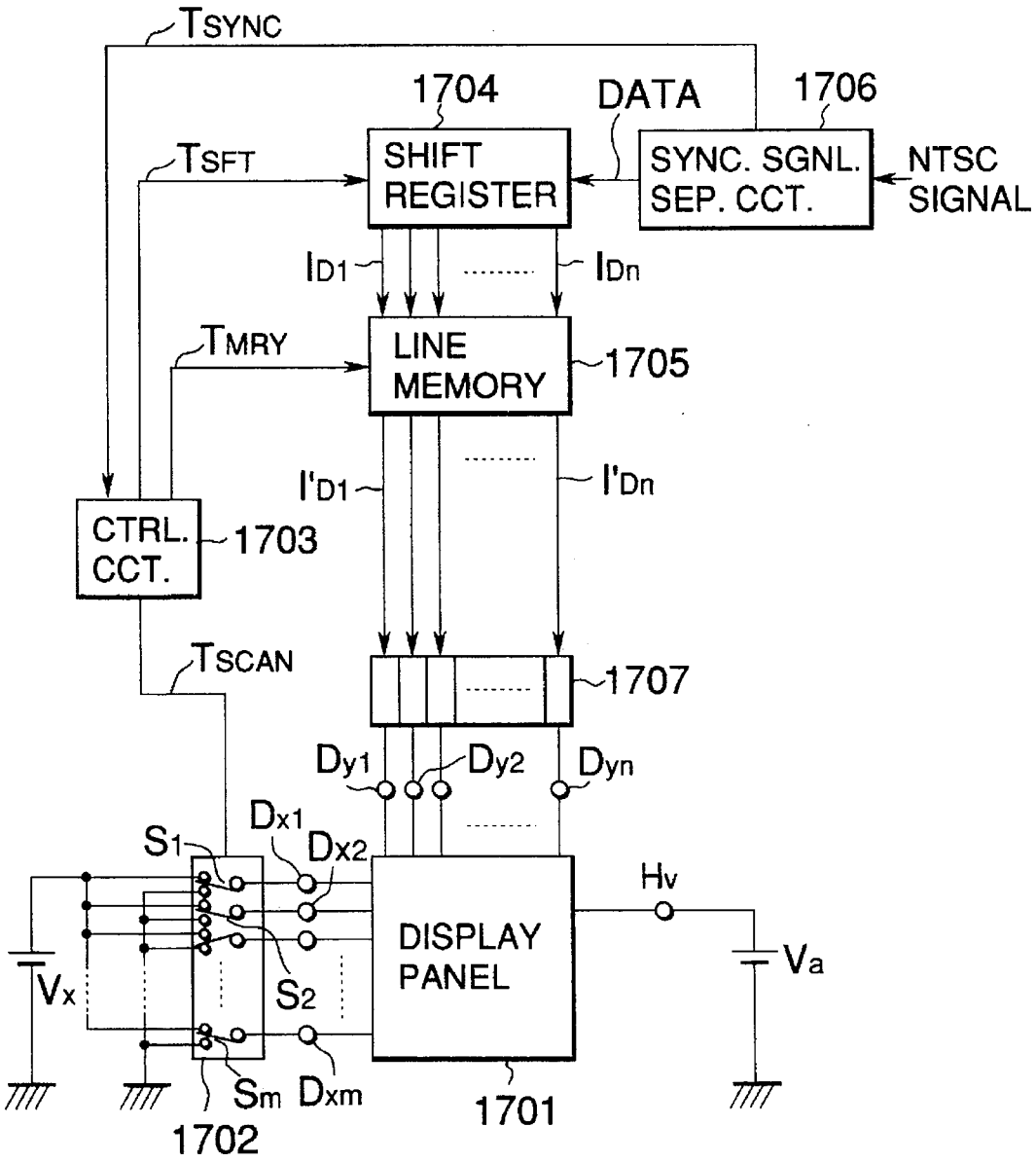
FIG. 25 is a schematic circuit diagram of a drive circuit for carrying out first and second drive methods for a fourth embodiment of the invention.

FIG. 25 is a block diagram of a drive circuit for carrying out the first and second drive methods which are designed for image display operation using NTSC television signals. In FIG. 25, reference numeral 1701 denotes display panel A or B prepared in a manner as described above. Scan circuit 1702 operates to scan display lines whereas control circuit 1703 generates input signals to be fed to the scan circuit. Shift register 1704 shifts data for each line and line memory 1705 feeds modulation signal generator 1707 with data for a line. Synchronizing signal separation circuit 1706 separates a synchronizing signal from an incoming NTSC signal. Both Vx and Va in FIG. 25 denote a DC voltage source.

Each component of the apparatus of FIG. 25 operates in a manner as described below.

The display panel 1701 is connected to external circuits via terminals Dx1 through Dxm, Dy1 through Dym and high voltage terminal Hv, of which terminals Dx1 through Dxm are designed to receive scan signals for sequentially driving on a one-by-one basis the rows (of n devices) of a multiple electron beam source in the apparatus comprising a number of surface-conduction electron-emitting devices arranged in the form of a matrix having m rows and n columns.

On the other hand, terminals Dy1 through Dyn are designed to receive a modulation signal for controlling the output electron beam of each of the surface-conduction electron-emitting devices of a row selected by a scan signal. High voltage terminal Hv is fed by the DC voltage source Va with a DC voltage of a level typically around 10 kV, which is sufficiently high to energize the fluorescent bodies of the selected surface-conduction electron-emitting devices.

The scan circuit 1702 operates in a manner as follows.

The circuit comprises n switching devices (of which only devices S1 and S2 are schematically shown in FIG. 25), each of which takes either the output voltage of the DC voltage source or 0 V and comes to be connected with one of the terminals Dx1 through Dxm of the display panel 1701. Each of the switching devices S1 through Sm operates in accordance with control signal Tscan fed from the control circuit 1703 and can be prepared by combining transistors such as FETs.

The DC voltage source Vx of this embodiment is designed to output a constant voltage of 7 V so that any drive voltage applied to devices that are not being scanned is reduced to less than threshold voltage Vth. (This will be described later in greater detail by referring to FIG. 28.)

The control circuit 1703 coordinates the operations of related components so that images may be appropriately displayed in accordance with externally fed video signals. It generates control signals Tscan, Tsft and Tmry in response to synchronizing signal Tsync fed from the synchronizing signal separation circuit 1706, which will be described below. These control signals will be described later in greater detail by referring to FIG. 30.

The synchronizing signal separation circuit 1706 separates the synchronizing signal component and the luminance signal component form an externally fed NTSC television signal and can be easily realized using a popularly known frequency separation (filter) circuit. Although a synchronizing signal extracted from a television signal by the synchronizing signal separation circuit 1706 is constituted, as well known, of a vertical synchronizing signal and a horizontal synchronizing signal, it is simply designated as Tsync signal here for convenience sake, disregarding its component signals. On the other hand, a luminance signal drawn from a television signal, which is fed to the shift register 1704, is designed as DATA signal.

The shift register 1704 carries out for each line a serial/parallel conversion on DATA signals that are serially fed on a time series basis in accordance with control signal Tsft fed from the control circuit 1703. In other words, a control signal Tsft operates as a shift clock for the shift register 1704.

A set of data for a line that have undergone a serial/parallel conversion (and correspond to a set of drive data for n electron-emitting devices) are sent out of the shift register 1704 as n parallel signals Id1 through Idn.

Line memory 1705 is a memory for storing a set of data for a line, which are signals Id1 through Idn, for a required period of time according to control signal Tmry coming from the control circuit 1703. The stored data are sent out as I'd1 through I'dn and fed to modulation signal generator 1707.

Said modulation signal generator 1707 is in fact a signal source that appropriately drives and modulates the operation of each of the surface-conduction electron-emitting devices and output signals of this device are fed to the surface-conduction type electron-emitting devices in the display panel 1701 via terminals Dy1 through Dyn.

The display panel 1701 is driven to operate as described below.

As described above by referring to the embodiments and FIG. 5, an electron-emitting device according to the present invention is characterized by the following features in terms of emission current Ie. Firstly, as seen in FIG. 5, there exists a clear threshold voltage Vth (8 V for the electron-emitting devices of the embodiment under consideration) and the device emits electrons only when a voltage exceeding Vth is applied thereto.

Secondly, the level of emission current Ie changes as a function of the change in the applied voltage above the threshold level Vth also as shown in FIG. 5, although the value of Vth and the relationship between the applied voltage and the emission current may vary depending on the materials, the configuration and the manufacturing method of the electron-emitting device.

More specifically, when a pulse-shaped voltage is applied to an electron-emitting device according to the invention, practically no emission current is generated while the applied voltage remains under the threshold level, whereas an electron beam is emitted once the applied voltage rises above the threshold level.

It should be noted here that the intensity of an output electron beam can be controlled by changing the peak level Vm of the pulse-shaped voltage.

Addtionally, the total amount of electric charge of an electron beam can be controlled by varying the pulse width Pw.

Thus, the first drive method can be carried out for the display panel of this embodiment by using a voltage modulation type circuit for the modulation signal generator 1707 so that the peak level of the pulse shaped voltage may be modulated according to input data, while the pulse width is held constant.

On the other hand, the second drive method can be carried out for the display panel of this embodiment by using a pulse width modulation type circuit for the modulation signal generator 1707 so that the pulse width of the applied voltage may be modulated according to input data, while the peak level of the applied voltage is held constant.

As each component of the embodiment has been described above in detail by referring to FIG. 25, the operation of the display panel 1701 will now be discussed here in detail by referring to FIGS. 26 through 29 and then the overall operation of embodiment is described.

For the sake of convenience of explanation, it is assumed here that the display panel comprises 6×6 pixels (or m=n=6), although it may be needless to say that by far much more pixels are used for a display panel in actual applications.

Figure 26:
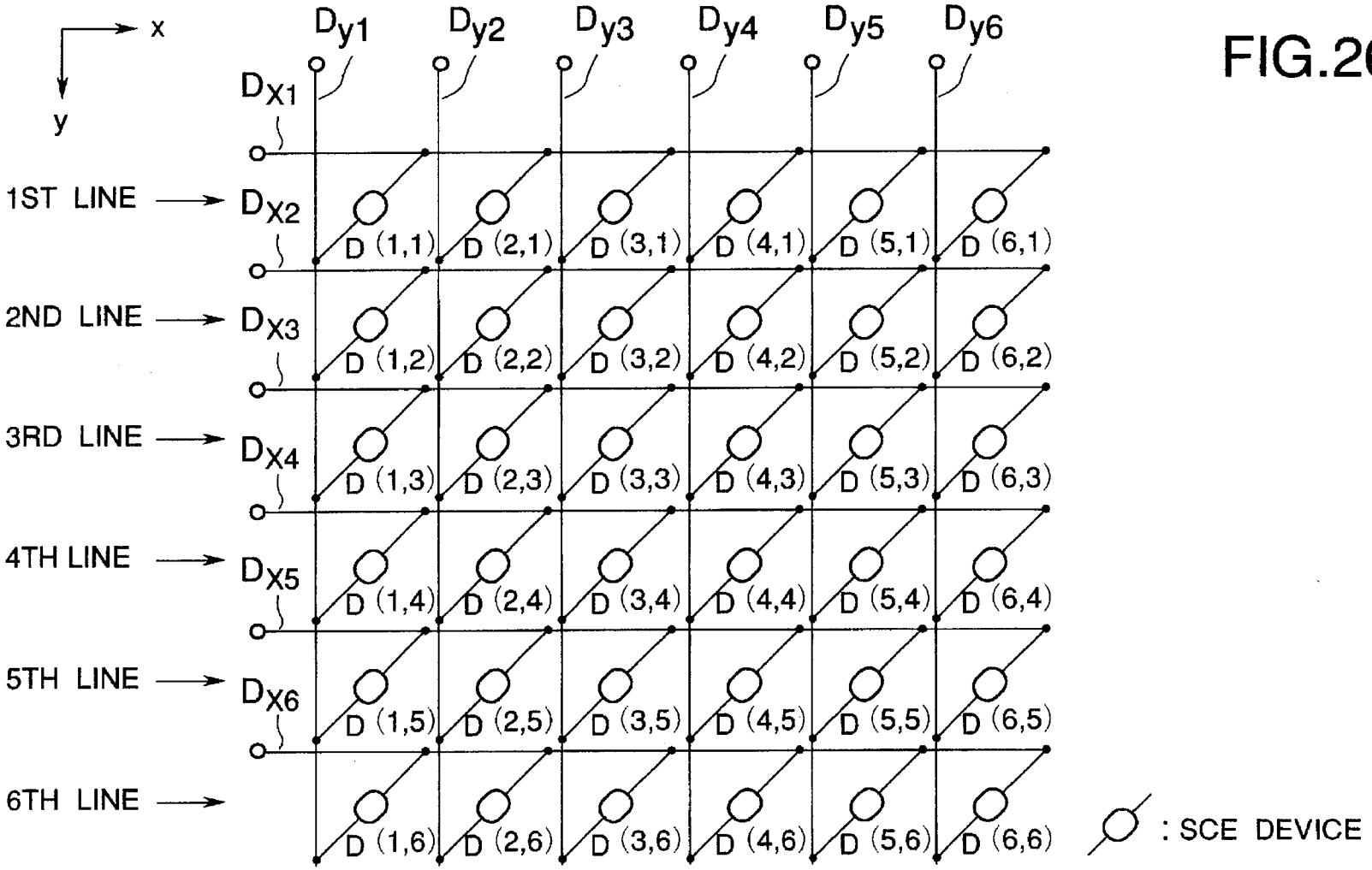
FIG. 26 is a circuit diagram of part of the fourth embodiment of FIG. 25 comprising a plurality of electron-emitting devices arranged to form a matrix.

The multiple electron beam source of FIG. 26 comprises surface-conduction electron emitting devices arranged and wired in the form of a matrix of six rows and six columns. For the convenience of description, a (X, Y) coordinate is used to locate the devices. Thus, the locations of the devices are expressed as, for example, D(1, 1), D(1, 2) and D(6, 6).

In the operation of displaying images on the display panel of the embodiment by driving a multiple electron beam sources as described above, an image is divided into a number of narrow strips, or lines as referred to hereinafter, running in parallel with the X-axis so that the image may be restored on the panel when all the lines are displayed there, the number of lines being assumed to be six here. In order to drive a row of electron-emitting devices that is responsible for an image line, 0 V is applied to the terminal of the horizontal wire corresponding to the row of devices, which is one of Dx1 through Dx6, while 7 V is applied to the terminals of all the remaining wires. In synchronism with this operation, a modulation signal is given to each of the terminals of the vertical wires Dy1 through Dy6 according to the image of the corresponding line.

Figure 27:
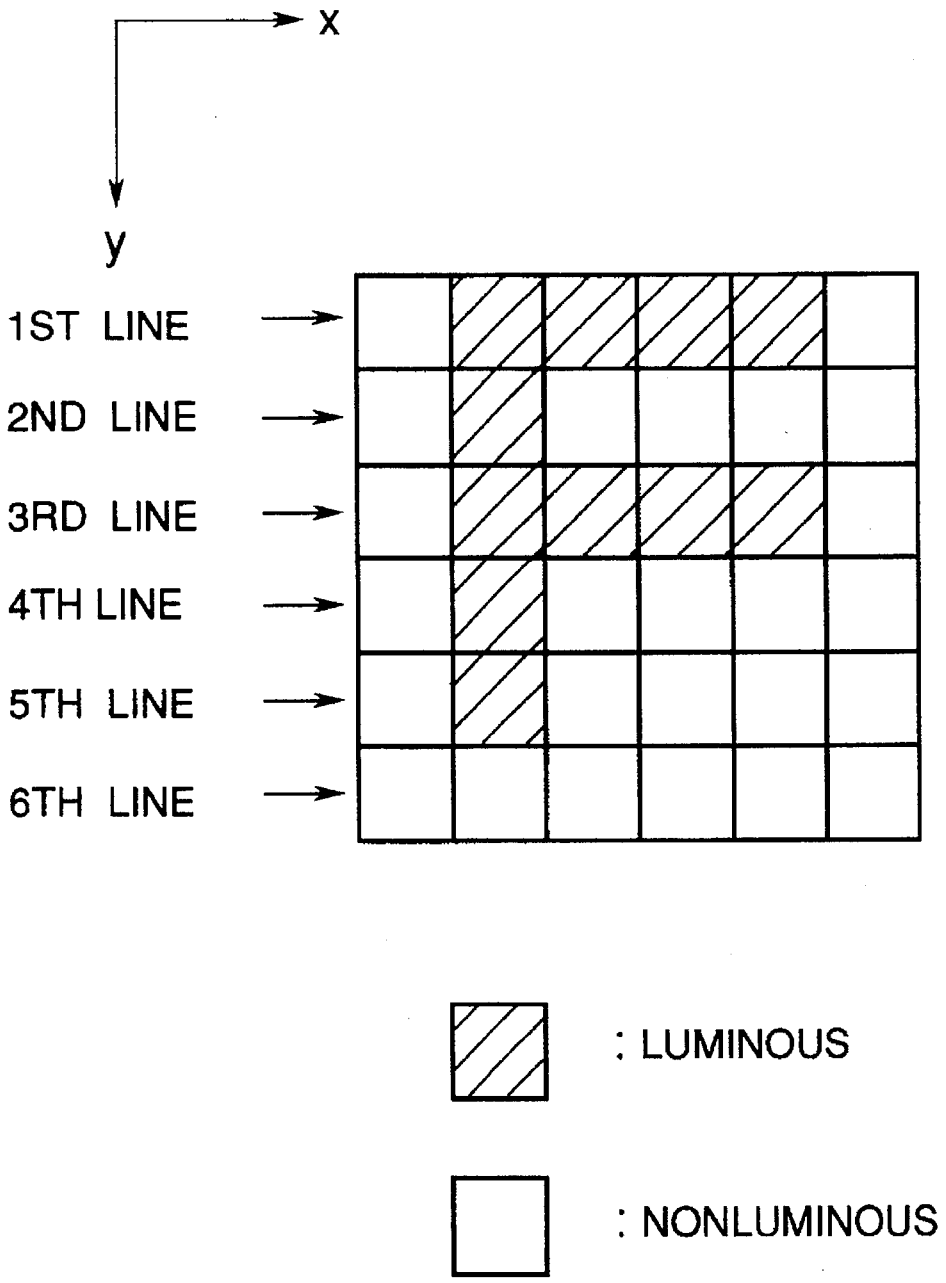
FIG. 27 is an enlarged schematic view of an image formed by the fourth embodiment.

Assume now that an image as illustrated in FIG. 27 is displayed on the panel and all the bright spots, or pixels, of the panel have an identical luminance, which is equal to 100 fL (footLambert). While known fluorescent material P-22 is used for the above display panel 1701 comprising surface-conduction electron-emitting devices having the above described features, to which a voltage of 10 kV is applied, and the image on the panel is updated at a frequency of 60 Hz, a voltage of 14 V is most suitably applied for 10 μsec. to the electron-emitting devices for a display panel having 6×6 pixels in order to achieve a luminance of 100 fL. Note, however, that these values are subject to alterations depending on changes in the parameters.

Figure 28:
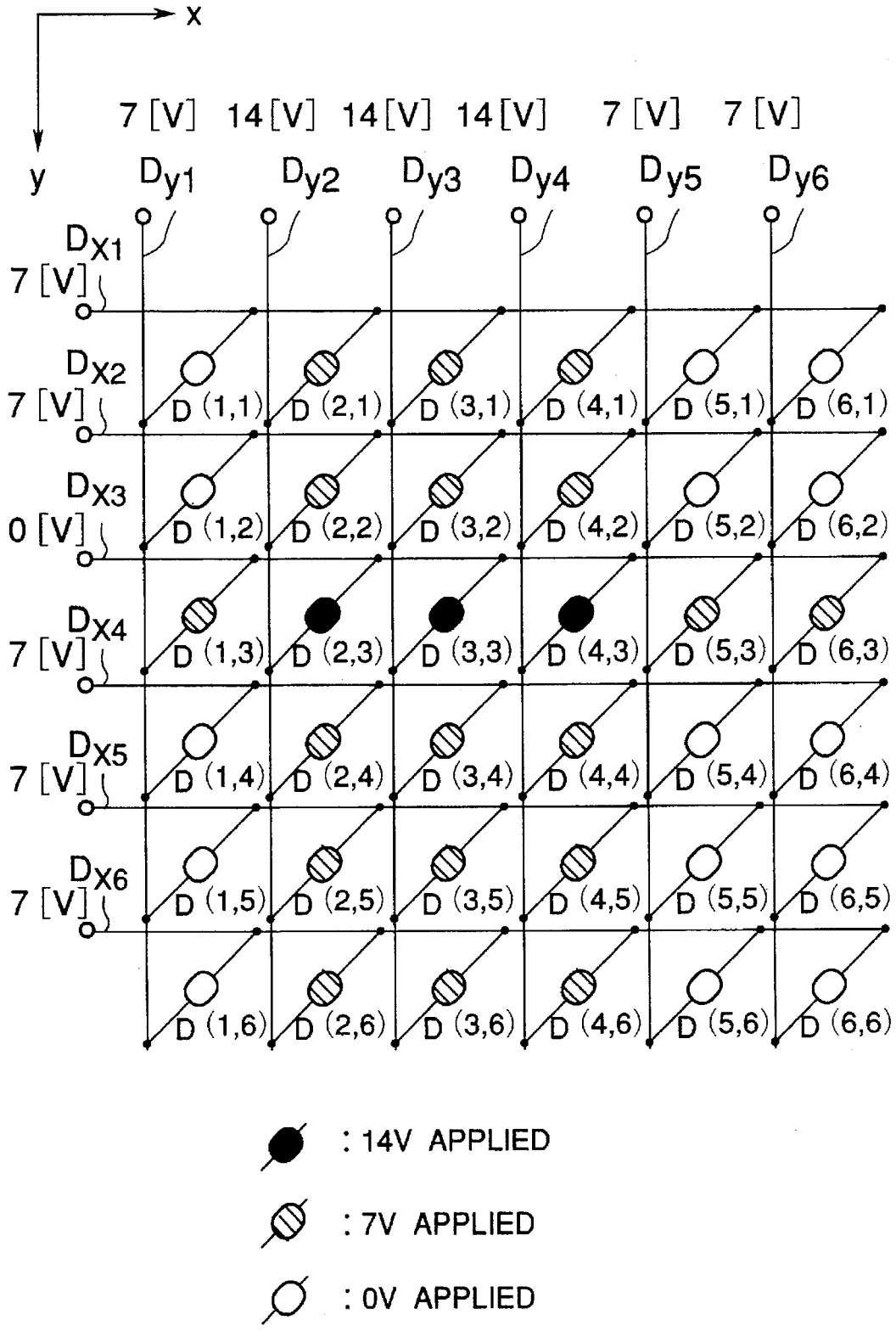
FIG. 28 is a schematic circuit diagram of part of the fourth embodiment illustrating how drive voltages are applied thereto.

Assume further that, in FIG. 27, the operation is currently on the stage of making the third line turn bright. FIG. 28 shows what voltages are applied to the multiple electron beam source by way of the terminals Dx1 through Dx6 and Dy1 through Dy6. As seen in FIG. 28, a voltage of 14 V which is far above the threshold voltage of 8 V for electron emission is applied to each of the surface-conduction electron-emitting devices D(2, 3) D(3, 3) and D(4, 3) (black devices) of the beam source, whereas 7 V or 0 V is applied to each of the remaining devices (7 V to shaded devices and 0 V to white devices). Since these voltages are lower than the threshold voltage of 8 V, these devices do not emit electron beams at all.

Figure 29:
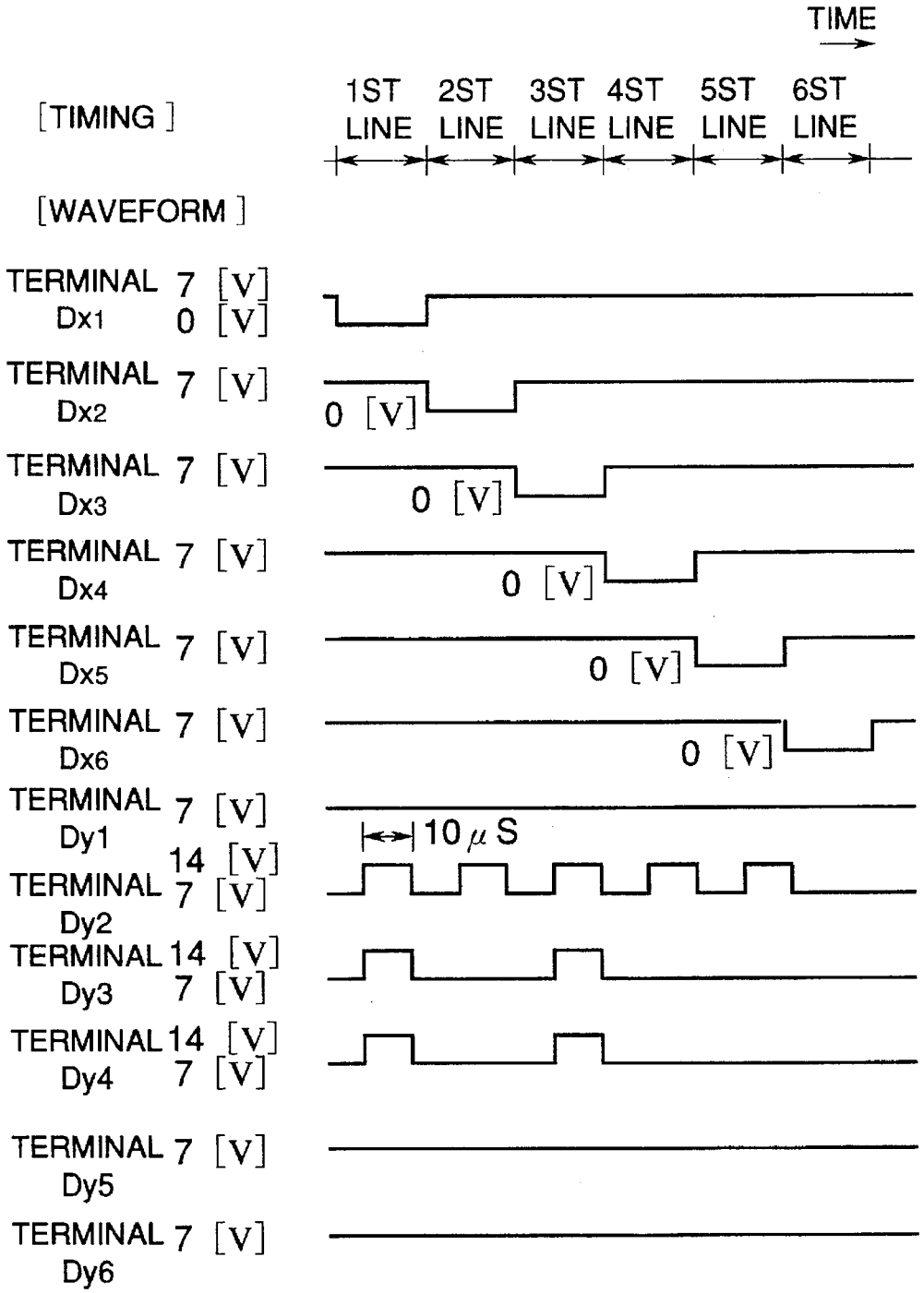
FIG. 29 is a timing chart to be used for the operation of the fourth embodiment.

In the same way, the multiple electron beam source is driven to operate for all the other lines on a time series basis in order to produce an image of FIG. 27. FIG. 29 shows a waveform timing chart for the above operation.

As seen in FIG. 29, the lines are driven sequentially, starting from the first line and the operation of driving all the lines is repeated at a rate of 60 times per second so that images may be displayed without flickering.

Images may be displayed in different gradations by modulating the luminance of each pixel in a manner as described below, although the above described image is a monotone image.

With a first method of multiple tone display involving modulation of the luminance of pixels, the luminance is raised (or lowered) by raising (or lowering) the voltage peak level of the pulsed modulation signal applied to a terminal selected from the terminals Dy1 through Dy6 to make greater (or smaller) than before above the threshold of 14 V.

If, for instance, the voltage peak level is changed stepwise between 7.9 V and 15.9 V by a step of 0.5 V, the luminance of the pixels can take a total of seventeen different steps (or tones) including luminance zero. The number of tones can be increased either by extending the voltage limits or by reducing the size of each step.

With a second method of multiple tone display, the luminance of pixels is raised (or lowered) by making the pulse width greater (or smaller) than 10 μsec.

If, for instance, the pulse width is changed stepwise between 0 and 15 μsec. by a step of 0.5 μm, the luminance of the pixels can take a total of thirty one different steps (or tones) including luminance zero. The number of tones can be increase either by extending the pulse width or by employing a smaller step.

Now, leaving the simplification of using a multiple electron beam source for 6×6 pixels, the overall operation of the apparatus of FIG. 25 will be described by referring to the timing chart of FIG. 30.

Figure 30:
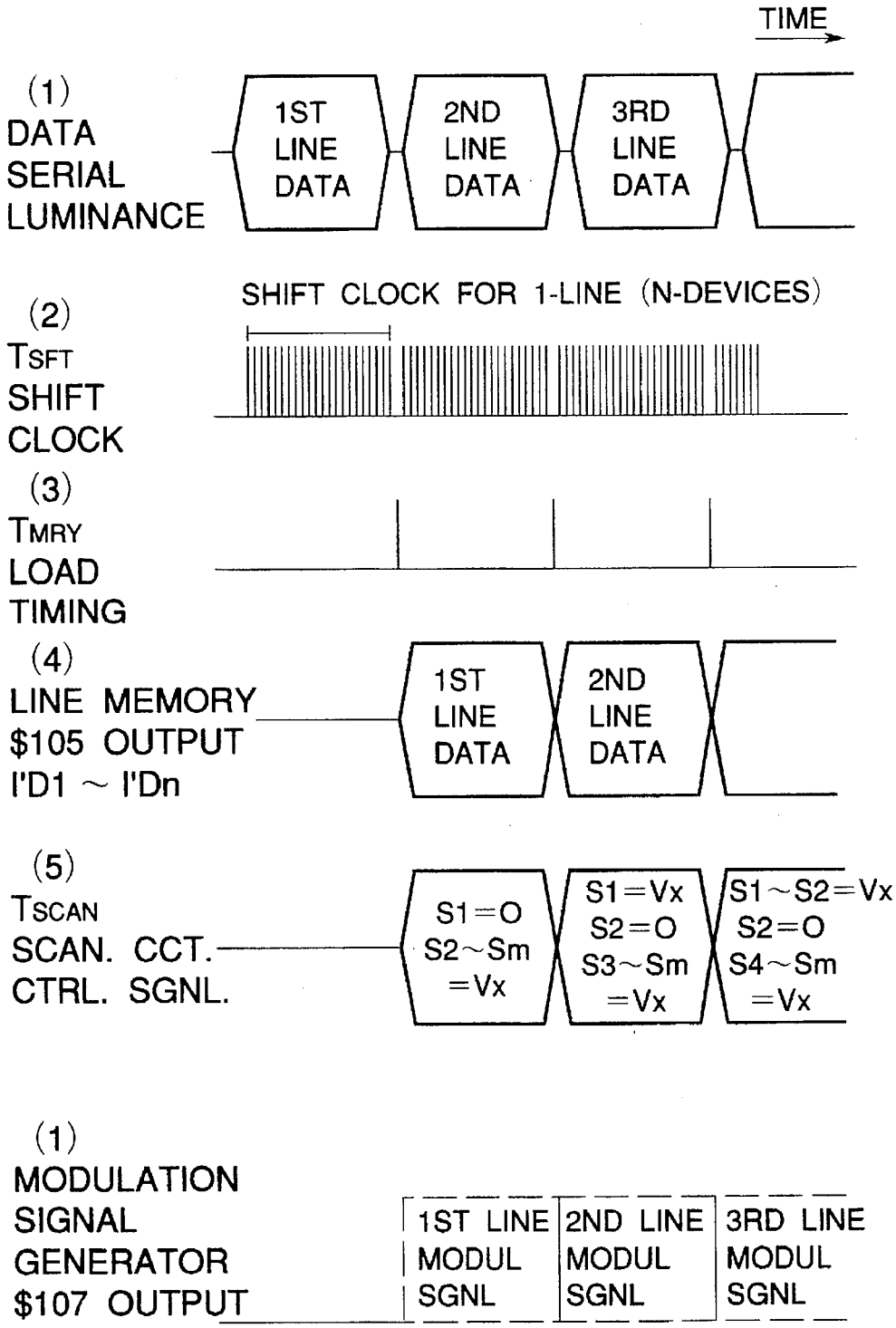
FIG. 30 is a timing chart schematically illustrating the overall operation of the fourth embodiment.

In FIG. 30, (1) shows the timing of operation of luminance signal DATA which is singled out from an externally fed NTSC signal by the synchronizing signal separation circuit 1706. As shown, the data for the first line, those for the second line, those for the third line and so forth are separately sent out as output signals. In synchronism with these, the control circuit 1703 transmits shift clocks Tsft as shown in (2) to the shift register 1704.

When data are stored in the shift register 1704 for a line, the control circuit 1703 transmits a memory write signal Tmry at a timing shown in FIG. 30 (3) and drive data for a line (n devices) are written in the line memory 1705. Consequently, output signals I'd1 through I'dn of the line memory 1705 are changed at respective timings shown in (4).

Control signal Tscan for controlling the operation of the scan circuit 1702 is shown in (5). More specifically, when the first line is driven, only the switching device S1 in the scan circuit 1702 is held to 0 V, whereas the other switching devices are held to 7 V. When the second line is driven, only the switching device S2 is held to 0 V, whereas the other switching devices are held to 7 V and so on.

In an experiment using the display panels A and B and the above described operational procedures, television images were displayed on the panels. As a result, it was observed that, while the display panel B produced clear and satisfactory images, the fluorescent materials of the display panel A that were not energized for image display became bright, although slightly. In an effort to look into this problem, samples were prepared for the purpose of comparison and used for the panels A and B. Thereafter, the panels were operated for television display, where the television drive frequency was used and the device voltage was held below Vth for both of the panels A and B to observe the electron emission current Ie and the device current If. As a result, it was found in the panel A that both the electron emission current Ie and the device current If were not held constant and showed a slight increase. This may be because the functional features of a surface-conduction electron-emitting device discovered by the inventors of the present invention were held under a stable condition in the panel B, whereas they were unstable in the panel A because of the drive conditions, the quality of vacuum within the casing of the panel and other factors.

Although it is not particularly mentioned above that the shift register 1704 and the line memory 1705 may be either of digital or of analog signal type so long as serial/parallel conversions and storage of video signals are conducted at a given rate. If digital signal type devices are used, output signal DATA of the synchronizing signal separation circuit 1706 needs to be digitized. However, such conversion can be easily carried out by arranging an A/D converter at the output of the synchronizing signal separation circuit 1706.

It may be needless to say that different circuits may be used for the modulation signal generator 1707 depending on if output signals of the line memory 1705 are digital signals or analog signals. If digital signals are used, a D/A converter circuit of a known type may be used for the modulation signal generator 1707 and an amplifier circuit may additionally be used, if necessary.

As for the second drive method, the modulation signal generator 1707 can be realized by using a circuit that combines a high speed oscillator, a counter for counting the number of waves generated by said oscillator and a comparator for comparing the output of the counter and that of the memory.

If necessary, an amplifier may be added to amplify the voltage of the output signal of the comparator having a modulated pulse width to the level of the drive voltage of a surface-conduction electron-emitting device according to the invention.

If, on the other hand, analog signals are used with the first drive method, an amplifier circuit comprising a known operational amplifier may suitably be used for the modulation signal generator 1707 and a level shift circuit may be added thereto if necessary.

As for the second drive method, a known voltage control type oscillation circuit (VCO) may be used with, if necessary, an additional amplifier to be used for voltage amplification up to the drive voltage of surface-conduction type electron-emitting device.

Now, two other embodiments of the invention will be described in terms of the third drive method that utilizes modulation of both the peak level and the pulse width of pulse-shaped voltage. Note that the display panel of these embodiments are same as the display panel B of Embodiment 4.

Embodiment 5

Figure 32:
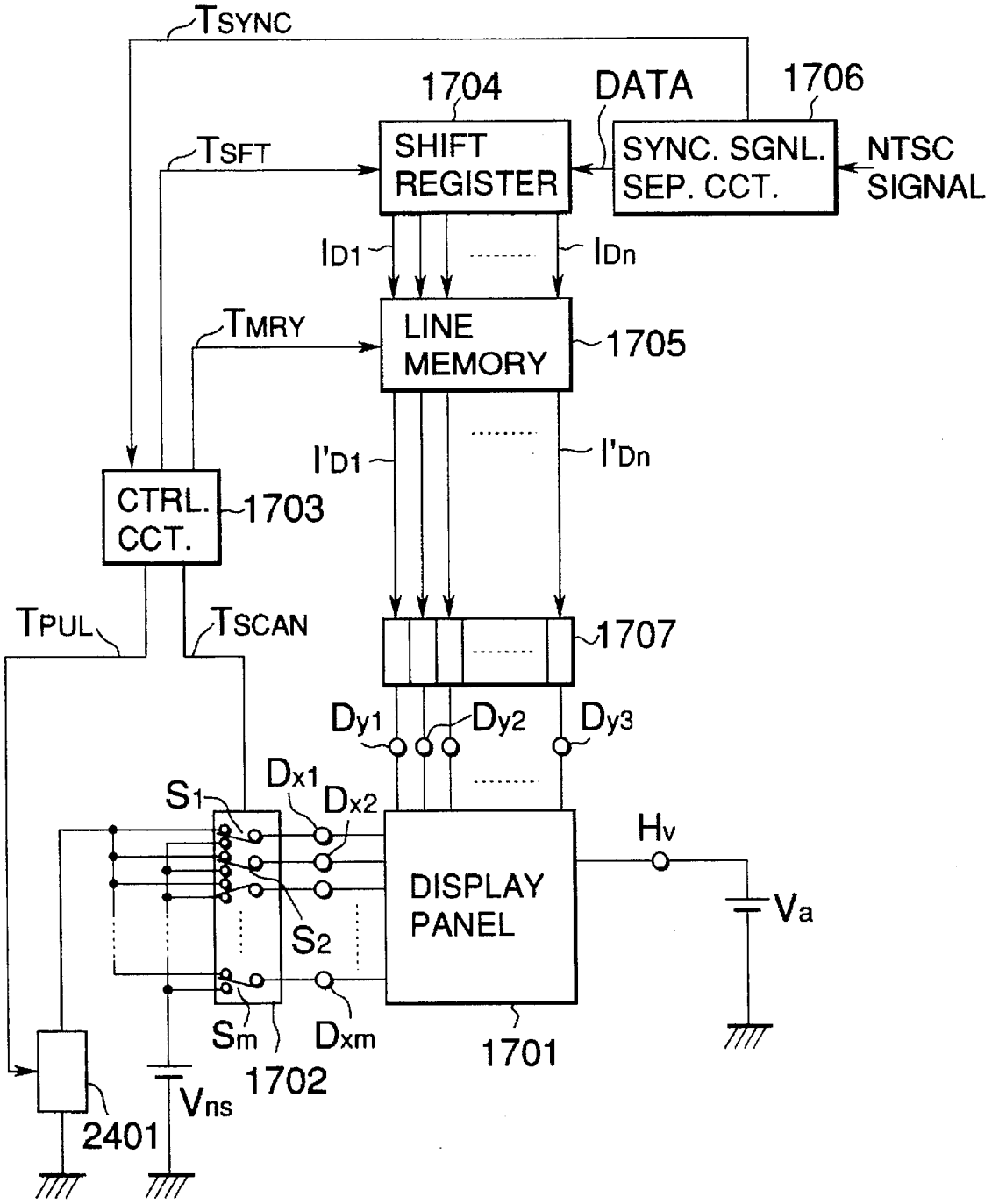
FIG. 32 is a schematic circuit diagram of a drive circuit for carrying out a third drive method for a fifth embodiment of the invention.

FIG. 32 is a block diagram of a drive circuit for the third drive method that can be used for a display apparatus according to the invention. Like the circuit of FIG. 17 for the first drive method, it comprises a display panel 1701, a scan circuit 1702, a control circuit 1703, a shift register 1704, a line memory 1705, a synchronizing signal separation circuit 1706, a modulation signal generator 1707 and a DC voltage soruce Va. Vns in the circuit denotes another DC voltage source and pulse voltage source 2401 is used to generate pulses as described hereinafter.

Since the components 1701, 1704, 1705, 1706 and Va are identical with their counterparts of the circuit of FIG. 25. They will not be described here any further.

The scan circuit 1702 is provided in the inside with a total of M switching devices S1 through Sm, each of which is designed to select either the output voltage of the pulse voltage source 2401 or that of the DC voltage source Vns and to be electrically connected with one of the terminals Dx1 through Dxm of the display panel 1701. These switching devices S1 through Sm operate according to control signal Tscan from the control circuit 1703 and can be easily formed by combining switching devices such as FETs.

While the control circuit 1703 coordinates the operations of related components as in the case of FIG. 25, it additionally takes the role of feeding the pulse voltage source 2401 with control signal Tpul.

The pulse voltage source 2401 generates a pulse voltage according to control signal Tpul from the control circuit 1703 and the timing of generating a pulse voltage and the waveform of such a pulse voltage will be described below by referring to FIGS. 33(1) through (5).

The modulation circuit 1707 generates signals for appropriately driving and modulating the operation of each of the surface-conduction electron-emitting devices according to image luminance data I'd1 through I'dn. The waveform of its output signals to be applied to the surface-conduction electron-emitting devices will be described below also by referring to FIGS. 33(1) through (5).

FIG. 33(1) illustrates the waveform of a pulse voltage generated by the pulse voltage source 2401. This pulse voltage source 2401 maintains its output voltage to 7 V while it does not generate any pulse voltage but comes to generate a pulse voltage under the control of control signal Tpul. The pulse is a rectangular pulse having a width of 30 μsec. that reduces the output voltage to 0 V as long as the pulse voltage is being generated.

FIG. 33(2) shows the output voltage of the DC voltage source Vns. As shown, the voltage source Vns is constantly producing a voltage of 7 V if it is operating. Note that a pulse width of a 0 V pulse voltage generated by the pulse voltage source 2401 is also shown.

FIG. 33(3) illustrate the waveform of a modulation signal that can be generated by the modulation signal generator 1707. The modulation signal generator 1707 maintains its output voltage to 7 V while it does not generate any modulation signal but comes to generate a modulation signal according to image luminance data I'd1 through I'dn in synchronism with the output pulse of 0 V of the pulse voltage source 2401. A modulation signal is formed by appropriately combining components a, b, c and d as indicated by dotted lines in FIG. 33(3) according to the luminance data of the incoming video signal.

The components a, b, c and d are pulses with respective voltages of 11 V, 12 V, 13 V and 14 V, each having a width of 5 μsec. Note that the pulse of FIG. 33(1) has a width exceeding that of a modulation signal by 5 μsec. at both the front and rear ends, these margins may be varied without problem so long as the modulation signal is located within the pulse voltage signal.

Now, the waveform of a drive signal fed to a surface-conduction electron-emitting device will be described, using the above described signal waveforms.

FIG. 33(4) shows the waveform of a drive voltage that can be applied to a surface-conduction electron-emitting device when the output of the pulse voltage source 2401 is selected by the scan circuit 1702. In other words, it is obtained by withdrawing the waveform of FIG. 33(1) from that of FIG. 33(3). In FIG. 33(4), components a', b', c' and d' shown by dotted lines correspond to respective components a, b, c and d of FIG. 33(3). If just a component a' is selected and applied to a surface-conduction electron-emitting device, that latter emits an electron beam that continues for 5 μsec. at a rate of 0.27 μA (momentary current). Similarly, if only a component b' is selected and applied, an electron beam is emitted at a rate of 0.37 μA. The value of momentary current of the electron beam emission is 0.49 μA for component c' and 0.66 μA for component d'. Since the intensity of an electron beam emitted by a surface-conduction electron-emitting device under consideration does not change linearly, it does not exhibit the same difference for the same voltage difference applied to the components. For instance, if components a' and b' are applied, the output of the device is not equal to that of the device when only component c' is applied thereto. This means that a total of sixteen different outputs can be obtained for an electron-emitting device by differently combining components a' through d' (including a combination where none of a' through d' are used) so that the luminance of the pixel connected to the device can be modulated in sixteen different ways.

FIG. 33(5) shows the waveform of a drive voltage of a surface-conduction electron-emitting device when the output of the DC current source Vns is selected by the scan circuit 1702, which is obtained by subtracting the waveform of a DC voltage shown in FIG. 33(2) from the modulation waveform of FIG. 33(3). In FIG. 33(5), components a', b', c' and d' respectively corresponds to components a, b, c and d in FIG. 33(3), although no electron beam emission takes place because none of them exceed the threshold voltage for electron emission (or 8 V in this embodiment).

Each of the surface-conduction electron-emitting devices of the embodiment is driven in a manner as described above. Since the overall operation of the embodiment of display apparatus is substantially same as that of the embodiment of FIG. 25, it will not be described here any further.

While a modulation voltage is constituted of four components a, b, c and d for the sake of convenience in the above description, the number of components is preferably more than four in actual applications. In general, because of the non-linear behavior of a surface-conduction electron-emitting device according to'the invention, a total of $2^n$ gradations can be achieved for a pixel for image display by using n components (or n different modulation voltages).

The number of n is preferably greater than seven for television images.

While each of the components a, b, c and d has an equal pulse width of 5 μsec. in the above description, they may not necessarily have a same and equal pulse width. Likewise, while the voltage of the components a, b, c and d increases with an equal increment of 1 V in the above description, they may alternatively show different increments of voltage.

Embodiment 6

Now, a sixth embodiment of the invention will be described by referring to FIGS. 34 and 35(1) through (5). This embodiment is so designed as to be driven also by the third drive method, with which the luminance of each pixel of the display panel of the embodiment is controlled by the intensity and the pulse width of the voltage applied thereto.

Figure 34:
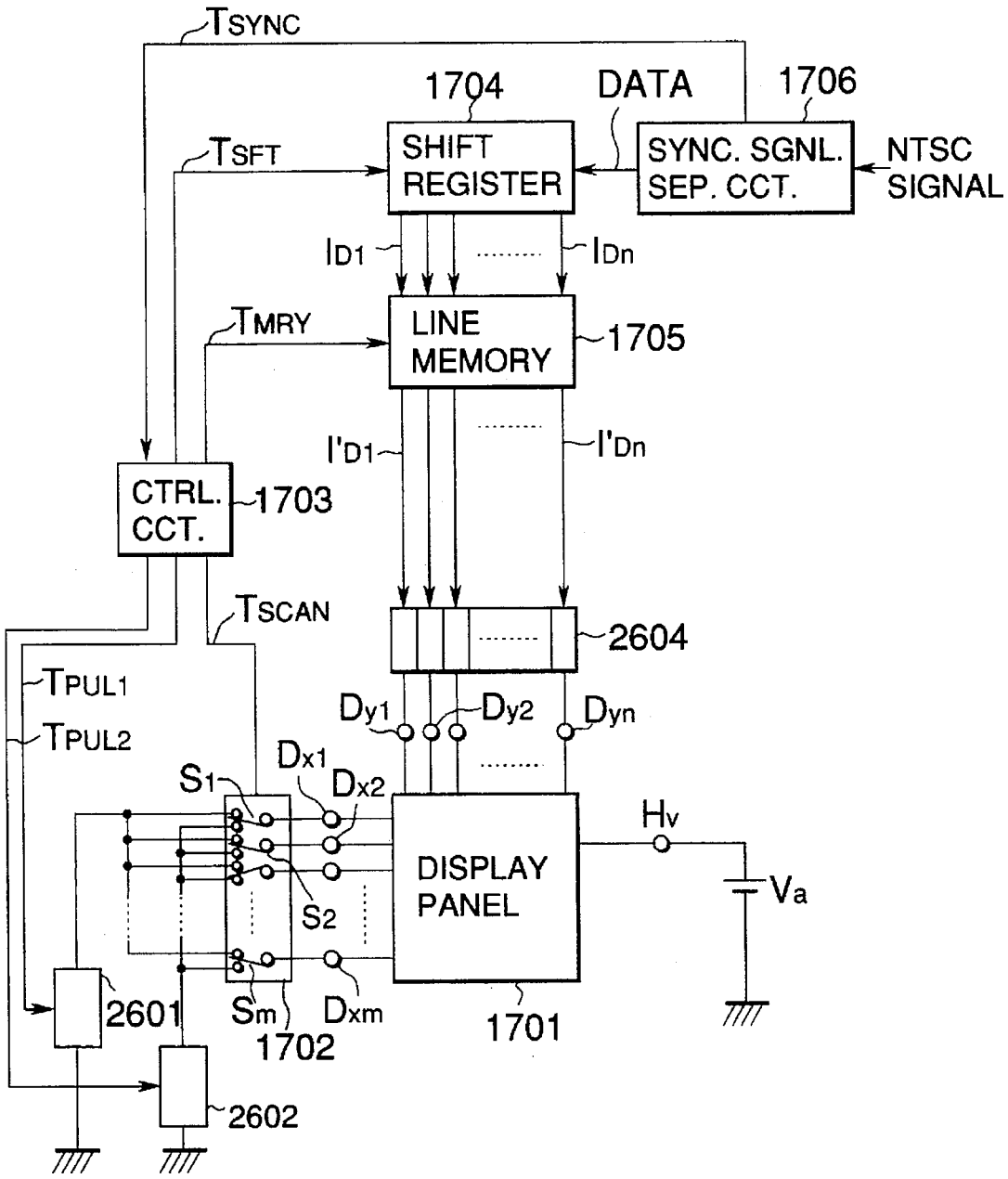
FIG. 34 is a schematic circuit diagram of a drive circuit for carrying out a fourth drive method for a sixth embodiment of the invention.

FIG. 34 is a schematic block diagram of a drive circuit that can used for the embodiment. Since it comprises many components that are identical with their counterparts of the fifth embodiment illustrated in FIG. 32, only those that are different will be discussed here. In FIG. 34, pulse voltage sources 2601 and 2602 operate respectively according to control signals Tpul1 and Tpul2 from control circuit 1703 and respectively send out pulse voltages with a waveform which is not rectangular and therefore different from that of the pulse voltage source of FIG. 32. Modulation signal generator 1707 of the circuit of FIG. 34 generates modulation signals according to incoming video signals I'd1 through I'dn with a waveform different from its counterpart of FIG. 32. These waveforms will be described by referring to FIGS. 35(1) through (5).

FIG. 35(1) shows the waveform of a pulse voltage generated by the pulse voltage source 2601 of this embodiment. This pulse voltage source 2601 maintains its output voltage to 7 V while it does not generate any pulse voltage but comes to generate a pulse voltage under the control of control signal Tpul1 as shown there. The pulse is a ramp pulse having a width of 30 μsec. and linearly decreases its height from 3 V to 0 V from the moment it starts.

FIG. 35(2) shows the waveform of a pulse voltage generated by the pulse voltage source 2602 of this embodiment. This pulse voltage source 2602 maintains its output voltage to 7 V while it does not generate any pulse voltage but comes to generate a pulse voltage under the control of control signal Tpul2 as shown there. The pulse is a ramp pulse having a width of 30 μsec. and linearly decreases its height from 7 V to 4 V from the moment it starts. Since the pulses of FIGS. 35(1) and (2) are synchronized with each other by the control signals Tpul1 and Tpul2, the pulses generated by the two sources always show a difference of 4 V.

FIG. 35(3) illustrates the waveform of a modulation signal that can be generated by the modulation signal generator 1707. The modulation signal generator 1707 maintains its output voltage to 7 V while it does not generate any modulation signal but comes to generate a modulation signal according to image luminance data I'd1 through I'dn in synchronism with the output pulses of the pulse voltage sources 2601 and 2602. A modulation signal is formed by appropriately combining components a, b, c and d as indicated by dotted lines in FIG. 35(3) according to the luminance data of the incoming video signal. Each of the components a, b, c and d is on its part a rectangular pulse having a voltage level of 14 V and a pulse width of 5 μsec. and these components are applied respectively 5, 10, 15 and 20 μsec. after the start of the pulses having a pulse width of 30 μsec. shown in FIGS. 35(1) and (2).

Now, the waveform of a drive signal fed to a surface-conduction electron-emitting device will be described, using the above described signal waveforms.

FIG. 35(4) shows the waveform of a drive voltage that can be applied to a surface-conduction electron-emitting device when the output of the pulse voltage source 2601 is selected by the scan circuit 1702. In other words, it is obtained by withdrawing the waveform of FIG. 35(1) from that of FIG. 33(3). In FIG. 35(4), components a', b', c' and d' shown by dotted lines correspond to respective components a, b, c and d of FIG. 35(3) and have a level exceeding the threshold voltage for electron emission (or 8 V for this embodiment). Therefore, once any of these are applied to an electron-emitting device, the latter start emitting an electron beam with an intensity that depends on the properties of the device. Since the intensity of an electron beam emitted by the surface-conduction electron-emitting device does not change linearly, it does not exhibit the same difference for all the components a', b', c' and d'. This means that a total of sixteen different outputs can be obtained for an electron-emitting device by differently combining components a' through d' so that the luminance of the pixel connected to the device can be modulated in sixteen gradations.

On the other hand, FIG. 33(5) shows the waveform of a drive voltage of a surface-conduction electron-emitting device when the output of the pulse voltage source 2601 is selected by the scan circuit 1702. Since it does not reach the threshold voltage for the electron-emitting device as shown in FIG. 33(5), the device would emit practically no electron beam.

While a modulation voltage is constituted of four components a, b, c and d for the sake of convenience in the above description, the number of components is preferably more than four in actual applications as in the case of FIG. 33(3). In general because of the non-linear behavior of a surface-conduction electron-emitting device according to the invention, a total of $2^n$ gradations can be achieved for a pixel for image display by using n components. The number of n is preferably greater than seven for television images.

Again, the waveform a signal generated by each of the pulse voltage sources 2601 and 2602 is a ramp waveform that linearly decreases with time. A ramp waveform that increases with time or a waveform that non-linearly fluctuates may alternatively be used.

While each of the components a, b, c and d of a signal generated by the modulation signal generator 1707 has an equal pulse width of 5 μsec. in the above description, they may not necessarily have a same and equal pulse width. For instance, components a, b, c and d may have voltage levels and pulse widths that are different from one another and these components may start irregularly.

Surface-conduction electron-emitting devices of the type described before beginning the description of the embodiments are used for the display panel of each of the above described embodiments that are used by one of the above described first, second and third drive methods. While devices of the above identified type may vary their characteristics (e.g., threshold voltage Vth, the device voltage-emission current relationship, etc.) depending on the materials and manufacturing method employed, such variances are accommodated within the concept of the present invention by appropriately modifying the pulse voltage waveform to be used for scanning and modulation. Additionally, the drive methods developed for the purpose of the present invention may be applied to conventional surface-conduction electron-emitting devices.

While the embodiments are described above in terms of NTSC television signals, a display apparatus according to the invention may well be used with other signals systems, including other television signals systems and those for computers, image memories and telecommunication networks, where signal sources are directly or indirectly connected with display apparatuses. These methods are particularly suitable for large displays capable of displaying a large quantity of image data.

A surface-conduction electron-emitting device and an image-forming apparatus comprising a number of such devices may be used not only for applications where they are exposed to the sight of users but also for those where they are used as or for light sources for recording data like light sources for optical printers.

Additionally, the drive methods of the present invention may well be used for driving electron beam sources of electron beam design apparatuses using electron beams for designing various images.

Embodiment 7

Figure 36:
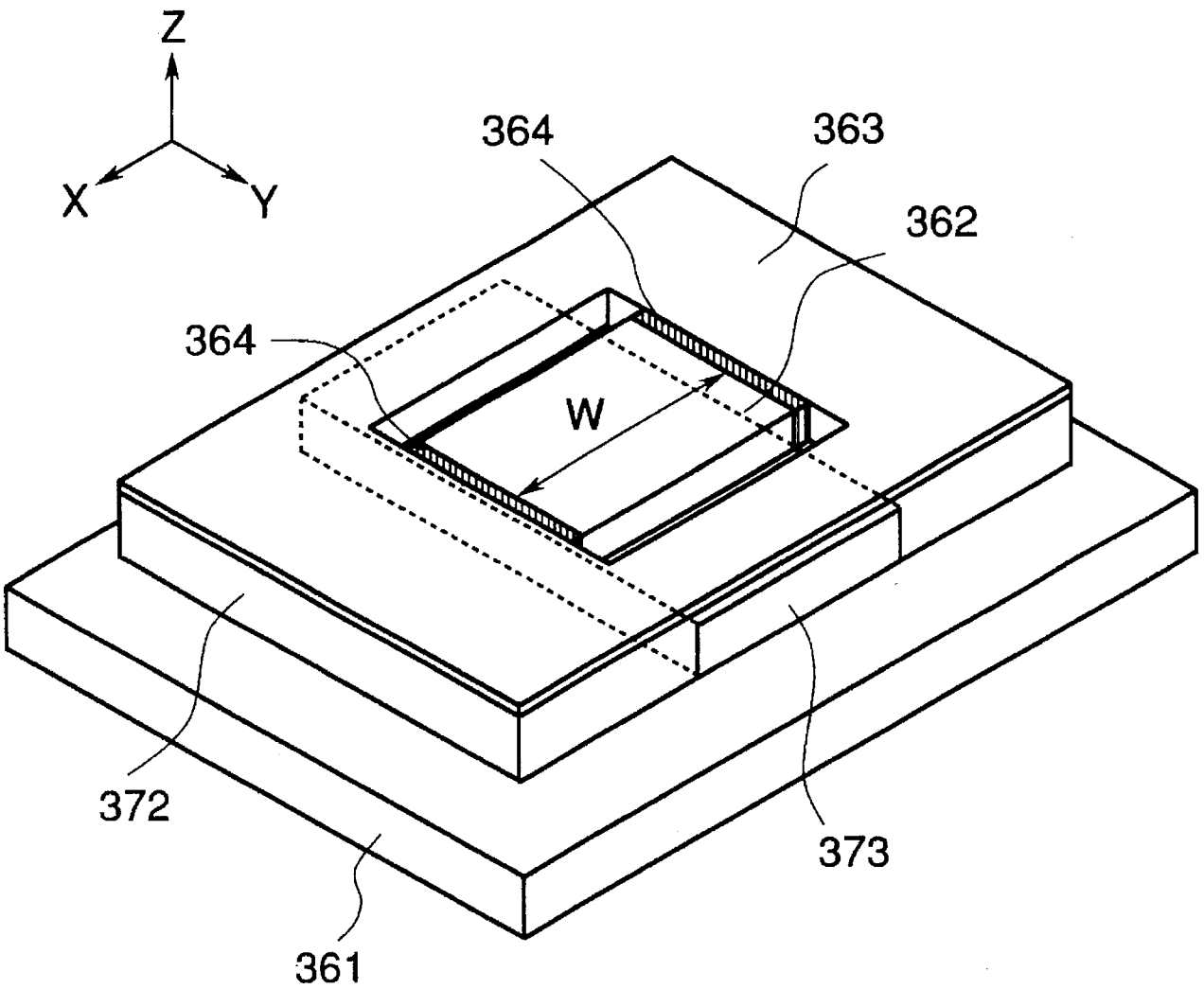
FIG. 36 is a schematic perspective view of an electron-emitting device used for a seventh embodiment of the invention.

This embodiment is directed to an electron source or an image forming device of the type that plural electron emitting elements of surface conduction type (i.e. surface-conduction electron-emitting devices), each including a plurality of electron emitting portions, are arrayed in a matrix pattern, wherein electron beams from the plural electron emitting portions are superposed to form a high-quality image on an image forming member. The electron emitting elements of this embodiment are constructed as shown in FIG. 36 which illustrates one element extracted from the plural electron emitting elements arrayed in a matrix pattern. The image forming device is fabricated in a like manner to the other embodiments.

Note that a face plate arranged in opposite relation to a base plate provided with the electron emitting elements is of the same as that in the other embodiments.

In this embodiment, after sufficiently washing an insulating base plate 361, an element wired electrode 373 for an element electrode 362 on the higher potential side was formed on the base plate by evaporation and etching to be 1 μm thick and 600 μm wide using material containing Ni as a main ingredient. Then, $SiO_2$ was evaporated in thickness of 2 μm all over the base plate surface to form an insulating layer 372.

After that, a 100 μm-square contact hole was opened in $SiO_2$ over the element wired electrode 373 by etching. Material such as Ni was first evaporated in the opening only for connection to the element wired electrode 373 therethrough, and Ni material was then evaporated in thickness of 0.1 μm all over the surface.

Subsequently, the Ni electrode was formed into a desired pattern by photolithography and etching so as to form a higher-potential element electrode 362 which is connected to the element wired electrode 373 and a lower-potential element electrode 363 which lies perpendicularly to the element wired electrode 373 with electrode gaps left on both sides of the higher-potential element electrode 362 in the direction of width (i.e., in the X-direction as shown).

Fine particle films are formed in the gaps between the element electrodes 362 and 363 to serve as electron emitting regions 364. By applying a desired voltage to the electron emitting regions 364, electrons can be emitted similarly to the other embodiments.

With this embodiment thus constructed, by setting an X-direction width (W) of the higher-potential element electrode 362 between the two electron emitting portions 364 to 400 μm, applying +14 V and 0 V respectively to the higher-potential element electrode 362 and the lower-potential element electrode 363 for emission of electrons, and applying 6 kV to a fluorescent material on the face plate positioned above the electrodes through a distance of 2.5 mm, a substantially circular bright spot was produced with good symmetry. A diameter of the bright spot was about 500 μmϕ in this embodiment.

An electron beam from an electron emitting element of surface conduction type including one electron emitting portion produces a bright point being poor in symmetry on the surface of an image forming member, i.e., the surface of fluorescent material in this case. In contrast, with such an arrangement that a plurality of electron emitting portions are formed on both sides of higher-potential one of element electrodes with a spacing W, expressed by the following formula, therebetween in the direction of voltage application, electron beams emitted from the plural electron emitting portions are superposed into one beam on the surface of an image forming member, i.e., the surface of fluorescent material in this case, to thereby produce a bright point with good symmetry in shape, as proved by this embodiment.

$$K2*2H(Vf/Va)^{1/2} \geqq W/2 \geqq K3*2H(Vf/Va)^{1/2}$$

where K2, K3; constants K2=1.25±0.05, K3=0.35±0.05

Vf; voltage applied to element

Va; voltage applied to image forming member (accelerating voltage)

H; distance between electron emitting element of surface conduction type and image forming member W; distance between electron emitting regions

Embodiment 8

Figure 37:
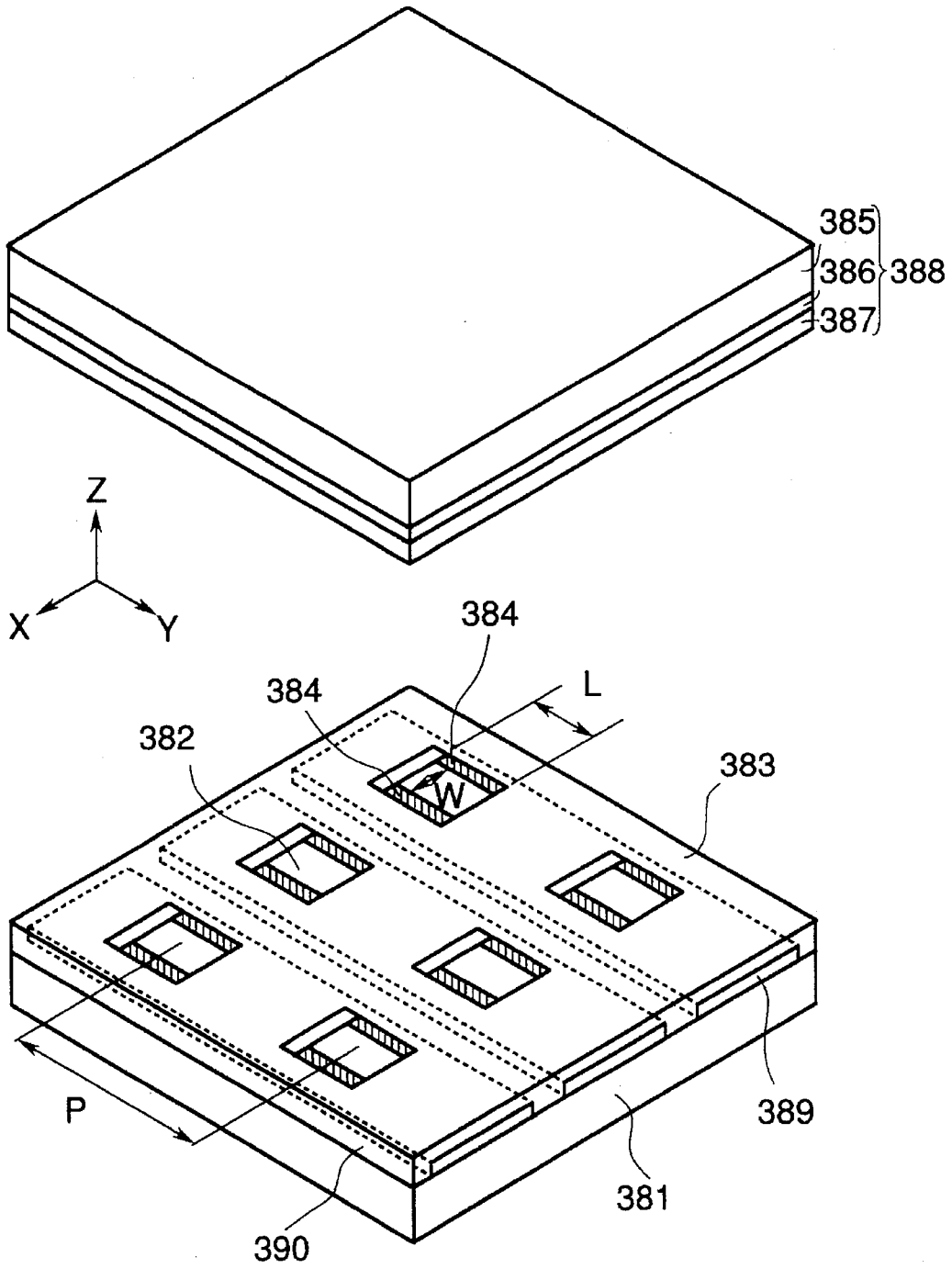
FIG. 37 is an exploded perspective view of an eighth embodiment of the invention, which is an image-forming apparatus.
Figure 38:
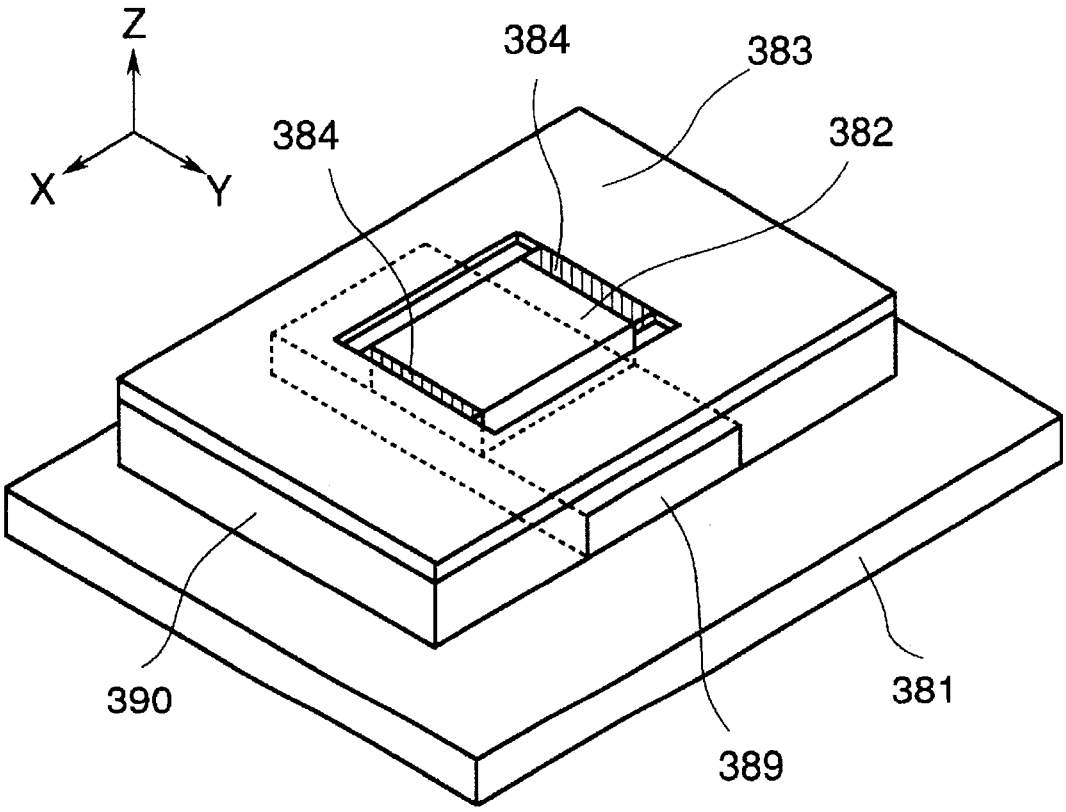
FIG. 38 is a schematic perspective view of an electron-emitting device used for the eighth embodiment of FIG. 37.
Figure 39:
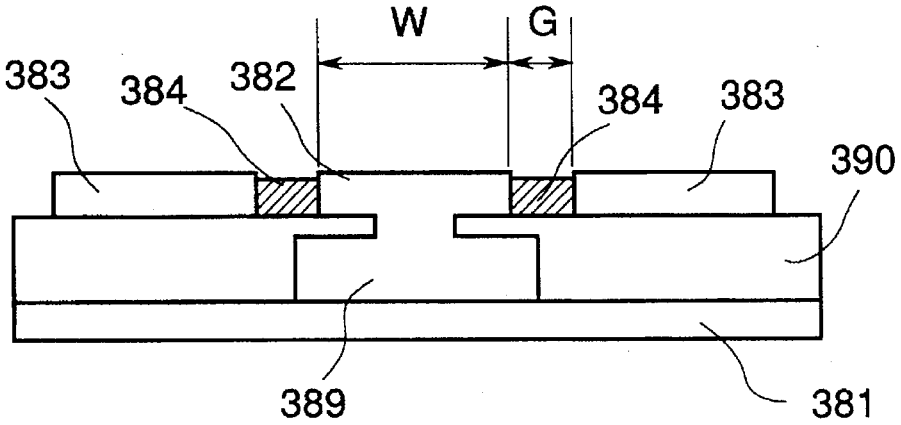
FIG. 39 is a schematic sectional view of the electron-emitting device of FIG. 38.

This embodiment is concerned with an arrangement of plural electron emitting element of surface conduction type arrayed in a matrix pattern. FIG. 37 shows a schematic view of a image forming device according to this embodiment, FIG. 38 shows an enlarged perspective view of one electron emitting element according to this embodiment, and FIG. 39 shows a sectional view taken along an X-axis of the element.

In this embodiment, electron emitting elements were fabricated on an insulating base plate 381 as follows.

A method of fabricating a image display of this embodiment will first be described.

(1) After washing the insulating base plate 381, element wired electrodes 389 were formed on the base plate 381 in thickness of 1 μm by evaporation and etching using material containing Ni as a main ingredient.

(2) Then, an insulating layer 390 of $SiO_2$ was formed in thickness of 2 μm all over the surface of the base plate 381.

(3) Then, a contact hole was bored in a desired position of $SiO_2$ by etching and, thereafter, element electrodes 382 and 383 were formed in thickness of 1000 Å by evaporation and photolithography. Material of the electrodes contains Ni as a main ingredient.

(4) As a result of the above step, the element electrode 382 was electrically connected to the element wired electrode 389, and both the element electrodes 382 and 383 were positioned in opposite relation with narrow gaps of 2 μm left therebetween. The process subsequent to a step of forming Pd fine particle films in the gaps to serve as electron emitting regions 364 is the same as that in the other embodiments and hence are omitted here.

In this embodiment, the element electrodes 382 electrically connected in the Y-direction and the element electrodes 383 electrically connected in the X-direction constitute an XY-matrix with the electron emitting regions formed in the gaps between both the electrodes. As a result, the plural electron emitting elements are formed in a matrix pattern.

As shown in FIG. 38, each electron emitting element includes the electron emitting region 384 on both sides of the higher-potential element electrode 382 in the direction of voltage application (i.e., in the X-direction). In this embodiment, a width (W) of the higher-potential element electrode (i.e., device electrode) in the X-direction was set to 800 μm and a gap width (G) between the element electrodes 382, 383 was set to 2 μm.

Further, a length (L) of the electron emitting region in the Y-direction was set to 140 μm and an array pitch (P) of the electron emitting elements in the Y-direction was set to 750 μm.

Additionally, an array pitch of the electron emitting elements in the X-direction was set to 1 mm in this embodiment.

Above the insulating base plate 381 on which the electron emitting elements were fabricated as explained above, similarly to the other embodiments, a face plate 388 including a transparent electrode 386 and a fluorescent substance layer (image forming member) 387 both coated on its inner surface was positioned via a support frame (not shown) with a distance d=4.5 mm therebetween. The base plate, the support frame and the face plate were bonded together by applying frit glass to joined portions between those members and baking the glass at 430° C. for 10 minutes or more.

In the image display thus constructed, an accelerating voltage Va of 5000 V Was applied to the fluorescent material layer 387 through the transparent electrode 386 and a voltage Vf of 14 V was applied between the element electrodes 382, 383 through the element wired electrode 389.

Specifications of this embodiment were as follows: accelerating voltage Va=5000 V, element voltage Vf=14 V, element/face plate distance d=4.5 mm, Y-direction length L of electron emitting region in element=140 μm, Y-direction array pitch P of electron emitting elements=750 μm, and width of higher-potential electrode=800 μm. It was observed as with above Embodiment 7 that electron beams emitted from the two electron emitting regions substantially coincided in axes of their luminous spots with each other on the image forming member, and two bright spots were superposed in precisely symmetrical relation to produce one almost circular luminous spot as a whole. This successful result is inferred to come from agreement of the conditions in this embodiment with the formula shown in above Embodiment 7.

Further, as a result of intensive studies made by the inventors, it was found that superposition of the two luminous spots in the Y-direction can be controlled by specifying an arrangement of those bright spots in view of the relationship among variables expressed by the following formulae.

In case where bright points are continuously superposed with each other in the Y-direction:

$$P<L+2K5*2H(Vf/Va)^{1/2}$$

where K5 is a constant K5=0.80 Va is accelerating voltage, Vf is element voltage, H is distance between element and face plate, L is a Y-direction length of electron emitting region in element, P is a Y-direction array pitch of electron emitting elements, and W is a width of higher-potential electrode.

In case where bright points are not superposed and discontinuous in the Y-direction:

$$P\geqq L+2K6*2d(Vf/Va)^{1/2}$$

where K6 is a constant K6=0.90.

Thus, it was found that the electron emitting elements are required to be arrayed in the Y-direction in view of the conditions of the above formulae. This embodiment satisfies the range defined by the latter formula corresponding to the case where bright points are not superposed and discontinuous in the Y-direction; hence the two luminous spots were observed as independent spots.

According to the image display of this embodiment, as described above, a luminous spot is produced in an optimum shape, and a highly discernible and sharper display image is obtained with a high degree of luminance and fineness.

Embodiment 9

Figure 40:
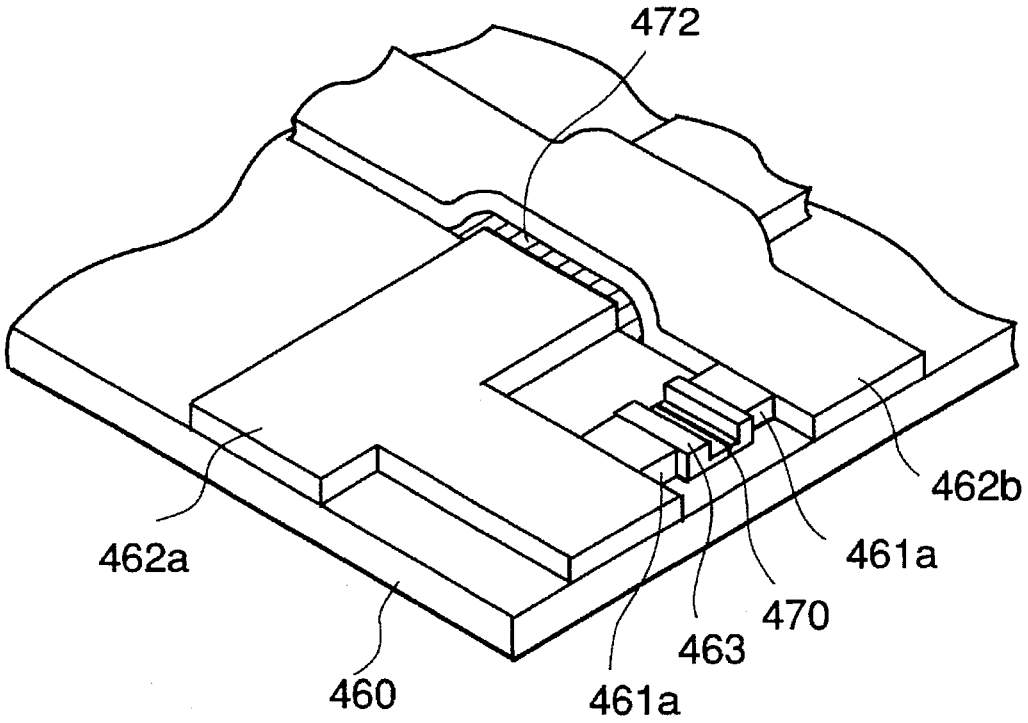
FIG. 40 is a schematic perspective view of an electron-emitting device used for a ninth embodiment of the invention.

This embodiment is concerned with an image forming device that plural electron emitting elements of surface conduction type, which can be driven in a divided manner, are arrayed in a matrix pattern, and a method of driving the device. A description of this embodiment will be given below with reference to FIGS. 40 and 41. FIG. 40 is a perspective view of a part extracted from an electron source in which electron emitting elements of surface conduction type are arrayed in a matrix pattern, and FIG. 41 is a circuit diagram showing a driving method of this embodiment.

In the element of this embodiment, element electrodes 461*a*, 461*b* and wired electrodes 462*a*, 462*b* are respectively connected to each other, as shown in FIG. 40. Reference numeral 462*a* denotes a wired electrode in the X-direction and 462*b* denotes a wired electrode in the Y-direction. The electron source of this embodiment is constructed similarly to above Embodiment 4 such that electron emitting elements of surface conduction type corresponding to red (R), green (G) and blue (B) are arrayed as shown in FIG. 41. Though not shown, an enclosure is also fabricated similarly.

The method of driving the device according to this embodiment will now be described with reference to FIG. 41.

Figure 41:
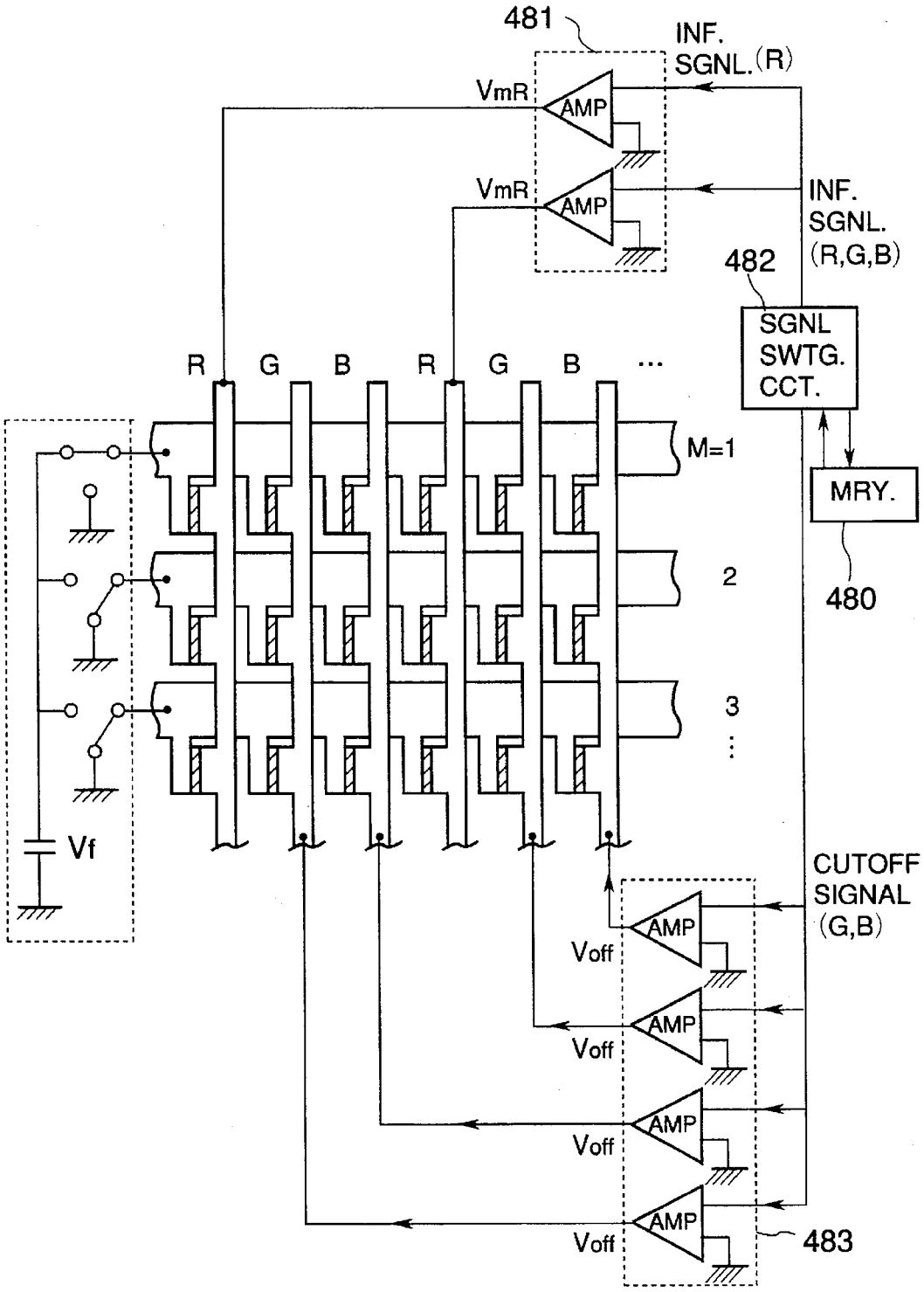
FIG. 41 is a schematic circuit diagram of a drive circuit for carrying out a drive method for the ninth embodiment of FIG. 40.

Let it be assumed that the matrix is scanned successively on a row-by-row basis from M=1 in FIG. 41.

(1) Voltage applying means (not shown) is turned on to apply a constant voltage to the transparent electrode for thereby applying an electron emission voltage Vf to the row M=1.

(2) Of information signals for one scanned row (M=1), information signals to be input to signal wired electrodes G for green and signal wired electrodes B for blue are once stored in a memory 480. Information signals to be input to signal wired electrodes R for red are directly applied, as a modulation voltage (VmR) taking any one of an ON voltage, a cutoff voltage and a gradation voltage depending on each information signal, to the signal wired electrodes R through a voltage applying means 481. During a period of that application, cutoff signals are issued from a signal switching circuit 482 for the signal wired electrodes G, B regardless of states of the information signals, whereby a cutoff voltage (Voff) is applied to each of the signal wired electrodes G, B through a voltage applying means 483.

(3) The signal switching circuit 482 is then changed over such that, of the information signals for one scanned row (M=1), the information signals for green in the information signals previously stored in the memory 48 are input to the signal wired electrodes G. Thus, a modulation voltage (VmG) taking any one of an ON voltage, a cutoff voltage and a gradation voltage depending on each information signal is applied to the corresponding signal wired electrode G through the voltage applying means 483. During a period of that application, cutoff signals are issued from the signal switching circuit 482 for the signal wired electrodes R, B regardless of states of the information signals, whereby a cutoff voltage (Voff) is applied to each of the signal wired electrodes R, B through the voltage applying means.

(4) The signal switching circuit 482 is then changed over such that, of the information signals for one scanned row (M=1), the information signals for blue in the information signals previously stored in the memory 48 are input to the signal wired electrodes B. Thus, a modulation voltage (VmB) taking any one of an ON voltage, a cutoff voltage and a gradation voltage depending on each information signals is applied to the corresponding signal wired electrode B through the voltage applying means 483. During a period of that application, cutoff signals are issued from the signal switching circuit 482 for the signal wired electrodes R, G regardless of states of the information signals, whereby a cutoff voltage (Voff) is applied to each of the signal wired electrodes R, B through the voltage applying means.

The above operation of applying the information signals for one scanned row to the respective signal wired electrodes while dividing the information signals into threes in timed relation for each color, i.e., at every two rows, is carried out within a display time allocated for one scanned row.

By repeating the above operations (1) to (4) successively so as to scan the rows one by one, one or more full-color images for one or multiple pictures are displayed on the surface of the fluorescent material layer.

According to the driving method of this embodiment, plural bright spots forming a display image on the surface of a fluorescent material layer partitioned for respective colors are produced in extremely uniform and stable size and shape without causing crosstalk. As a result, a full-color image having higher color purity and improved color reproduction is displayed.

Embodiment 10

Figure 42:
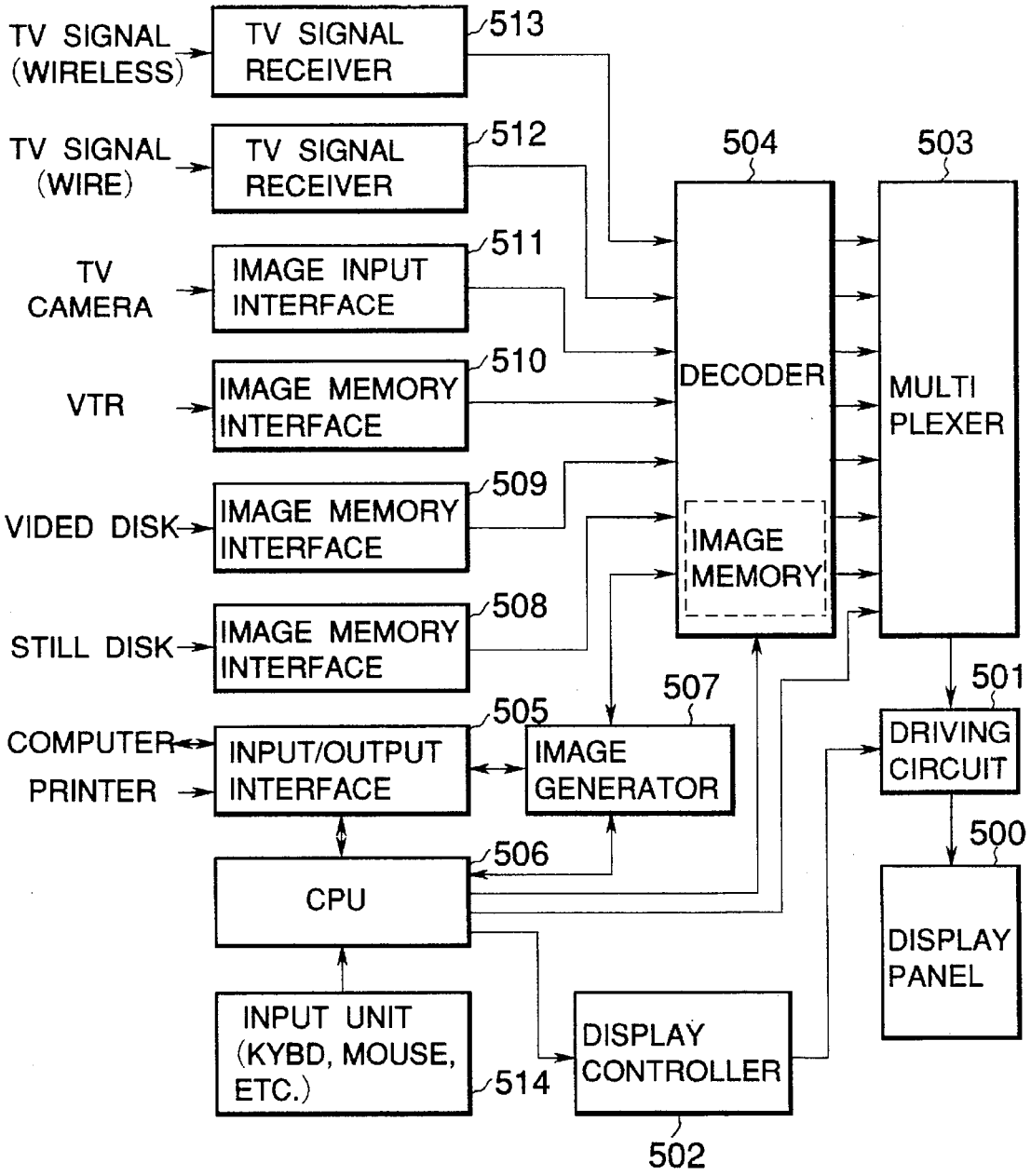
FIG. 42 is a schematic block diagram of a tenth embodiment of the invention, which is a display apparatus.
Figure 43:
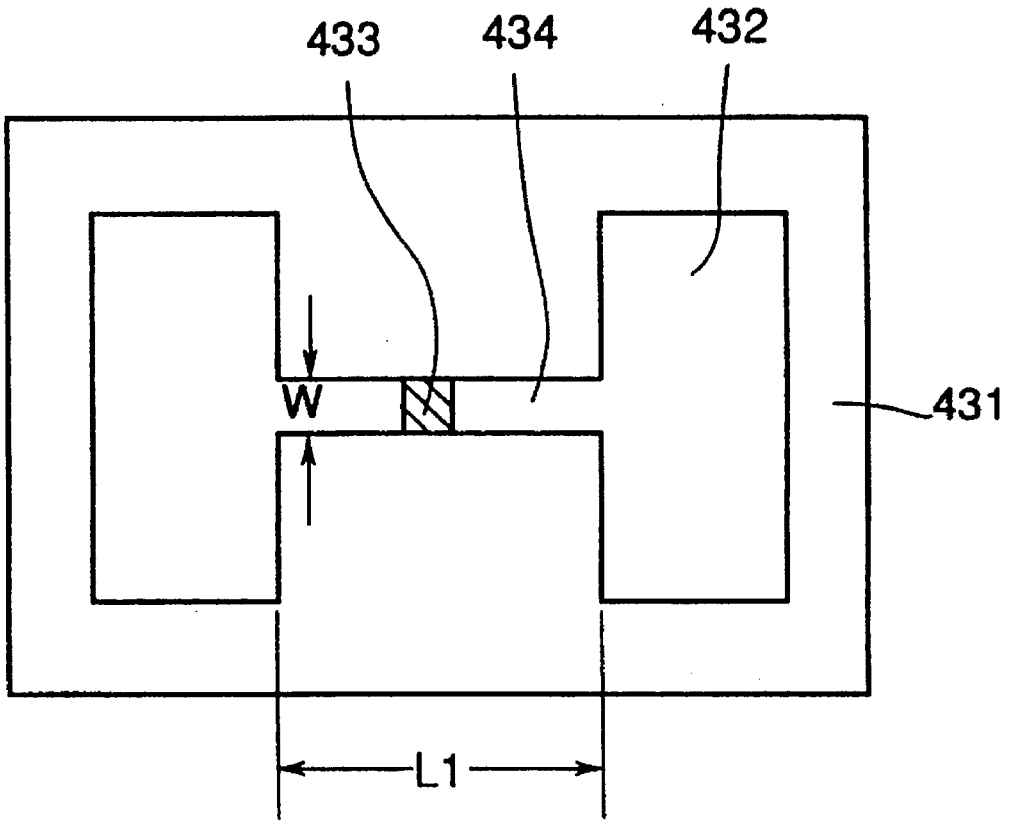
FIG.43 CONVENTIONAL ART
FIG. 43 is a schematic plan view of a known electron-emitting device.
Figure 44:
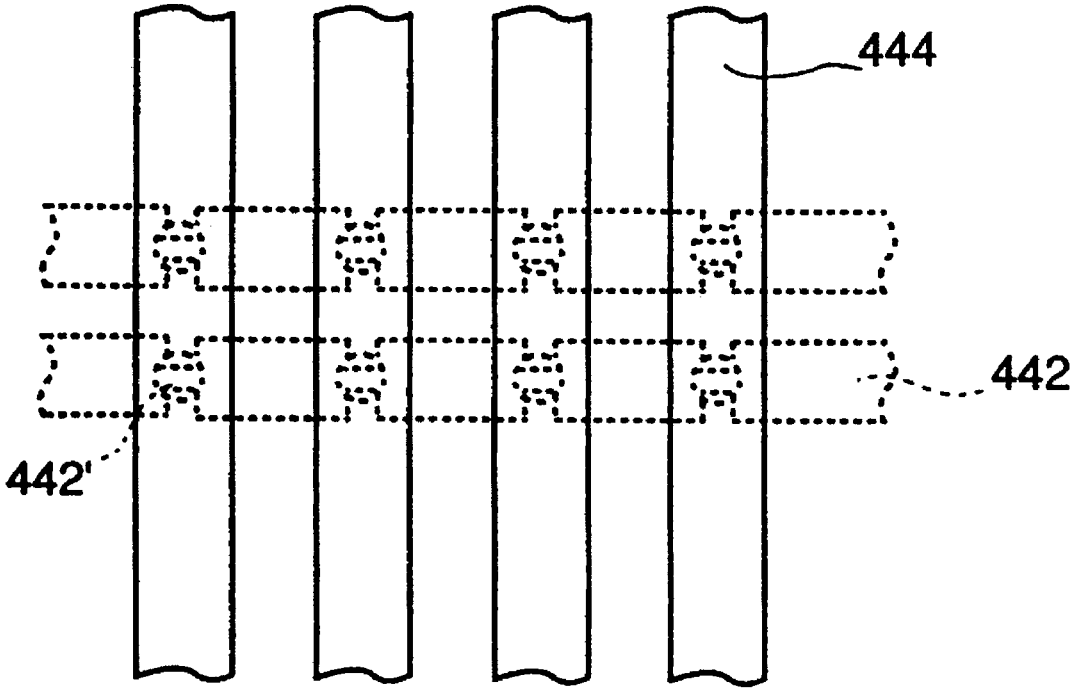
FIG.44 CONVENTIONAL ART
FIGS. 44 and 45 are schematic plan views of a known image-forming apparatus.
Figure 45:
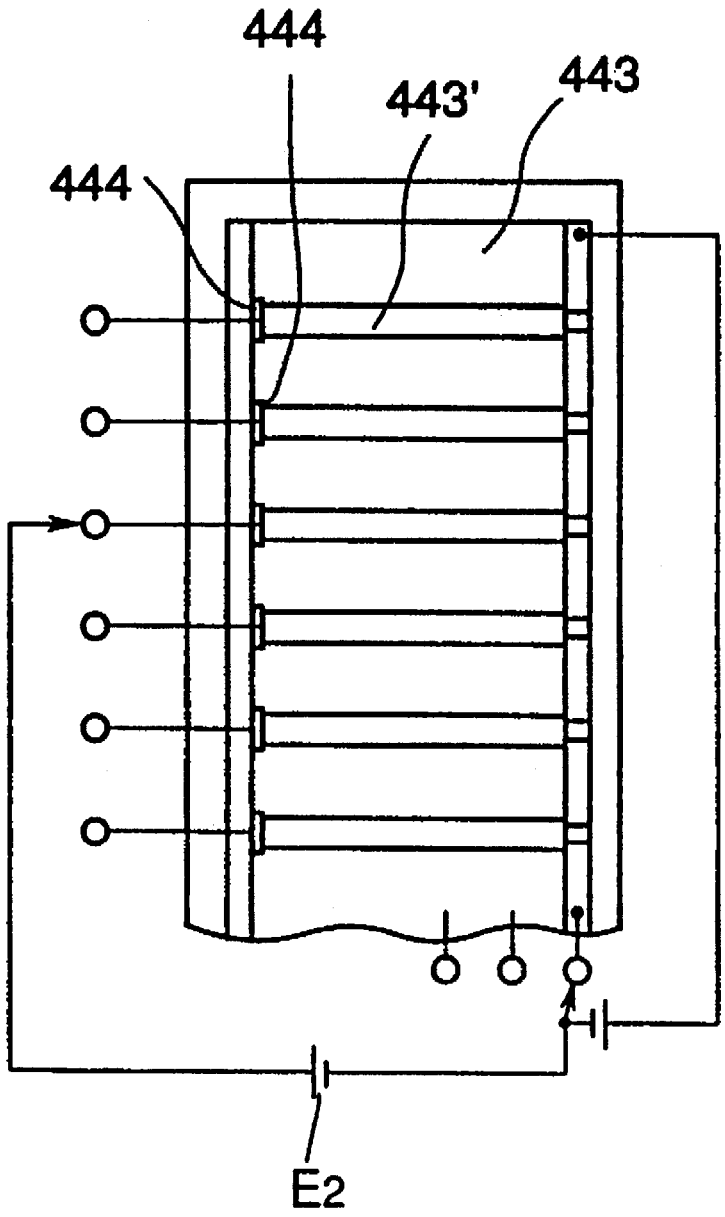
FIG.45 CONVENTIONAL ART

FIG. 42 is a block diagram showing one example of a display in which a display panel using the above-mentioned electron emitting elements of surface conduction type as an electron source is arranged to be able to display image information provided from various image information sources including TV broadcasting, for example. In FIG. 42, denoted by 500 is a display panel, 501 is a driver for the display panel, 502 is a display controller, 503 is a multiplexer, 504 is a decoder, 505 is an input/output interface, 506 is a CPU, 507 is an image generator, 508, 509 and 510 are image memory interfaces, 511 is an image input interface, 512 and 513 are TV signal receivers, and 514 is an input unit. (When the present display receives a signal such as a TV signal, for example, including both video information and voice information, it of course displays an image and reproduces voices simultaneously. But circuits, a loudspeaker and so on necessary for reception, separation, reproduction, processing, storage, etc. of the voice information, which are not directly related to the features of the present invention will not described here.)

Functions of the above components will be described below along a flow of image signals.

First, the TV signal receiver 513 is a circuit for receiving a TV image signal transmitted through a wireless transmission system in the form of electric waves or spatial optical communication, for example. A type of the TV signal to be received is not limited to particular one, but may be any of the NTSC, PAL and SECAM types, for example. Another type TV signal (e.g., so-called high-quality TV signal including the MUSE type) having the larger number of scan lines than the above types is a signal source fit to utilize an advantage of the display panel suitable for an increase in the screen size or the number of pixels. The TV signal received by the TV signal receiving circuit 513 is output to the decoder 504.

Then, the TV signal receiver 512 is a circuit for receiving a TV image signal transmitted through a wire transmission system in the form of coaxial cables or optical fibers. As with the TV signal receiver 513, a type of the TV signal to be received by the TV signal receiver 512 is not limited to particular one. The TV signal received by the receiver 512 is also output to the decoder 504.

The image input interface 511 is a circuit for taking in an image signal supplied from an image input unit such as a TV camera or an image reading scanner, for example. The taken-in image signal is output to the decoder 504.

The image memory interface 510 is a circuit for taking in an image signal stored in a video tape recorder (hereinafter abbreviated to a VTR). The taken-in image signal is output to the decoder 504.

The image memory interface 509 is a circuit for taking in an image signal stored in a video disk. The taken-in image signal is output to the decoder 504.

The image memory interface 508 is a circuit for taking in an image signal from a device storing still picture data, such as a so-called picture disk. The taken-in image signal is output to the decoder 504.

The input/output interface 505 is a circuit for connecting the display to an external computer or computer network, or an output device such as a printer. It is possible to perform not only input/output of image data and character/figure information, but also input/output of a control signal and numeral data between the CPU 506 in the display and the outside depending on cases.

The image generator 507 is a circuit for generating display image data in accordance with image data and character/figure information input from the outside via the input/output interface 505, or image data and character/figure information output from the CPU 506. Incorporated in the image generator 507 are, for example, a rewritable memory for storing image data and character/figure information, a read only memory for storing image patterns corresponding to character codes, a processor for image processing, and other circuits required for image generation.

The display image data generated by the image generator 507 is usually output to the decoder 504, but may also be output to an external computer network or a printer via the input/output interface 505 depending on cases.

The CPU 506 primarily carries out operation control of the display and tasks relating to generation, selection and editing of a display image. For example, the CPU 506 outputs a control signal to the multiplexer 503 for appropriately selecting one of or combining ones of image signals to be displayed on the display panel. In this connection, the CPU 506 also outputs a control signal to the display panel controller 502 depending on the image signal to be displayed, thereby appropriately controlling the operation of the display in terms of picture display frequency, scan mode (e.g., interlace or non-interlace), the number of scan lines per picture, etc.

Further, the CPU 506 directly outputs image data and character/figure information to the image generator 507, or accesses to an external computer or memory via the input/output interface 505 for inputting image data and character/figure information. It is a matter of course that the CPU 506 may be used in relation to any suitable tasks for other purposes than the above. For example, the CPU 506 may directly be related to functions of producing or processing information as with a personal computer or a word processor, or it may be connected to an external computer network via the input/output interface 505, as mentioned above, to execute numerical computations and other tasks in cooperation with external equipment.

The input unit 514 is employed when a user enters commands, programs, data, etc. to the CPU 506, and may be any of various input equipment such as a keyboard, mouse, joy stick, bar code reader, and voice recognition device.

The decoder 504 is a circuit for reverse-converting various image signals input from 507 to 513 into signals for three primary colors, or a luminance signal, an I signal and a Q signal. As indicated by dot lines in the drawing, the decoder 504 preferably includes an image memory therein.

This is because the decoder 504 also handles those TV signals including the MUSE type, for example, which require an image memory for the reverse-conversion. Further, the provision of the image memory gives rise to an advantage of making it possible to easily display a still picture, or to easily perform image processing and editing, such as thinning-out, interpolation, enlargement, reduction and synthesis of image(s), in cooperation with the image generator 507 and the CPU 506.

The multiplexer 503 appropriately selects a display image in accordance with the control signal input from the CPU 506. In other words, the multiplexer 503 selects desired one of the reverse-converted image signals input from the decoder 504 and outputs it to the driver 501. In this connection, by switchingly selecting two or more of the image signals in a display time for one picture, different images can also be displayed in plural areas defined by dividing one screen like the so-called multiscreen television.

The display panel controller 502 is a circuit for controlling the operation of the driver 501 in accordance with a control signal input from the CPU 506. As a function relating to the basic operation of the display panel, the controller 502 outputs to the driver 501 a signal for controlling, by way of example, the operation sequence of a driving power supply (not shown) for the display panel. As a function relating to a method Of driving the display panel, the controller 502 outputs to the driver 501 signals for controlling, by way of example, a picture display frequency and a scan mode (e.g., interlace or non-interlace).

Depending on cases, the controller 502 may output to the driver 501 control signals for adjustment of image quality in terms of luminance, contrast, tone and sharpness of the display image.

The driver 501 is a circuit for producing a drive signal applied to the display panel 500. The driver 501 is operated in accordance with the image signal input from the multiplexer 503 and the control signal input from the display panel controller 502.

With the various components arranged as shown in FIG. 42 and having the functions as described above, the display can display image information input from a variety of image information sources on the display panel 500. More specifically, various image signals including the TV signal are reverse-converted by the decoder 504, and at least one of them is selected by the multiplexer 503 upon demand then input to the driver 501. On the other hand, the display controller 502 issues a control signal for controlling the operation of the driver 501 in accordance with the image signal to be displayed. The driver 501 applies a drive signal to the display panel 500 in accordance with both the image signal and the control signal. An image is thereby displayed on the display panel 500. A series of operations mentioned above are controlled under supervision of the CPU 506.

In addition to displaying the image signal selected from the image memory built in the decoder 504, the image generator 507 and other information, the present display can also perform, on the image information to be displayed, not only image processing such as enlargement, reduction, rotation, movement, edge emphasis, thinning-out, interpolation, color conversion, and conversion of image aspect ratio, but also image editing such as synthesis, erasure, connection, replacement, and inset. Although not especially specified in the description of this embodiment, there may also be provided a circuit dedicated for processing and editing of voice information, as well as the above-explained circuits for image processing and editing.

Accordingly, even a single unit of the present display can have functions of a display for TV broadcasting, a terminal for TV conferences, an image editor handling still and motion pictures, a computer terminal, an office automation terminal including a word processor, a game machine and so on; hence it can be applied to very wide industrial and domestic fields.

It is needless to say that FIG. 42 only shows one example of the configuration of a display using a display panel in which electron emitting elements of surface conduction type are used as electron beam sources, and the present invention is not limited to the illustrated example. For example, those circuits of the components shown in FIG. 42 which are not necessary for the purpose of use may be dispensed with. On the contrary, depending on the purpose of use, other components may be added. When the present display is employed as a TV telephone, it is preferable to provide, as additional components, a TV camera, an audio microphone, an illuminator, and a transmission/reception circuit including a modem.

In the present display, particularly, the display panel using electron emitting elements of surface conduction type as electron beam sources can easily be reduced in thickness and, therefore, a depth of the display can be made smaller. Additionally, since the display panel using electron emitting elements of surface conduction type as electron beam sources can easily increase a screen size and also can provide high luminance and a superior characteristic of viewing angle, the present display can display a more realistic and impressive image with good viewability.

Effect of the Invention

As described above, by utilizing the following three features in basic characteristics of the electron emitting element of surface conduction type according to the present invention:

first, the element produces the emission current Ie which is abruptly increases when an element voltage higher than a certain voltage (called a threshold voltage, Vth in FIG. 6), but which is little detected at a voltage lower than the threshold voltage Vth; namely, it is a non-linear element having the definite threshold voltage Vth with respect to the emission current Ie, second, the emission current Ie depends on the element voltage Vf and, therefore, it can be controlled with the element voltage Vf, and third, emitted charges trapped by the anode electrode 34 depends on a period of time during which the element voltage vf is applied; namely, an amount of charges trapped by the anode electrode 34 can be controlled with a period of time during which the element voltage Vf is applied, additionally, in the more preferable case, both the element current If and the emission current Ie in the element has a monotonously increasing characteristic (called an MI characteristic) with respect to a voltage applied to a pair of element electrodes facing each other, electrons emitted from the electron emitting element of surface conduction type are controlled with the height and width of a pulse voltage applied between the element electrodes facing each other when the pulse voltage is higher than the threshold voltage. However, those electrons are little emitted when the pulse voltage is lower than the threshold voltage.

Based on the above features, even for an array of numerous electron emitting elements, e.g., a device comprising plural electron emitting elements of surface conduction type which are each constituted by at least element electrodes and thin films inclusive of electron emitting regions and are arrayed in a matrix pattern on a base plate, the pairs of opposite element electrodes being respectively connected to m lines of row wirings and then n lines of column wirings laminated over the former wirings via insulating layers, a driving method which can select one of the electron emitting elements of surface conduction type and controlling an amount of electrons emitted therefrom in accordance with an input signal, by providing modulation means for producing a pulse having a height, a width, or a height and width depending on the input signal, and select means, which may be called scanning means, V for selecting the electron emitting element row successively one by one in accordance with the sync signal which is contained in the input signal.

Thus, according to the novel construction and driving method of the present invention based on the characteristics of an electron emitting element of surface conduction type, there is obtained a high-quality electron source which comprises numerous electron emitting elements of surface conduction type, and which can successively select the electron emitting elements and control an amount of emitted electrons in accordance with input signals by applying scan signals and modulation signals, both obtained from the input signals, to m lines of row wirings and n lines of column wirings one by one, respectively without using grid electrodes which have been essential in the prior art.

Further, with the arrangement including pairs of opposite element electrodes in the electron emitting elements of surface conduction type, m lines of row wirings and n lines of column wirings, at least part of lines repsectively connecting in parallel the pairs of opposite element electrodes in the electron emitting elements of surface conduction type the m lines of row wirings and the n lines of column wirings are partially or totally the same in their constituent elements. Therefore, particularly when a high temperature is applied during manufacture of the device, the problem of connecting between different kinds of metals is solved; hence the inexpensive and simple device structure can be provided with high reliability.

Moreover, since insulating layers are present only in the vicinity of points where the m lines of row wirings and the n lines of column wirings cross each other, and a part or all of the insulating layers in the stepped portions of the vertical electron emitting elements of surface conduction type is manufactured by the same process, the manufacture method is simplified in such a point that the m lines of row wirings or the n lines of column wirings can be connected electrically to the elements without using contact holes. As a result, there can be provided an electron source and an image forming device which are inexpensive and simple in structure.

According to another driving method of the present invention, input signal dividing means for dividing input signals into plural groups of input signals is further provided, and plural rows (or columns) of the electron emitting elements of surface conduction type are selected and modulated in accordance with each group of divided plural input signals generated by the input signal dividing means, thereby providing a divided driving method. Therefore, a time allowed for each row (or column) of the electron emitting elements of surface conduction type can be increased; hence a driving IC and the electron emitting elements of surface conduction type can be designed with greater allowance.

Further, according to that driving method, the row (or column) of the electron emitting elements adjacent to the row (or column) of the electron emitting elements being selected and modulated are maintained in a state under a constant potential applied. Therefore, no crosstalk occurs between electron beams emitted from the electron emitting elements on the image forming member to which the electron beams are irradiated.

According to the electron source of the present invention, since plural electron beams emitted from plural electron emitting portions in each electron emitting element of surface conduction type are superposed with each other, the electron beams can be controlled into a highly symmetrical shape on the electron irradiated surface.

Also, by properly specifying the element array pitch in the Y-direction, it is possible to control superposition between the electron beams emitted from the electron emitting elements on the surface to which the electron beams are irradiated.

As a result, there can be provided an electron source which can easily select those electron emitting elements from which electrons are to be emitted and also control an amount of the emitted electrons with a simple structure.

The image forming device, e.g., the display, of the present invention is a device for forming an image in accordance with input signals, the device comprising plural electron emitting elements of surface conduction type which are each constituted by at least element electrodes and thin films inclusive of electron emitting regions, are arrayed in a matrix pattern on a base plate corresponding to pixels making up an image, and the pairs of opposite element electrodes are respectively connected to m lines of row wirings and the n lines of column wirings laminated over the former wirings via insulating layers according to the input signal which is composed of synch signals and image signals, select means for selecting a desired row of the plural electron emitting elements of surface conduction type in accordance with the synch signals, and modulation means for producing modulation signals depending on the image signals and inputting the modulation signals to the electron emitting elements selected by the select means in accordance with the synch signals. Particularly, the image forming device includes fluorescent materials which are positioned in opposite relation to a base plate of the electron source and produce visible lights upon irradiation of electron beams. Preferably, the image forming device contains a vacuum therein and has such a feature that both the element current and the emission current in each electron emitting element of surface conduction type exhibits monotonically increasing characteristic (called an MI characteristic) with respect to a voltage applied to the pair of opposite element electrodes.

Thus, according to the novel construction and driving method of the present invention based on the characteristics of an electron emitting element of surface conduction type there is obtained a device which includes an electron source comprising numerous electron emitting elements of surface conduction type, which can successively select the electron emitting elements and control an amount of emitted electrons in accordance with input signals by applying scan signals and modulation signals, both obtained from the input signals, to m lines of row wirings and n lines of column wirings one by one, respectively, without using grid electrodes which have been essential in the prior art, and which can eliminate crosstalk between pixels, modulate display luminance with good control performance, and further enables display in finer gradations, making it possible to display a TV image with high quality, for example.

Also, since the fluorescent materials are directly excited by the electron beams in a vacuum, those fluorescent substances in respective colors which are conventionally well known in the art of CRT and have superior luminescent characteristics, can be used as light emitting sources. It is therefore possible to easily realize color display and represent a large range of hues. Additionally, color display can be achieved just by separately coating the fluorescent materials respective colors, and the display panel can easily be manufactured. Since the voltages required for scan and modulation are small, electric circuits can easily be integrated. These advantages cooperatively make it possible to reduce a production cost and realize an extremely inexpensive display. As a result, there can be provided an image forming device such as a display which can emit lights with brightness selectively controlled and hence has high display quality.

Further, with the arrangement including pairs of opposite element electrodes in the electron emitting elements of surface conduction type, m lines of row wirings and n lines of column wirings, at least part of lines respectively connecting in parallel the pairs of opposite element electrodes in the electron emitting elements of surface conduction type, the m lines of row wirings and the n lines of column wirings are partially or totally the same in their constituent members.

The electron emitting elements of surface conduction type are formed on the base plate or the insulating layers.

The insulating layers are present only in the vicinity of points where the m lines of row wirings and the n lines of column wirings cross each other, and a part or all of the insulating layers in the stepped portions of the vertical electron emitting elements of surface conduction type is of the same structure.

Because of including the electron source having the above structural features, there can be provided an image forming device which is highly reliable, is inexpensive, and has a novel structure.

According to another driving method adapted for the novel image forming device of the present invention, input signal dividing means for dividing input signals into plural groups of input signal is further provided, and plural rows (or columns) of the electron emitting elements of surface conduction type are selected and modulated in accordance with each group of divided plural input signals generated by the input signal dividing means, thereby providing a divisional driving method. Therefore, a time allowed for each row (or column) of the electron emitting elements of surface conduction type can be increased; hence a driving IC and the electron emitting elements of surface conduction type can be designed with greater allowance.

Further, according to that driving method, the row (or column) of the electron emitting elements adjacent to the row (or column) of the electron emitting elements being selected and modulated are maintained in a state under a constant potential applied. Therefore, no crosstalk occurs between electron beams emitted from the electron emitting elements on the image forming member.

According to the image forming device of the present invention, since plural electron beams emitted from plural electron emitting portions in each electron emitting element of surface conduction type are superposed with each other on the image forming member, a resulting luminescent bright spot can be controlled into a highly symmetrical shape.

Also, by properly specifying the element array pitch in the Y-direction, it is possible to control superposition between the electron beams emitted from the electron emitting elements on the image forming member, with the result that a high-quality image corresponding to the input image can be presented.

In addition, since the image forming device of the present invention can use TV signals, signals from image input devices, image memories and computers, etc. as input signals, even a single unit can have functions of a display for TV broadcasting, a terminal for TV conferences, an image editor handling still and motion pictures, a computer terminal, an office automation terminal including a work processor, a game machine and so on; hence it can be applied to very wide industrial and domestic fields.

What is claimed is:

1. An electron source adapted to emit electrons as a function of input signals, said electron source comprising:

a substrate;

a matrix of wires having m row wires and n column wires laid on said substrate with an insulator layer interposed therebetween; and a plurality of surface-conduction electron-emitting devices each having a pair of electrodes and a thin film including an electron emitting region and arranged between said electrodes, each of said plurality of surface-conduction electron emitting devices having a device current and an electron emission current monotonically increasing as a function of the device voltage thereto, said plurality of surface-conduction electron-emitting devices being so arranged as to form a matrix with said electrodes connected to the respective row and column wires;

selection means for selecting a row of said plurality of surface-conduction electron-emitting devices; and modulation means for generating modulation signals according to input signals and applying the modulation signals to said surface-conduction electron-emitting devices selected by said selection means.

2. An electron source according to claim 1, wherein said surface-conduction electron-emitting devices are plane type surface-conduction electron-emitting devices.

3. An electron source according to claim 1, wherein said surface-conduction electron-emitting device are step type surface-conduction electron-emitting devices.

4. An electron source according to claim 3, wherein said step type surface-conduction electron-emitting devices have a step region serving as at least part of said insulator layer.

5. An electron source according to claim 3, wherein said step type surface-conduction electron-emitting devices have a step region made of a material same as or containing at least an ingredient common with the material of said insulator layer.

6. An electron source according to claim 1, wherein said thin film including an electron emitting region constituted of conductive fine particles.

7. An electron source according to claim 6, wherein said conductive fine particles are made of at least a material selected from Pd, Ru, Ag, Au, Ti, In, Cu, Cr, Fe, Zn, Sn, Ta, W, Pb, PbO, $SnO_2$, $In_2O_3$, PdO, $Sb_2O_3$, $HfB_2$, $ZrB_2$, $LAB_6$, $CeB_6$, $YB_4$, $GdB_4$, TiC, ZrC, HfC, TaC, SiC, WC, TiN, ZrN, HfN, Si, Ge, carbon, Ag-Mg.

8. An electron source according to claim 1, wherein said thin film including an electron emitting region, said device electrodes, said m row wires, said n column wires or the material of said connection or any combinations thereof are partially or totally the same in their constituent elements.

9. An electron source according to claim 1, wherein said insulator layer is arranged only on and near the crossings of said m row wires and said n column wires.

10. An electron source according to claim 1, wherein said surface-conduction electron-emitting devices are formed on said substrate.

11. An electron source according to claim 1, wherein said surface-conduction electron-emitting devices are formed on said insulator layer.

12. An electron source according to claim 1, wherein two or more than two of a plurality of electron beams emitted from said plurality of surface-conduction electron-emitting devices are collected together.

13. An electron source according to claim 1, wherein said modulation means generate pulses having a variable pulse height determined as a function of said input signals.

14. An electron source according to claim 1, wherein said modulation means generate pulses having a variable pulse width determined as a function of said input signals.

15. An electron source according to claim 1, wherein said modulation means generate pulses having a variable pulse height and a variable pulse width determined as a function of said input signals.

16. An electron source according to claim 1, wherein it further comprises separation means for drawing synchronizing signals from said input signals and said selection means sequentially select a row of said surface-conduction electron-emitting devices according to said synchronizing signals.

17. An electron source according to claim 1, wherein said selection means select a row of said surface-conduction electron-emitting devices by generating pulses having different heights.

18. An electron source according to claim 17, wherein the selected row of electron-emitting devices are modulated by pulses generated by said modulation means and having a variable pulse height determined as a function of said input signals.

19. An electron source according to claim 17, wherein the selected row of electron-emitting devices are modulated by pulses generated by said modulation means and having a variable pulse width determined as a function of said input signals.

20. An electron source according to claim 17, wherein the selected row of electron-emitting devices are modulated by pulses generated by said modulation means and having variable pulse height and pulse width determined as a function of said input signals.

21. An electron source according to claim 1, wherein it further comprises division means for dividing the input signals into a plurality of signal groups, said plurality of rows and columns of surface-conduction type electron-emitting devices being so adapted as to be selected according to the signals for the plurality of signal groups generated by said division means.

22. An electron source according to claim 21, wherein a constant voltage is applied to the rows or columns adjacent to the selected ones.

23. An image-forming apparatus adapted to form images as a function of input signals comprising:

an electron source; and an image-forming member;

said electron source comprising:

a substrate;

a matrix of wires having m row wires and n column wires laid on said substrate with an insulator layer interposed therebetween; and a plurality of surface-conduction electron-emitting devices each having a pair of electrodes and a thin film including an electron emitting region and arranged between said electrodes, each of said plurality of surface-conduction electron emitting devices having a characteristic for a device current and an electron emission current monotonically increasing as a function of the device voltage applied thereto, said plurality of surface-conduction, electron-emitting devices being so arranged as to form a matrix with said electrodes connected to the respective row and column wires;

selection means for selecting a row of said plurality of surface-conduction electron-emitting devices; and modulation means for generating modulation signals according to input signals and applying the modulation signals to said surface-conduction electron-emitting devices selected by said selection means.

24. An image-forming apparatus according to claim 23, wherein said surface-conduction electron-emitting devices are plane type surface-conduction electron-emitting devices.

25. An image-forming apparatus according to claim 23, wherein said surface-conduction electron-emitting device are step type surface-conduction electron-emitting devices.

26. An image-forming apparatus according to claim 25, wherein said step type surface-conduction electron-emitting devices have a step region serving as at least part of said insulator layer.

27. An image-forming apparatus according to claim 25, wherein said step type surface-conduction electron-emitting devices have a step region made of a material same as or containing at least an ingredient common with the material of said insulator layer.

28. An image-forming apparatus according to claim 23, wherein its inside is held to such a degree of vacuum that said surface-conduction electron-emitting devices has a characteristic for its device current and electron emission current of monotonously increasing as a function of the device voltage applied thereto.

29. An image-forming apparatus according to claim 23, wherein said thin film including an electron emitting region constituted of conductive fine particles.

30. An image-forming apparatus according to claim 29, wherein said conductive fine particles are made of at least a material selected from Pd, Ru, Ag, Au, Ti, In, Cu, Cr, Fe, Zn, Sn, Ta, W, Pb, PbO, $SnO_2$, $In_2O_3$, PdO, $Sb_2O_3$, $HfB_2$, $ZrB_2$, $LAB_6$, $CeB_6$, $YB_4$, $GdB_4$, TiC, ZrC, HfC, TaC, SiC, WC, TiN, ZrN, HfN, Si, Ge, carbon, Ag-Mg.

31. An image-forming apparatus according to claim 23, wherein at least said thin film including an electron emitting region, said device electrodes, said m row wires, said n column wires or the material of said connection or any combinations thereof are partially or totally the same in their constituent elements.

32. An image-forming apparatus according to claim 23, wherein said insulator layer is arranged only on and near the crossings of said m row wires and said n column wires.

33. An image-forming apparatus according to claim 23, wherein said surface-conduction electron-emitting devices are formed on said substrate.

34. An image-forming apparatus according to claim 33, wherein said plurality of electron emitting regions of said surface-conduction electron emitting device are mutually arranged with an interval W satisfying equation (I) below:

$$K_2 \times 2H(Vf/Va)^{1/2} \geqq W/2 \geqq K_3 \times 2H(Vf/Va)^{1/2} \quad \text{(I)}$$

where $K_2 = 1.25 \pm 0.05$, $K_3 = 0.35 \pm 0.05$,

H is the distance between the surface-conduction electron-emitting devices and the image-forming member, Vf is the voltage applied to the surface-conduction type electron-emitting device and Va is the voltage applied to the image-forming member.

35. An image-forming apparatus according to claim 23, wherein said surface-conduction type electron-emitting devices are formed on said insulator layer.

36. An image-forming apparatus according to claim 23, wherein two or more than two of a plurality of electron beams emitted from said plurality of surface-conduction electron-emitting devices are collected together on the said image forming member.

37. An image-forming apparatus according to claim 23, wherein said plurality of electron emitting regions of said plurality of surface-conduction electron emitting devices are mutually arranged with pitch P for the columns satisfying equation (II) below:

$$P<L+2K_5\times 2H(Vf/Va)^{1/2} \quad \text{(II)}$$

where $K_5=0.8$,

L is the distance of the columns of surface-conduction electron-emitting device, H is the distance between the surface-conduction type electron-emitting devices and the image-forming member, Vf is the voltage applied to the surface-conduction type electron-emitting device, and Va is the voltage applied to the image-forming member.

38. An image-forming apparatus according to claim 23, wherein said plurality of electron emitting regions of said plurality of surface-conduction type electron emitting devices are mutually arranged with pitch P for the columns satisfying equation (III) below:

$$P\geqq L+2K_6\times 2H(Vf/Va)^{1/2} \quad \text{(III)}$$

where $K_6=0.9$,

L is the distance of the columns of surface-conduction type electron-emitting device, H is the distance between the surface-conduction type electron-emitting devices and the image-forming member, Vf is the voltage applied to the surface-conduction electron-emitting device, and Va is the voltage applied to the image-forming member.

39. An image-forming apparatus according to claim 23, wherein said modulation means generate pulses having a variable pulse height determined as a function of said input signals.

40. An image-forming apparatus according to claim 23, wherein said modulation means generate pulses having a variable pulse width determined as a function of said input signals.

41. An image-forming apparatus according to claim 23, wherein said modulation means generate pulses having a variable pulse height and a variable pulse width determined as a function of said input signals.

42. An image-forming apparatus according to claim 23, wherein it further comprises separation means for drawing synchronizing signals from said input signals and said selection means sequentially select row of said surface-conduction type electron-emitting devices according to said synchronizing-signals.

43. An image-forming apparatus according to claim 23, wherein said selection means select row of said surface-conduction type electron-emitting devices by generating pulses having different heights.

44. An image-forming apparatus according to claim 23, wherein the selected row of electron-emitting devices are modulated by pulses generated by said modulation means and having a variable pulse height determined as a function of said input signals.

45. An image-forming apparatus according to claim 23, wherein the selected row of electron-emitting devices are modulated by pulses generated by said modulation means and having a variable pulse width determined as a function of said input signals.

46. An image-forming apparatus according to claim 23, wherein the selected row of electron-emitting devices are modulated by pulses generated by said modulation means and having variable pulse height and pulse width determined as a function of said input signals.

47. An image-forming apparatus according to claim 23, wherein it further comprises division means for dividing the input signals into a plurality of signal groups, said plurality of rows or columns of surface-conduction electron-emitting devices being so adapted as to be selected according to the signals for the plurality of signal groups generated by said division means.

48. An image-forming apparatus according to claim 23, wherein a constant voltage is applied to the rows or columns adjacent to the selected ones.

49. An image-forming apparatus according to claim 23, wherein said image-forming member is made of a fluorescent material.

50. An image-forming apparatus according to claim 23, wherein said input signals are at least TV signals, signals fed from an image input apparatus, signals fed from an image memory or signals fed from a computer of any combinations thereof.

51. Use of the electron source of any of claims 1–22 for an image-forming apparatus.

52. Use of the electron source of any of claims 1–22 for a display apparatus.

53. Use of the image-forming apparatus of any of claims 23–50 for a television set.

54. Use of the image-forming apparatus of any of claims 23–50 for a computer terminal unit.

* * * * *